US007534538B2

(12) United States Patent
Niimi et al.

(10) Patent No.: US 7,534,538 B2
(45) Date of Patent: May 19, 2009

(54) COATING LIQUID FOR INTERMEDIATE LAYER IN ELECTROPHOTOGRAPHIC PHOTOCONDUCTOR, ELECTROPHOTOGRAPHIC PHOTOCONDUCTOR UTILIZING THE SAME, IMAGE FORMING APPARATUS AND PROCESS CARTRIDGE FOR IMAGE FORMING APPARATUS

(75) Inventors: Tatsuya Niimi, Numazu (JP); Maiko Kondo, Ebina (JP); Nozomu Tamoto, Numazu (JP); Katsuichi Ohta, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 505 days.

(21) Appl. No.: 11/219,886

(22) Filed: Sep. 7, 2005

(65) Prior Publication Data

US 2006/0057479 A1 Mar. 16, 2006

(30) Foreign Application Priority Data

Sep. 8, 2004 (JP) ..... 2004-260456

(51) Int. Cl.
*G03G 5/14* (2006.01)

(52) U.S. Cl. ..... 430/64; 430/59.4; 430/66; 430/131

(58) Field of Classification Search ..... 430/59.4, 430/131, 60, 134, 64, 66; 399/159
See application file for complete search history.

(56) References Cited

U.S. PATENT DOCUMENTS 4,400,455 A 8/1983 Hashimoto et al.
4,863,822 A 9/1989 Fukagai et al.
5,578,405 A 11/1996 Ikegami et al.
5,871,876 A 2/1999 Ikuno et al.
6,355,390 B1 * 3/2002 Yamanami et al. ..... 430/60
6,558,863 B2 * 5/2003 Rokutanzono et al. ..... 430/58.7
6,861,188 B2 3/2005 Ikegami et al.
6,899,983 B2 5/2005 Tamoto et al.
6,936,388 B2 8/2005 Suzuki et al.
2004/0033428 A1 2/2004 Niimi
2004/0053149 A1 3/2004 Toda et al.
2004/0126687 A1 7/2004 Ikegami et al.
2004/0234875 A1 11/2004 Toda et al.
2004/0248024 A1 * 12/2004 Suzuki et al. ..... 430/66
2005/0008957 A1 1/2005 Ikegami et al.
2005/0069797 A1 3/2005 Niimi et al.

(Continued)

FOREIGN PATENT DOCUMENTS

JP 63-18185 1/1988

(Continued)

OTHER PUBLICATIONS

U.S. Appl. No. 11/749,292, filed May 16, 2007, Inaba et al.

(Continued)

*Primary Examiner*—John L Goodrow
(74) *Attorney, Agent, or Firm*—Oblon, Spivak, McClelland, Maier & Neustadt, P.C.

(57) ABSTRACT

A coating liquid for an intermediate layer of an electrophotographic photoconductor comprises at least one of alcohol solvents; and N-methoxymethylated nylon, in which the N-methoxymethylated nylon has solution viscosity within a range from 43 mPa·s to 50 mPa·s when dissolving into methanol at 30° C. in a concentration of 20% by mass.

19 Claims, 13 Drawing Sheets

U.S. PATENT DOCUMENTS

| | | | |
|---|---|---|---|
| 2005/0141919 | A1 | 6/2005 | Kitajima et al. |
| 2005/0158644 | A1 | 7/2005 | Kondo et al. |
| 2005/0175911 | A1 | 8/2005 | Tamoto et al. |

FOREIGN PATENT DOCUMENTS

| | | |
|---|---|---|
| JP | 1-177556 | 7/1989 |
| JP | 3-248161 | 11/1991 |
| JP | 3-288157 | 12/1991 |
| JP | 4-269761 | 9/1992 |
| JP | 5-72787 | 3/1993 |
| JP | 5-80572 | 4/1993 |
| JP | 6-102692 | 4/1994 |
| JP | 6-202366 | 7/1994 |
| JP | 6-93129 | 11/1994 |
| JP | 7-295267 | 11/1995 |
| JP | 9-62021 | 3/1997 |
| JP | 2000-56494 | 2/2000 |
| JP | 2000-147814 | 5/2000 |
| JP | 2002-287393 | 10/2002 |
| JP | 2002-333803 | 11/2002 |
| JP | 2004-83859 | 3/2004 |
| JP | 2004-163862 | 6/2004 |

OTHER PUBLICATIONS

U.S. Appl. No. 11/474,258, filed Jun. 26, 2006, Niimi.
U.S. Appl. No. 11/852,708, filed Sep. 10, 2007, Tada et al.
U.S. Appl. No. 11/853,490, filed Sep. 11, 2007, Miyamoto et al.
U.S. Appl. No. 11/855,553, filed Sep. 14, 2007, Inaba et al.
U.S. Appl. No. 11/850,394, filed Sep. 5, 2007, Toshine et al.
U.S. Appl. No. 11/219,886, filed Sep. 7, 2005, Niimi et al.
U.S. Appl. No. 09/566,958, filed May 8, 2000, Niimi et al.
U.S. Appl. No. 11/611,179, filed Dec. 15, 2006, Niimi et al.
U.S. Appl. No. 11/304,711, filed Dec. 16, 2005, Kondo et al.
U.S. Appl. No. 12/020,713, filed Jan. 28, 2008, Matsumoto et al.
U.S. Appl. No. 11/625,873, filed Jan. 23, 2007, Niimi.

* cited by examiner

COATING LIQUID FOR INTERMEDIATE LAYER IN ELECTROPHOTOGRAPHIC PHOTOCONDUCTOR, ELECTROPHOTOGRAPHIC PHOTOCONDUCTOR UTILIZING THE SAME, IMAGE FORMING APPARATUS AND PROCESS CARTRIDGE FOR IMAGE FORMING APPARATUS

BACKGROUND OF THE INVENTION

1. Field of the Invention

The present invention relates to an electrophotographic photoconductor used in a laser beam printer, facsimile machine, digital copier and the like, and to an electrophotographic apparatus and a process cartridge using the electrophotographic photoconductor.

2. Description of the Related Art

Conventionally, various efforts have been made to develop electrophotographic photoconductors utilizing organic photoconductive materials exhibiting outstanding properties in terms of sensitivity, thermal stability, and toxicity and the like for such inorganic materials as Se, CdS, and ZnO, as photoconductive materials used in electrophotographic photoconductors, and electrophotographic photoconductors utilizing organic photoconductive materials are now employed in many copiers and printers. In the case of forming a photoconductive layer of the electrophotographic photoconductor using the organic photoconductive material, a function-separating type photoconductor in which a charge transporting layer is provided on a charge generating layer is widely used because it excels in sensitivity and durability. In general, in an image forming apparatus such as a printer, copier, or facsimile machine, image formation is carried out by a train series of steps, namely charging step, exposing step, developing step, and transferring step, fixing step. While the high speed and high durability of electrophotographic copiers have advanced in recent years, reliability in a photoconductor to maintain high picture quality even when there is repeated use for an extended period of time is in strong demand. Since copy volume is particularly great in a super high speed copier, stopping the copier many times to replace the photoconductor causes a great reduction of productivity. Further, in a color copier, a tandem system in which four-color development systems are arranged in parallel is widely adopted, and in order to prevent the entire copier from becoming larger in size, use is made of a small-diameter photoconductor in comparison with a conventional one, so additional high durability in a photoconductor is required in response to the high speed of a machine.

Concerning durability, as an abnormal pictures created by the photoconductor, background smear is provided in a current image forming system where negative-positive development is the norm. In the meantime, it is known that it is effective to provide an intermediate layer between a support and a photoconductive layer including a charge generating layer and a charge transporting layer.

For example, Japanese Patent Application Laid-Open (JP-A) No. 47-6341 discloses a cellulose nitrate-base resin intermediate layer; JP-A No. 60-66258 discloses a nylon-base resin intermediate layer; JP-A No. 52-10138 discloses a maleic acid-base resin intermediate layer; and JP-A No. 58-105155 discloses a polyvinyl alcohol resin intermediate layer. However, since these single resin (single layer) intermediate layers have high electric resistance, residual potential is generated, and thus there is picture density reduction in negative-positive development. In addition, because ionic conductivity originated by impurities is indicated, the electric resistance in the intermediate layer becomes especially high at lower temperature and lower humidity, and the residual potential remarkably rises. Consequently, it is necessary for the intermediate layer to be a thin film, with the deficiency that there is an insufficient electrostatic property after repeated use.

In order to solve these problems, as a technology to control the electric resistance of the intermediate layer, the addition of conductive additives to the intermediate layer bulk has been proposed. For example, JP-A No. 51-65942 discloses an intermediate layer formed by dispersing carbon or chalcogen-base substance in a curing resin; JP-A No. 52-82238 discloses a thermal polymer intermediate layer formed by addition of quaternary ammonium salt and by use of an isocyanate-base hardening agent; JP-A No. 55-113045 discloses a resin intermediate layer in which resistance modifier is added; and JP-A No. 58-93062 discloses a resin intermediate layer in which organic metal compound is added. However, these single resin intermediate layers have the problem that a moire image may be generated in a recent image forming apparatus using a coherent light, such as a laser beam.

In addition, for the purpose of simultaneously preventing the moire image and controlling the electric resistance of the intermediate layer, a photoconductor of which the intermediate contains filler has been proposed. For example, JP-A No. 58-58556 discloses a resin intermediate layer in which aluminum or tin oxide is dispersed; JP-A No. 60-111255, a resin intermediate layer in which conductive particles are dispersed; JP-A No. 59-17557 discloses an intermediate layer in which magnetite is dispersed; JP-A No. 60-32054 discloses a resin intermediate layer in which titanium oxide and tin oxide are dispersed; and JP-A Nos. 64-68762, 64-68763, 64-73352, 64-73353, 1-118848 and 1-118849 disclose a resin intermediate layer in which fine particles of boride, nitride, fluoride or oxide of calcium, magnesium or aluminum, are dispersed. For these intermediate layers in which filler is dispersed, in order to present the potential characteristic of the intermediate layer by the dispersed filler, it is necessary to increase the quantity of filler in the intermediate layer, that is, it is necessary to reduce the quantity of resin. Consequently, there is the problem that accompanying the reduction of the amount of resin, adhesion with the support decreases, so peelings between the support and the intermediate layer easily occurs, and in particular, if the support has a flexible belt-like structure, the problem becomes notable.

In order to solve the problem, an approach to provide a laminated intermediate layer has been proposed. The construction of the lamination is roughly divided into two types. One is constructed such that, as shown in FIG. 1, resin layer 303*c* in which filler is dispersed is provided on the support 301, and then another resin layer 303*d* which does not contain filler is laminated on the resin layer 303*c*. Another is constructed such that, as shown in FIG. 2, resin layer 303*d* which does not contain filler is disposed on the support 301, and the resin layer 303*c* in which filler is dispersed is laminated on the resin layer 303*d*.

Describing the former construction in detail, in order to hide support related defects, a conductive layer in which filler with low resistance is dispersed is provided on the support, on which the resin layer 303*d* is laminated. Such construction is described, for example, in JP-A Nos. 58-95351, 59-93453, 4-170552, 6-208238, 6-222600, 8-184979, 9-43886, 9-190005 and 9-288367. In such construction, since the conductive layer which is a lower layer essentially fulfills the role of an electrode in the support, the above-mentioned electrostatic defects of the photoconductor are still the same as the photoconductor having the single resin intermediate layer. Uniquely, since the conductive layer is composed of a filler dispersed film, scattering of recording light by this layer results in the provision of the moire prevention function. In such construction, because the lower layer is a conductive layer, attaining a charge with opposite polarity to that electrified on the surface of the photoconductor to the interface of the lower layer (conductive layer) and the upper layer (resin intermediate layer) at the time of electrification of the photoconductor results in the realization of the photoconductor action. However, if the resistance of the conductive layer is not so low, the charge injection from the electrode is not sufficiently conducted, and the lower layer becomes a resistance component upon the repeated use, causing a very great rise of the residual potential. In particular, in order to cover defects of the support, which is an objective of this construction, it is essential that the lower layer should be sufficiently thick (10 μm or more), which is a notable problem.

In the meantime, the latter is constructed that the resin single layer having an electron hole blocking function is provided on the support, on which the resin layer in which filler with low resistance or conductive filler is dispersed is provided. Such construction is described, for example, in JP-A Nos. 5-80572 and 6-19174. Since this construction has an electron hole blocking function similar to the former construction, it effectively functions as a background smear. Further, because the filler dispersed film exists on the upper layer; compared to the former construction, the accumulation of the residual potential is lower. In this construction, since the charge (electron hole) injection to the photoconductive layer from the support can be prevented as described above, the background smear phenomenon in the negative-positive development can be considerably reduced. Further, the arrangement of the charge blocking layer to the lower layer also enables the reduction of the rise of the residual potential due to the repeated use, compared to the case of arranging it to the upper layer.

In addition, in JP-A No. 8-44096 discloses an intermediate layer in which the volume content of the contained thermosetting resin is 0.5-0.6 and in which titanium oxide with the provided average particle size is dispersed; JP-A No. 10-301314 discloses an intermediate layer formed by mixing colloid-state alumina into organoalkoxysilane, followed by heating and hardening the mixed composition; JP-A No. 10-90931 discloses an intermediate layer in which thermally-treated titanium oxide is contained in the resin; and JP-A No. 9-34152 discloses an intermediate layer containing a compound selected from metal alkoxide, organic metal chelate, a silane coupling agent and these reaction products on a conductive substrate composed of pure aluminum, aluminum-manganese-base alloy, aluminum-magnesium-base alloy or aluminum-magnesium-silica-base alloy. In any case, the objective is to reduce the background smear phenomenon in negative-positive development by preventing the charge injection from the support to the photoconductive layer.

The resin materials used for these intermediate layers require some functions. The following are provided: (1) in the case of coating a photoconductive layer containing a charge generating layer and a charge transporting layer on the intermediate layer using the wet deposition method, to have the anti-solvent property of not being easily dissolved in a solvent or not for deforming; (2) in order to secure the electric barrier property or not to affect the coating property of the upper layer, to be able to obtain a uniform deposition property without any film defect; and (3) to require excellent adhesion with the support. Consequently, a polyamide-base rein is preferably used as disclosed, for example, in Japanese Patent (JP-B) Nos. 3226110 and 2885609.

However, in general, alcohol soluble polyamide-base resin has a problem, which is the change of the electric resistance according to the use environment. In other words, a photoconductor having the intermediate layer made of alcohol soluble polyamide resin has the problem of great environment dependency, for example, resistance becomes higher and residual potential rises in an environment of lower humidity, and the resistance becomes lower and causes electrification reduction in a environment of high humidity. For this problem, it is known that using polyamide rein, especially N-alkoxymethylated nylon, results in reduced environmental dependency (for example, JP-A Nos. 6-202366 and 63-18185 and Japanese Patent Publication (JP-B) No. 6-93129).

For example, JP-A No. 9-265202 discloses that alkoxymethylated copolymerized nylon with 5 to 30% of degree of alkoxymethylation is contained in an undercoat layer; JP-A No. 2002-107984 discloses that inorganic pigment and N-alkoxymethylated polyamide cross-linked as a binder resin are contained in an intermediate layer; JP-B No. 2718044 discloses that an undercoat layer is composed of N-alkoxymethylated nylon resin, and the element concentrations of impurities, Na and Ca and P atoms, contained in the resin are 10 ppm or less, respectively; JP-B No. 3086965 discloses that N-alkoxymethylated polyamide copolymer in which λ-amino-n-lauric acid is regarded as a main ingredient is contained in an intermediate layer; the above-mentioned JP-B No. 3226110 discloses a method to contain a polyamide resin having a unit component having one structure in an intermediate layer; the above-mentioned JP-A No. 6-202366 discloses an intermediate layer containing an electron-accepting substance along with methoxymethylated nylon; the above-mentioned JP-A No. 63-18185 discloses an intermediate layer containing either N-alkoxymethylated nylon or N-alkylated nylon; and the above-mentioned JP-B No. 6-93129 discloses an intermediate layer containing N-methoxymethylated nylon 6 in which a component(s) whose molecular weight is 1000 or less is contained 10 ppm or less.

In addition to these, in JP-A Nos. 4-170552, 6-208238 and 8-184979, an intermediate layer containing a charge blocking layer containing N-methoxymethylated nylon on a moire preventive layer, which is provided on the support for the purpose of preventing the moire phenomenon due to the interference of a laser beam, is presented.

Although he N-alkoxymethylated nylon is usefully used as a material for an intermediate layer as described above; except for a part of the material, it is dissolved only in an alcohol-based solvent. Consequently, in the case of using the N-alkoxymethylated nylon for an intermediate layer, it is used in a dissolved state in an alcohol-base solvent. However, according to the study by the present inventors, it has been found that there is the great problem that a coating liquid prepared by dissolving the N-alkoxymethylated nylon in an alcohol-base solvent becomes clouded and the viscosity increases (gelated) after storage for an extended period of time or at low temperature. This is not mentioned in detail in the above-mentioned references.

In the meantime, JP-A No. 9-152731 discloses a technology to obtain a long-term storage life by adding halogenated hydrocarbon to an alcohol-base solvent when forming a coating liquid containing alcohol soluble nylon. However, it is not preferable to use halogenated hydrocarbon because of recent environmental problems, so it is difficult to say that this technology can be effectively used, and is a technology that cannot be adopted for actual production.

JP-A No. 2000-56496 discloses a technology to use benzyl alcohol for a coating liquid containing alcohol soluble nylon. This enables extending the life of the coating liquid. However, it has defect that time for drying to touch at the time of coating deposition becomes longer, and thus non-uniformity of film easily occurs. Further, since benzyl alcohol is a solvent having a high boiling point, there is the defect that the drying temperature must be considerably high.

As described above, when coating the coating liquid for an intermediate layer containing N-alkoxymethylated nylon stored for a long term or in an environment of low temperature on the support, non-uniform film thickness or film defects, such as a pinhole, occur, inhibiting the function to block the charge from the support, and abnormal images, such as background smear or black void, are generated. Consequently, the usefulness of N-alkoxymethylated nylon has not yet been effectively utilized.

Further, because the pot life of the coating liquid is short, it is necessary to re-produce it in a short term, with the problem of increased production costs.

As described above, although N-alkoxymethylated nylon is useful as a material for an intermediate layer of the electrophotographic photoconductor, it has the above-mentioned defects, which must be solved.

SUMMARY OF THE INVENTION

Therefore, an object of the present invention is to provide a coating liquid for an intermediate layer of an electrophotographic photoconductor excelling in film uniformity even in the case of using a coating liquid stored for an extended period of time. Further, another object of the present invention is to provide an electrophotographic photoconductor which can prevent generation of abnormal images, such as background smear or black void, due to the repeated use through a long term, and which can provide excellent images excelling in the environmental stability, by manufacturing the photoconductor with the use of the coating liquid, and to provide an electrographic apparatus and a process cartridge equipped with the photoconductor with the use of the coating liquid.

The present inventors have diligently studied, and found that the above-mentioned problems are solved by the invention described below.

According to an aspect of the present invention, there is provided a coating liquid for an intermediate layer of an electrophotographic photoconductor, which comprises at least one of alcohol solvents and N-methoxymethylated nylon, wherein the N-methoxymethylated nylon has solution viscosity within a range from 43 mPa·s to 50 mPa·s when dissolving into methanol at 30° C. in a concentration of 20% by mass.

Preferably, the coating liquid comprises at least two different alcohol solvents.

Preferably, one of the alcohol solvents is methanol.

According to another aspect of the present invention, there is provided an electrophotographic photoconductor, which comprises a support, an intermediate layer and a photoconductive layer in this order, wherein the intermediate layer is formed using a coating liquid which comprises at least one of alcohol solvents and N-methoxymethylated nylon, and the N-methoxymethylated nylon has solution viscosity within a range from 43 mPa·s to 50 mPa·s when dissolving into methanol at 30° C. in a concentration of 20% by mass.

Preferably, the photoconductive layer comprises a charge generating layer and a charge transporting layer.

Preferably, the intermediate layer comprises multiple layers.

Preferably, the intermediate layer comprises a charge blocking layer and a moire preventive layer on the charge blocking layer.

Preferably, the charge blocking layer contains N-methoxymethylated nylon.

Preferably, a charge generating material contained in the charge generating layer is titanyl phthalocyanine.

Preferably, the titanyl phthalocyanine is titanyl phthalocyanine crystal showing a highest diffraction peak at least at 27.2°, main peaks at 9.4°, 9.6° and 24.0°; a diffraction peak as a lowest-angle leak at 7.3°, and has no peaks in a range between 7.3° and 9.4° and at 26.3° as Bragg 2θ angles (±0.2°) in terms of CuK-α characteristic X-ray wavelength at 1.542 Å; and having 0.25 μm or less of average particle size of primary particles.

Preferably, the photoconductive layer or the charge generating layer is formed by using the titanyl phthalocyanine crystal particles having an average particle size of 0.3 μm or less, dispersing the titanyl phthalocyanine crystal particles to prepare a dispersion till the standard deviation of the average particle size reduces to 0.2 μm or less, filtering the dispersion by means of a filter having an effective pore size of 3.0 μm or less, and coating the dispersion to form the photoconductive layer or the charge generating layer.

Preferably, the titanyl phthalocyanine crystal particles are formed through transforming amorphous or lower crystallinity titanyl phthalocyanine, which shows a highest diffraction peak in a range between 7.0° and 7.5° as Bragg 2θ angles (±0.2°) in terms of the CuK-α characteristic X-ray wavelength at 1.542 Å, a peak width at half height of the highest peak of 1° or more, and an average primary particle size of 0.1 μm or less, by using an organic solvent in the presence of water; and separating the transformed titanyl phthalocyanine from the organic solvent before the average primary particle size of the transformed titanyl phthalocyanine grows above 0.25 μm or more.

Preferably, the titanyl phthalocyanine particles are synthesized using raw materials free from halides.

Preferably, the amorphous or lower crystallinity titanyl phthalocyanine prior to the transforming is produced by an acid paste process that involves such sufficient rinsing with de-ionized water that the rinsed de-ionized water exhibits at least one of a pH of 6.0 to 8.0 and a specific conductivity of 8.0 or less.

Preferably, the transforming of the titanyl phthalocyanine is conducted using the organic solvent 30 times or more than the amount of the amorphous or lower crystallinity titanyl phthalocyanine.

Preferably, the photoconductor further comprises a protective layer on the photoconductive layer.

Preferably, the protective layer is a cross-linked protective layer having a charge transporting structure.

Preferably, the cross-linked protective layer comprises a reaction product of a radical polymerizable compound having one functionality and the charge transporting structure and a radical polymerizable monomer having three or more functionalities and no charge transporting structure, and a functional group of the radical polymerizable monomer having three or more functionalities and no charge transporting is at least one of acryloyloxy group and methacryloyloxy group.

According to still another aspect of the present invention, there is provided an image forming apparatus, which comprises an electrophotographic photoconductor, a charging unit configured to charge the photoconductor, an exposing unit configured to expose the charged photoconductor by the charging unit with a recording light to form a latent electrostatic image on the photoconductor, a developing unit configured to supply a developer to the latent electrostatic image to form a visible toner image on the photoconductor, and a transferring unit configured to transfer the toner image onto a transfer material, wherein the photoconductor comprises a support, an intermediate layer and a photoconductive layer in this order, the intermediate layer is formed using a coating liquid which comprises at least one of alcohol solvents and N-methoxymethylated nylon, and the N-methoxymethylated nylon has solution viscosity within a range from 43 mPa·s to 50 mPa·s when dissolving into methanol at 30° C. in a concentration of 20% by mass.

Preferably, the image forming apparatus comprises a plurality of image forming units each comprising at least the photoconductor, the charging unit, the exposing unit, and the developing unit.

Preferably, the image forming apparatus further comprises a cleaning unit, and wherein the photoconductor and at least one unit selected from the group consisting of the charging unit, the exposing unit, the developing unit and the cleaning unit are formed in an integral construction detachably mounted to a main body of the image forming apparatus.

According to still another aspect of the present invention, there is provided a process cartridge for an image forming apparatus, wherein the process cartridge is integrated with the a photoconductor and at least one unit selected from the group consisting of a charging unit configured to charge the photoconductor, an exposing unit configured to expose the charged photoconductor by the charging unit with a recording light to form a latent electrostatic image on the photoconductor, a developing unit configured to supply a developer to the latent electrostatic image to form a visible toner image on the photoconductor, a transferring unit configured to transfer the toner image onto a transfer material, a cleaning unit configured to clean the toner remaining on the photoconductor after the transferring, and a charge-eliminating unit configured to eliminate the latent electrostatic image on the photoconductor after the transferring, which is mounted detachably to a main body of an image forming apparatus, the photoconductor comprises a support, and an intermediate layer and a photosensitive layer in this order, the intermediate layer is formed using a coating liquid which comprises at least one of alcohol solvents and N-methoxymethylated nylon, and the N-methoxymethylated nylon has solution viscosity within a range from 43 mPa·s to 50 mPa·s when dissolving into methanol at 30° C. in a concentration of 20% by mass.

As is apparent from the following detailed and specific description, according to the present invention, a coating liquid for an intermediate layer of an electrophotographic photoconductor contains at least N-methoxymethylated nylon which is selected according to the methanol viscosity measuring method defined in the present invention, thus it is possible to prevent the viscosity increases and the gelation of the coating liquid, and it is also possible to produce a coating liquid with a fewer change of the physical property of the coating liquid after the storage for an extended period of time or in an environment of low temperature. Further, the present invention demonstrates an extremely excellent effect of obtaining a film having uniform thickness without any defect even upon the ling-term production, by using the coating liquid.

Further, in the case of forming an intermediate layer containing N-alkoxymethylated nylon, using N-alkoxymethylated nylon selected according to the methanol viscosity measuring method enables the uniform coating of the intermediate layer, and the generation of abnormal images, such as background smear, is very few, and stable images can be obtained even under a different environment, and in addition, it demonstrates an extremely excellent effect that an electrophotographic photoconductor enabling the maintenance of stable images and the transmission of highly durable and highly stable images can be formed. Specifically, it demonstrates an extremely excellent effect to provide a highly durable photoconductor, which enables the reduction of background smear generation due to the repeated use, the reduction of the residual potential, the reduction of environmental dependency, and moire control.

Further, the present invention provides an image forming apparatus which can maintain the control effect of the abnormal images even though images are repeatedly formed, and which enables the stable image transmission over time, by using the above-mentioned photoconductor. Specifically, an image forming apparatus according to the present invention can solve the biggest problem upon using the negative-positive development, such as the background smear and the reduction of the image density, and enables highly durable, high speed and highly stable image transmission. In addition, the present invention provides a process cartridge for an image forming apparatus which is highly durable and user friendly, by using the above-mentioned photoconductor.

DESCRIPTION OF THE PREFERRED EMBODIMENTS

Figure 1:
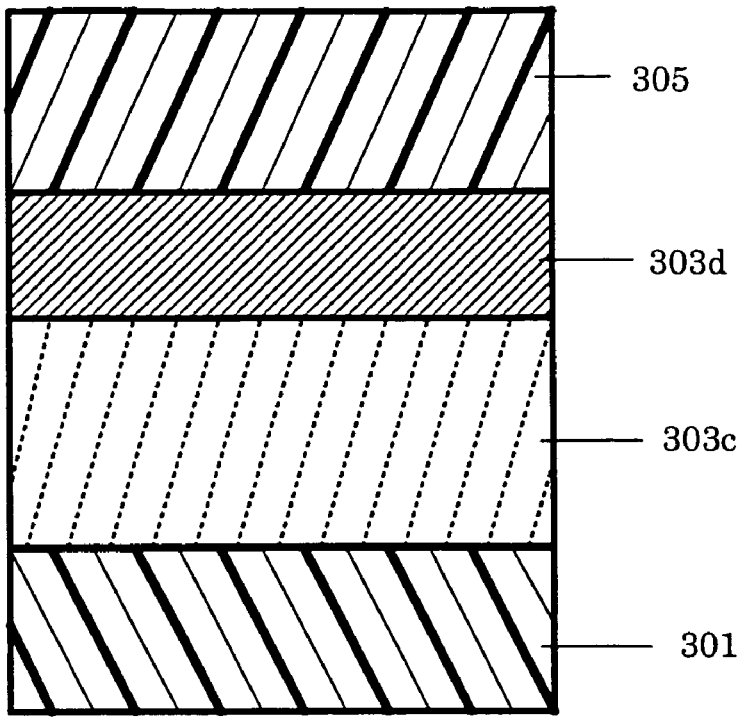
FIG. 1 is a diagram showing an example of a conventional photoconductor.
Figure 2:
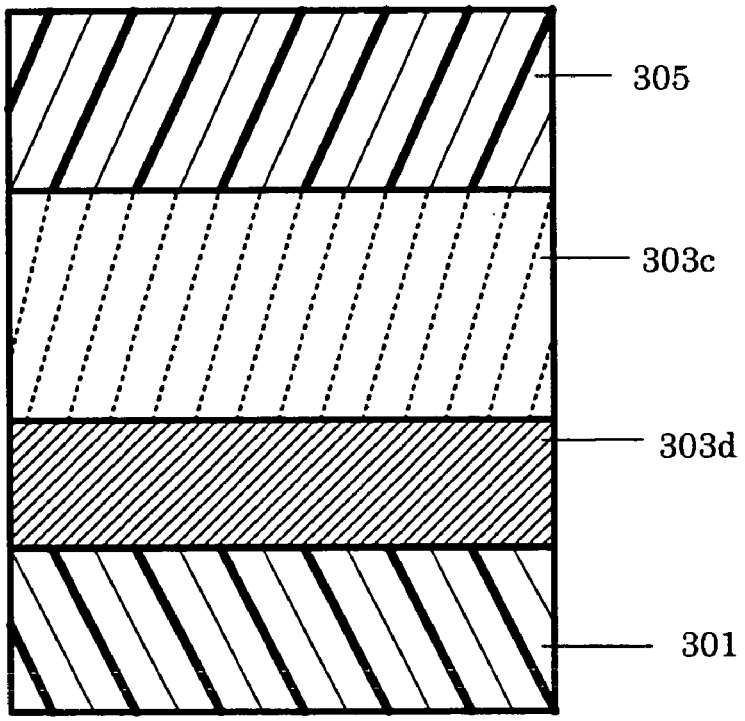
FIG. 2 is a diagram showing another example of a conventional photoconductor.

Hereafter, the present invention will be described in detail.

First, the coating liquid for an intermediate layer of the electrophotographic photoconductor according to the present invention will be described.

N-methoxymethylated nylon used for the coating liquid for an intermediate layer of the photoconductor of the present invention can be obtained by denaturing polyamide which contains polyamide 6 as a component. The polyamide can be denatured using a method proposed by, for example, T. L. Cairns (J. Am. Chem. Soc. 71, P651 (1949)). N-methoxymethylated nylon is obtained by substituting hydrogen of the amide bond in original polyamide by a methoxymethyl group. This substitutional rate is selectable within a wide range according to the denaturation condition, and it is preferable to be 15 mol % or more because the hygroscopic property of the intermediate layer is controlled to some extent and it excels in alcohol affinity, and because of the aspect of environmental stability. It is more preferable that the substitutional rate is 25 mol % or more. Further, as the degree of amide substitution (degree of N-methoxymethylation) increases, the alcohol-base solvent affinity increases. However, hygroscopic property also increases and crystallinity decreases probably because an effect of a bulk side chain group around the principal chain becomes strong and the relaxed state of the principal chain and the coordination state between the principal chains change; therefore, the melting point decreases and the mechanical strength and coefficient of elasticity reduce. Accordingly, it is preferable that the substitutional rate is 35 mol % or less. It is more preferable that the substitutional rate is 33 mol % or less. In addition, according to the examination result, for nylon, nylon 6 is the most preferable, and nylon 66 is preferable secondly. However, copolymerized nylon, such as nylon 6/66/610, is not so preferable contrary to the disclosed contents in JP-A No. 9-265202.

As a coating solvent, since N-methoxymethylated nylon indicates the alcohol solubility, an alcohol solvent, such as methanol, ethanol, propanol, butanol or a mixed solvent of these, can be used. N-methoxymethylated nylon used in the present invention has the highest solubility in methanol among them, so methanol is the most appropriate as the alcohol solvent.

However, in the case of using methanol independently as a coating solvent, because the evaporation rate of the solvent is great and latent heat is also great, a film defect, referred to as brushing, occurs when the film is dried to touch. In order to avoid this defect, it is necessary to lower the speed of drying to touch. Consequently, as a coating solvent containing N-methoxymehylated nylon, it is necessary to simultaneously use methanol with another alcohol solvent (simultaneously use two or more types of alcohol solvents) whose evaporation ration rate is slower that that of methanol. On this occasion, it is important to at least select methanol as one of the alcohol solvents.

As the alcohol solvent other than methanol, if using a solvent whose carbon number is not so great, the effect of brushing prevention cannot be obtained; therefore, the alcohol solvent whose carbon number is 3 or more is preferably used. For example, n-propanol, iso-propanol, n-butanol, iso-butanol, tert-butanol and n-pentanol are exemplified. In the case that the carbon number is excessively great, not only the time for drying to touch becomes longer, but also the solubility of N-methoxymethylated nylon decreases. Further, the affinity with water also decreases, and as a result, the stability of the coating liquid also decreases, so the alcohol-base solvent whose carbon number is approximately 6 or less is appropriate.

In the meantime, if forming the coating liquid using only the alcohol solvents as described above, it induces cloudiness and viscosity increase due to the storage for an extended period of time or at lower temperature. This causes the occurrence of defect to a film formed using this coating liquid. Consequently, as a result of studying the storage life of the coating liquid by the present inventors, they have found that using specific N-methoxymethylated nylon enables the drastic control of the cloudiness and viscosity increase of the coating liquid using this specific nylon. The present inventors have found that in the case of using this nylon as a coating liquid for an intermediate layer, it is needless to say, immediately after the production of the coating liquid, but even after the storage for an extended period of time or under the environment at lower temperature, it becomes possible to form an intermediate layer without any film defect or non-uniformity.

The above-mentioned specific N-methoxymethylated nylon can be selected according to the following method. For example, N-methoxymethylated nylon synthesized according to a method described in the specification of U.S. Pat. No. 2,441,057 generally is dissolved in heated methanol, and the solution viscosity is measured at predetermined temperature, and a material within a specific range is selected.

Specifically, N-methoxymethylated nylon is dissolved into heated methanol so as to be 20% by mass of solid concentration, and after cooling down to 30° C., the solution viscosity is measured while the temperature is maintained at 30° C. A material whose viscosity according to the measurement is 43 mPa·s to 50 mPa·s should be selected (hereafter, it may be referred to as 'methanol viscosity measuring method').

In order to conduct this measurement, a viscometer on the market can be used. Specifically, it is possible to measure the viscosity using an E-type viscometer, and a viscometer capable of controlling the temperature (at 30° C.) upon the viscosity measurement is preferable.

A value of the viscosity changes depending upon N-methoxymethylated nylon, and specifically, it changes depending upon the rate of methoxymethylation, molecular weight and molecular weight distribution. These values are different per synthesized material (per lot), and it is possible to independently measure them. However, even if measuring them independently, the effect of the present invention cannot be always obtained. Therefore, for synthesized N-methoxymethylated nylon, it is necessary to measure the viscosity of the solution according to the above-mentioned method and to screen the material.

For example, a method to contain alkoxymethylated copolymerized nylon whose degree of alkoxymethylation is 5 to 30% in an undercoat layer is described in JP-A No. 9-265202. However, the molecular weight distribution or the like of alkoxymethylated nylon is not tempered, and the storage life of the coating liquid is not even considered. Further, an intermediate layer containing N-methoxymethylated nylon 6, which contains 10 ppm or less of component whose molecular weight is 1000 or less, is described in JP-A No. 6-93129. However, no appropriate range of the degree of methoxymethylation is mentioned, and the storage life of the coating liquid is not even considered. Consequently, in the technologies described in these publications, the usefulness of methoxymethylated nylon is not always fully utilized.

Concerning the storage of the coating liquid, the reason why the coating liquid becomes clouded and/or the viscosity increases has not been clarified yet. However, in general, it is considered that some type of crosslink occurs between the principal chains in N-methoxymethylated nylon due to the passage of time or heat from the outside, and it is gelated, and as a result, cloudiness and/or viscosity increase occurs. Further, concerning the molecular weight, it is considered that in the case of containing a component with very large molecular weight or a component with very large molecular weight distribution, the solubility decreases, and as a result, the cloudiness or viscosity increase occurs.

If the material to be used is in this state, the viscosity becomes a greater value according to the above-mentioned methanol viscosity measuring method. This enables the selection of an appropriate material. In the meantime, contrary to the above-mentioned, if the rate of methoxymethylation is high or if the molecular weight is small, a smaller value can be obtained according to the above-mentioned viscosity measurement.

In the case that the rate of methoxymethylation is excessively low, the characteristic of 6-nylon, which is a raw material, strongly remains and the reforming of the nylon to be originally targeted is insufficient, so it is difficult to obtain a film having a desired physical property. For example, in the case of using this for the intermediate layer of the photoconductor, the environmental dependency of the resulting photoconductor may become worse. Further, in the case that N-methoxymethylated nylon contains a large amount of low molecular weight components or low molecular weight distribution components, a problem of film quality, such as reduction of deposition property or reduction of adhesion strength, occurs. Even concerning these defects, the above-mentioned methanol viscosity measuring method enables the selection of [appropriate] materials, so materials causing this problem can be excluded.

In addition, in the coating liquid containing N-methoxymethylated nylon according to the present invention, a method to mix water into an alcohol solvent is useful. In that case, it is more preferable that the rate of content of water in the solvent is 5 to 20% by mass. This rate of content is expressed with % by mass of water in the entire solvent used for the coating liquid. In the case of using the coating liquid whose rate of content is less than 5% by mass, the effect to control the cloudiness and viscosity increase is not sufficient, and there is a case that the effect cannot be demonstrated upon the storage for an extended period of time or under the environment at low temperature. In the meantime, in the case of exceeding 20% by mass, even though the storage life tends to improve, on the occasion of the film production using this coating liquid, it becomes in the state where water and the alcohol solvent become separate layers when the film is dried to touch, and non-uniformity may become greater.

Furthermore, as water to be used in the present invention, tap water is usable. However, distilled water from which impurities have been eliminated or ion-exchange water is appropriate, and it is more preferable if the water has been through a filtration process using a filter having an appropriate pore size.

In addition to these, filler or additives, such as an electron-accepting substance, a hardening agent or a disperser, may be added according to a design of the intermediate layer to be prepared using this coating liquid. Further, an organic solvent other than the alcohol solvent can be added as the occasion demands. However, the use of a halogen-base solvent should be avoided from the viewpoint of environmental protection.

The photoconductor according to the present invention will be described in detail hereafter, with reference to the drawings.

Figure 3:
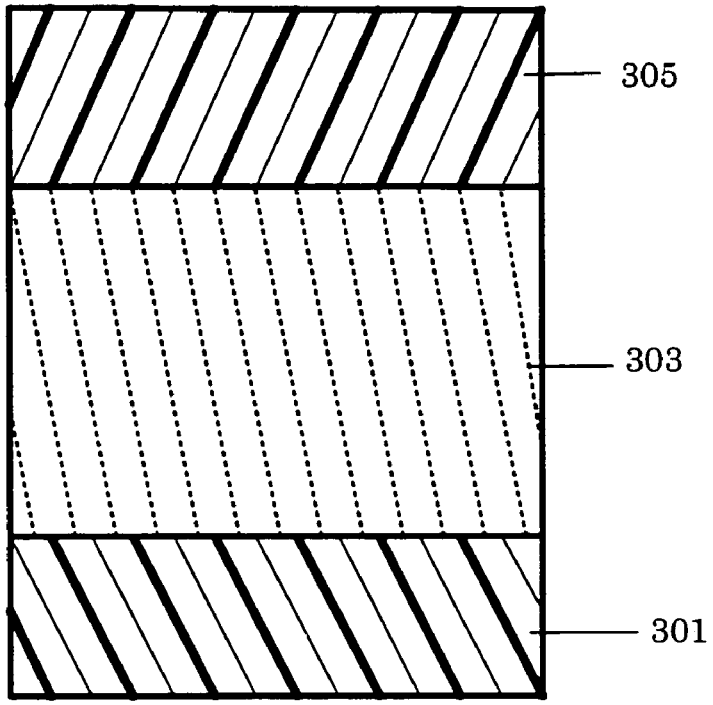
FIG. 3 is a cross-sectional view showing an example of a photoconductor according to the present invention.

FIG. 3 is a cross-sectional view showing an example of a photoconductor according to the present invention, and it is constructed such that an intermediate layer 303 and a photoconductive layer 305 are disposed on a support 301 in order. In this case, the photoconductive layer 305 can be comprised of the laminated construction of a charge generating layer 305*a* and a charge transporting layer 305*b* as shown in FIG. 5, and a protective layer 307 can be provided on the photoconductive layer 305 as shown in FIG. 6.

The case where the intermediate layer is composed of multiple layers will be explained in the following.

Figure 4:
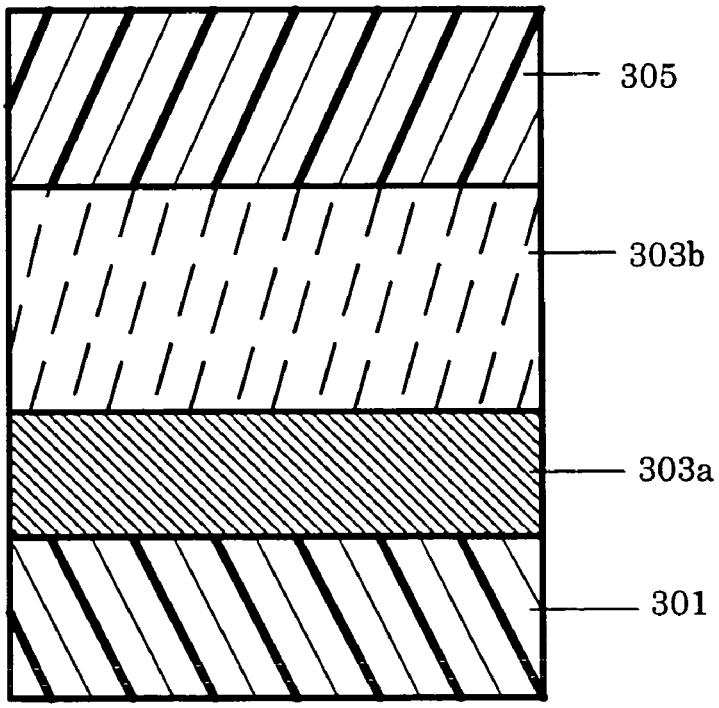
FIG. 4 is a cross-sectional view showing another example of a photoconductor according to the present invention.

FIG. 4 is a cross-sectional view showing another example of a photoconductor according to the present invention, and it is constructed such that a charge blocking layer 303*a*, a moire preventive layer 303*b* and the photoconductive layer 305 are disposed on the support 301 in order.

Figure 5:
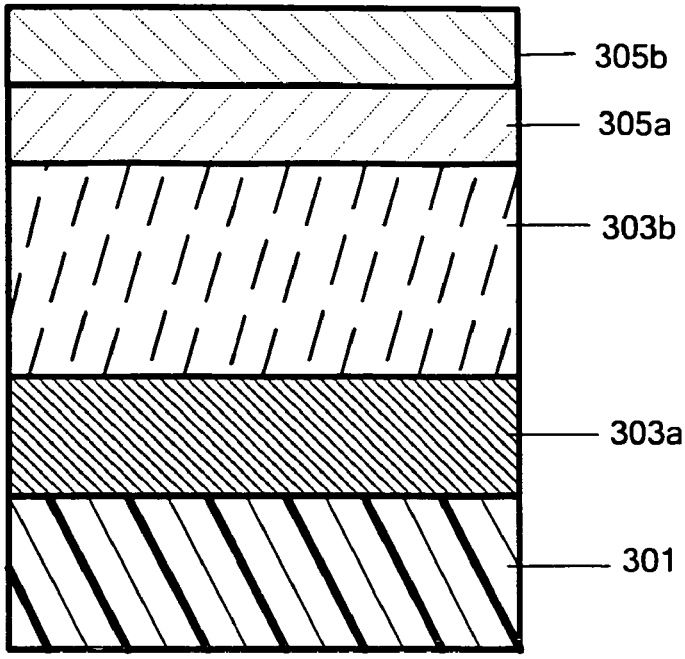
FIG. 5 is a cross-sectional view showing still another example of a photoconductor according to the present invention.
Figure 6:
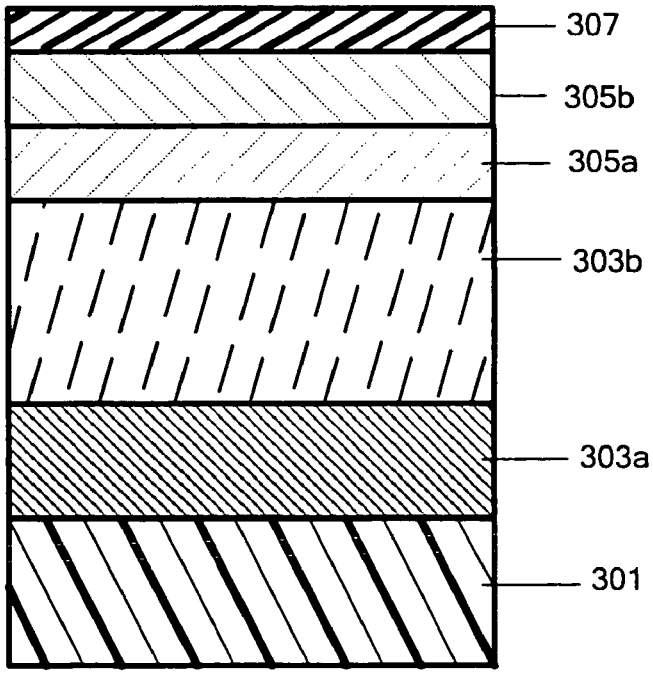
FIG. 6 is a cross-sectional view showing still another example of a photoconductor according to the present invention.

FIG. 5 is a cross-sectional view showing still another example of a photoconductor according to the present invention, and it is constructed such that the charge blocking layer 303*a*, the moire preventive layer 303*b*, the charge generating layer 305*a* and the charge transporting layer 305*b* are disposed on the support 301 in order.

FIG. 6 is a cross-sectional view showing still another example of a photoconductor according to the present invention, and it is constructed such that the charge blocking layer 303*a*, the moire protective layer 303*b*, the charge generating layer 305*a*, the charge transporting layer 305*b* and the protective layer 307 are disposed on the support 301 in order.

Among the constructions shown in FIGS. 3 to 6, the constructions shown in FIGS. 5 and 6 are most preferably used.

The support may be a film-shaped or cylindrically-shaped plastic or paper covered with a conducting material having a volume resistivity of $10^{10}$ ohm·cm or less, e.g., a metal such as aluminum, nickel, chromium, nichrome, copper, gold, silver or platinum, or a metal oxide such as tin oxide or indium oxide, by vapor deposition or sputtering, or it may be a plate of aluminum, aluminum alloy, nickel or stainless steel, and this may be formed into a tube by extrusion or drawing, cut, polished and surface-treated. The endless nickel belt and endless stainless steel belt can also be used as the support.

In addition, a conductive powder may also be dispersed in the binder resin and coated on the support, and used as the support of the present invention. Examples of this conductive powder are carbon black, acetylene black, metal powders such as aluminum, nickel, iron, nichrome, copper, zinc and silver, and a metal oxide such as conductive tin oxide and ITO or the like. The binder resin used together may also comprise a thermoplastic resin, thermosetting resin or photosetting resin such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate resin, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenol resin or alkyd resin. Such a conductive layer can be provided by dispersing these conductive powders and binder resin in a suitable solvent, for example, tetrahydrofuran, dichloromethane, methyl ethyl ketone or toluene, and coating the support with the dispersion.

Further, the conductive support which is prepared by forming the conductive layer on a suitable cylinder base with a thermal-contraction inner tube which is made of a suitable material, such as polyvinyl chloride, polypropylene, polyester, polystyrene, polyvinylidence chloride, polyethylene, chlorinated rubber, Teflon (registered trade name), etc. and contain the conductive fine particles may also be utilized as the conductive support in the present invention.

Next, the intermediate layer will be described in the following.

The intermediate layer to be used for the photoconductor of the present invention may have a single layer construction or a multilayer construction composed of multiple layers.

First, the case of the single layer construction will be described. The intermediate layer has several functions, and in a recent image forming apparatus using a photoconductor, a coherent light, such as LD or LED, is often used as a recording light for latent image formation. Consequently, a moire image is sometimes generated based upon the interference fringe occurred between the support and the photoconductive layer. In order to avoid this phenomenon, it is necessary to have a moire prevention function by adding filler composed of, for example, metal oxide to the intermediate layer. Further, as a notable defect in the negative-positive development, background smear is provided, and a function to prevent charge leak (charge blocking) from the support by the intermediate layer is required. In the case of the intermediate layer with a single layer construction, it is necessary to have at least the above-mentioned two functions, and thus the construction is as mentioned below.

As a binder resin to be used, N-methoxymethylated nylon selected according to the above-mentioned methanol viscosity measuring method is used. Another binder resin other than N-methoxymethylated nylon can be simultaneously used as occasion demands. Further, for the purpose of the moire prevention, organic filler or an inorganic pigment is simultaneously used. In particular, the inorganic pigment is usefully used and white pigment is effectively used among the inorganic pigments, and for example, titanium oxide, calcium fluoride, calcium oxide, silicon oxide, magnesium oxide or aluminum oxide is preferably used.

In this case, for the coating liquid for the intermediate layer of the photoconductor, the inorganic pigment is dispersed and then used along with N-methoxymethylated nylon.

Next, a case of the multilayer construction will be described below. In the case of the multilayer construction, preferably, the intermediate layer is of function-separating type where the two functions of the intermediate layer described in the case of single layer construction are allotted to each layer. One example thereof is the intermediate layer with the multilayer construction composed of the charge blocking layer and the moire preventive layer as shown in FIG. 4. Concerning the deposition order of the charge blocking layer and the moire preventive layer, the order shown in FIG. 4 or the reverse order is applicable. While this depends upon the electric characteristic of the moire preventive layer, the construction in order shown in FIG. 4 often demonstrates less residual potential rise upon the repeated use.

In the case of the multilayer construction, N-methoxymethylated nylon is used for either the charge blocking layer or the moire preventive layer. In the case of forming a layer containing this N-methoxymethylated nylon, the above-mentioned coating liquid for an intermediate layer of the photoconductor is used.

The construction of the charge blocking layer and the moire preventive layer will be described in the following, and a construction showing the most preferable result in the present invention is a case where N-methoxymethylated nylon selected according to the methanol viscosity measuring method is used for the charge blocking layer.

The charge blocking layer has a function to prevent a charge with reversed polarity induced by an electrode (support) upon the charging of the photoconductor from injecting into the photoconductive layer from the support. In the case of a negative charge, it has a function to prevent the electron hole injection, and in the case of a positive charge, it has a function to prevent electron injection. As the charge blocking layer, an anode oxide film represented by an aluminum oxide layer; an inorganic insulating layer represented by SiO; a layer formed from a glass type network of metal oxide as described in JP-A No. 3-191361; a layer composed of polyphosphazene as described in JP-A No. 3-141363; a layer composed of a aminosilane reaction product as described in JP-A No. 3-101737; a layer composed of an insulating binder resin; and a layer composed of curing binder resin are provided. Among them, the insulating binder resin, which can be formed according to a wet coating method, or the layer composed of the curing binder resin can be preferably used. The moire preventive layer and the photoconductive layer are provided on the charge blocking layer, so if these layers are provided according to the wet coating method, it is important that the film is composed of a material or constructed not to be encroached by these coating solvents.

The binder resin used in the present invention includes, for example, N-methoxymethylated nylon, polyamide, polyester, thermoplastic resin, such as vinyl chloride-vinyl acetate copolymer, thermosetting resin, thermosetting resin obtained by thermally polymerizing a compound containing multiple active hydrogen atoms (for example, hydrogen in —OH group, —$NH_2$ group or —NH group), another compound containing multiple isocyanate groups and/or another compound containing multiple epoxy groups. The compound containing the multiple active hydrogen atoms in this case includes, for example, polyvinyl butyral, phenoxy resin, phenol resin, polyamide, polyester, polyethylene glycol, polypropylene glycol, polybutylene glycol and acrylic resin containing active hydrogen, such as hydroxyethylmetaacrylate group. The compound containing multiple isocyanate groups includes, for example, tolylene diisocyanate, hexamethylene diisocyanate, diphenylmethane diisocyanate and pre-polymers thereof. The compound containing multiple epoxy groups includes, for example, bisphenol A type epoxy resin. The binder resin used in the present invention also includes a thermosetting resin obtained by thermally polymerizing oil-free alkyd resin and amino resin, for example, butylated melamine resin; and an optically curing resin obtained by combining polyurethane having unsaturated bond, a resin having unsaturated bond, such as unsaturated polyester, a thioxanthone-base compound and photoinitiator, such as methylbenzylformate.

Since the charge blocking layer takes a role to prevent the charge injection at the time of charging as described above, a material with high insulating property is often used as mentioned above. However, when a balance is lost, the residual potential rise or the change of the photoconductor characteristic due to the use environment becomes great. Therefore, among the above-mentioned materials, if using N-methoxymethylated nylon selected according to the methanol viscosity measuring method, the function as the charge blocking layer can be well-balanced and demonstrated at maximum.

Further, the charging blocking layer can have another function to control the charge injection from a substrate by adding conductive polymer with rectification, resin or compound with acceptor (donor) property along with the charge polarity.

Further, the film thickness of the charge blocking layer is from 0.1 μm to 2.0 μm, and preferably, the range approximately from 0.3 μm to 1.0 μm is appropriate. If the charge blocking layer is thicker, the repetition of the charging and exposure results in the rise of residual potential especially at lower temperature and lower humidity, and if the film thickness is excessively thin, the effect of blocking property diminishes. Further, chemicals, a solvents, additives or a hardening accelerating agent required for curing (crosslink) is added to the charge blocking layer as occasion demands, and this is formed on the substrate by blade coating, dip coating method, spray coating, beat coating or nozzle coating according to a conventional method. After the coating, the film is dried or cured by drying, heating or curing process with lighting.

Next, the moire preventive layer will be described.

The moire preventive layer has a function to prevent the occurrence of a moire image due to the optical interference within the photoconductive layer on the occasion of recording using a coherent light, such as a laser beam. Basically, the moire preventive layer has a function to generate light scattering of the recording light. In order to present this function, it is effective for the moire preventive layer to have a material with great refractive index. In general, the material contains the inorganic pigment and the binder resin, and is constructed such that the inorganic pigment is dispersed in the binder resin. In particular, white pigment is effectively used among the inorganic pigments, and for example, titanium oxide, calcium fluoride, calcium oxide, silicon oxide, magnesium oxide and aluminum oxide are preferably used. Among them, titanium oxide having a great obliterating power is the most effectively used.

Further, as is apparent from the FIG. 4 through FIG. 6, the photoconductor of the present invention is designed to prevent the charge injection from the support by the charge blocking layer, so in the moire preventive layer, it is preferable to have at least a function to be able to move the charge with the same polarity as the charge electrified on the surface of the photoconductor, from the viewpoint of the residual potential prevention. Consequently, for example, in the case of negatively-charged photoconductor, it is desirable for the moire preventive layer to have the electron conductivity; in other words, it is desirable to use inorganic pigment having the electron conductivity, or to use electro-conductive inorganic pigment. Using a material with electron conductivity (for example, acceptor) for the moire preventive layer results in providing a further remarkable effect of the present invention.

As the binder resin, materials similar to those for the charge blocking layer can be used. However, taking the deposition of the photoconductive layer onto the moire preventive layer into consideration, it is important not to encroach on the moire preventive layer into the coating solvent of the photoconductive layer. In the case of not using N-methoxymethylated nylon selected according to the methanol viscosity measuring method for the charge blocking layer, as the binder resin of the moire preventive layer, N-methoxymethylated nylon selected according to the methanol viscosity measuring method should be used.

The thermosetting resin is preferably used for the binder resin of the moire preventive layer. In particular, a mixture of alkyd resin and melamine resin is the most preferably used. On this occasion, the mixing ratio of alkyd/melamine is an important factor to determine the structure and the characteristic of the moire preventive layer. The ratio of alkyd/melamine is preferably 5/5 to 8/2 by mass. If the melamine resin is richer than 5/5, the volume contraction on the occasion of thermally setting becomes greater, and film defect may easily occur or the residual potential in the photoconductor tends to rise, so it is not desirable. Further, if the alkyd resin is richer than 8/2, even though it is effective for the reduction of the residual potential in the photoconductor, the bulk resistance becomes excessively low, so the background smear tends to worsen, so it is also not desirable.

The volume ratio of the inorganic pigment to the binder resin determines the important characteristic of the moire preventive layer. Consequently, it is important that the volume ratio of the inorganic pigment to the binder resin is 1/1 to 3/1. If the volume ratio is less than 1/1, not only the moire prevention capacity diminishes, but the rise of the residual potential upon the repeated use may also be greater. In the meantime, if the volume ratio is 3/1 or greater, not only the binding capacity in the binder resin becomes poor, but the surface nature of coating film becomes deteriorated, so it may negatively affect the film forming property of the photoconductive layer to be formed on the moire protective layer. This effect can be a serious problem in the case that the photoconductive layer is constructed with a laminated construction and thin layer, such as the charge generating layer is formed on the moire preventive layer. Further, in the case that the volume ratio exceeds 3/1, the binder resin sometimes cannot cover the entire surface of the inorganic pigment, and the direct contact with the charge generating substance results in the greater probability of production of thermal carrier, and it may cause the negative effect on the background smear.

In addition, in the moire preventive layer, using two types of titanium oxides with different particle size from each other enables the improvement of the obliterating power to the electroconductive substrate and the control of the moire; concurrently, pinholes, which cause an abnormal image, can be eliminated. For this purpose, it is important that the average particle size ratio of the two types of titanium oxides to be used is within a certain range of $0.2<D2/D1\leqq 0.5$. In the case that the particle size ratio is beyond the range defined in the present invention; in other words, in the case that the ratio of the average particle size (D2) of one titanium oxide (T2) to the average particle size (D1) of the other titanium oxide (T1) is too small ($0.2>D2/D1$), the activity on the surface of titanium oxides increases and the electrostatic stability of the photoconductor using this moire preventive layer is remarkably deteriorated. Further, the average particle size ratio of one titanium oxide (T2) to the average particle size of the other titanium oxide (T1) is excessively great ($D2/D1>0.5$), the obliterating power to the electroconductive substrate decreases, and then restraint to the moire and the abnormal image decreases. The average particle size herein can be obtained from the particle size distribution measurement, which can be obtained when intense dispersion is performed in water-base.

Further, the smaller average particle size (D2) of titanium oxide (T2) is an important factor, and it is important to be within the range of $0.05\ \mu m<D2<0.20\ \mu m$. If D2 is smaller than 0.05 μm, the obliterating power decreases, and it may cause the generation of the moire image. In the meantime, if D2 is greater than 0.20 μm, it causes the decrease of the filling factor of titanium oxides in the moire preventive layer, and the background smear control effect cannot be sufficiently demonstrated.

Further, the mixing ratio by mass of the two types of titanium oxides is also an important factor. In the case that T2/(T1+T2) is smaller than 0.2, the filling factor of titanium oxides is not so great, so the background smear control effect cannot be sufficiently demonstrated. In the meantime, in the case that it is greater than 0.8, the obliterating power decreases, and it may cause the generation of the moire image. Therefore, it is important to be within the range of $0.2 \leqq T2/(T1+T2) \leqq 0.8$.

Further, the film thickness of the moire preventive layer is 1 to 10 μm, preferably 2 to 5 μm. If the film thickness is less than 1 μm, the effect presentation is small, and if it exceeds 10 μm, the residual potential may be accumulated, so it is not desirable.

As a method for forming the moire preventive layer, the wet coating method as described above can be employed, and a solvent not encroaching on the charge blocking layer of the lower layer is used. In particular, in the case of using N-methoxymethylated nylon selected according to the methanol viscosity measuring method for the charge blocking layer, an alcohol solvent should not be used as a coating solvent of the moire preventive layer.

Next, the photoconductive layer will be described.

For the photoconductive layer, either a single layer construction shown in FIGS. 3 and 4 or a lamination construction composed of the charge generating layer and the charge transporting layer as shown in FIGS. 5 and 6 can be employed. The lamination construction will be described first.

The charge generating materials of the charge generating layer for use in the present invention may be selected from conventional materials, examples thereof include metal phthalocyanines such as titanyl phthalocyanines and chlorogallium phthalocyanines; non-metal phthalocyanines; azulenium salt pigments; methine squarate pigments; symmetric or asymmetric type azo pigments typically having a carbazole skeleton, triphenylamine skeleton, diphenylamine skeleton, dibenzothiophene skeleton, fluorenone skeleton, oxadiazole skeleton, bisstilbene skeleton, distyryloxadiazole skeleton or distyrylcarbazole skeleton; perylene pigments; anthraquinone or polycyclic quinone pigments; quinoneimine pigments; diphenylmethane and triphenylmethane pigments; benzoquinone and naphthoquinone pigments; cyanine and azomethine pigments; indigoid pigments; and bisbenzimidazole pigments. As the phthalocyanine pigment used in the present invention, non-metal phthalocyanine and metal phthalocyanine are exemplified, and phthalocyanine obtained according to a synthesis method described in "Phthalocyanine Compounds" by F. H. Moser and A. L. Thomas (Reinhold Publishing Corp., New York, 1963) or any other appropriate method is used.

Examples of metal phthalocyanine includes, for example, a substance having copper, silver, beryllium, magnesium, calcium, zinc, indium, sodium, lithium, titanium, tin, lead, vanadium, chrome, manganese, iron or cobalt as central metal. Further, for the core of the phthalocyanine, instead of the above-mentioned metal atom, metal halide having trivalent or more valence can exist. Furthermore, for phthalocyanine, various crystal forms are known, and well-known crystal form, such as α-type, β-type, Y-type, ∈-type, τ-type, X-type, or amorphous, can be used.

Among them, titanyl phthalocyanine (TiOPc) pigments represented by following Formula (a) having titanium as a central metal have higher sensitivity and outstanding properties and are preferred.

Formula (a)

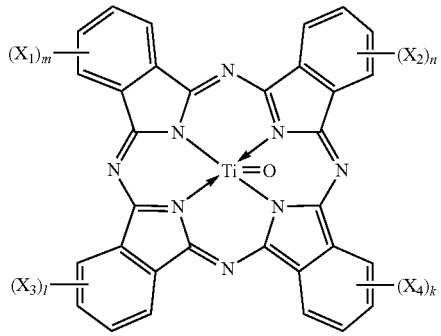

In the formula (a), $X_1$, $X_2$, $X_3$ and $X_4$ are respectively halogen atoms, and n, m, l and k are integers in the range of 0 to 4.

Among these titanyl phthalocyanines, a titanyl phthalocyanine, which shows a maximum diffraction peak at 27.2° in terms of Bragg 2θ angle, major peaks at 9.4°, 9.6° and 24.0° and a diffraction peak as a lowest-angle peak at 7.3°, and has no peak in a range between 7.3° and 9.4° and at 26.3°, is preferably used.

JP-A No. 2001-19871 discloses the titanyl phthalocyanine crystal, and also the charge generating substance, and the photoconductor and image forming apparatus that utilize the substance. By means of the titanyl phthalocyanine crystal, higher sensitivity may be attained, and a photoconductor may be obtained that exhibit charging stability even after the repeated usages. However, in the case of extremely repeated usage, the increase of the background smear may occur, a life of a photoconductor is not satisfactory. It is considered that even though the background smear factor caused by the charge generating layer is improved, another background smear factor induced by the charge injected from the support is not solved.

In addition, as a result of studying the improvement of technology of titanyl phthalocyanine indicating the above-mentioned crystal types, the present inventors have found that setting of the average particle size of the primary particle at 0.25 μm or less results in the remarkable improvement of the increase of the photosensitivity and the background smear characteristic in the photoconductor using this titanyl phthalocyanine. Therefore, as the charge generating material used in the photoconductor of the present invention, titanyl phthalocyanine which has the above-mentioned crystal types and of which the primary particle size is controlled is the most useful. This control method is described below.

In the meantime, the construction in which multiple undercoat layers or intermediate layers are laminated between the support and the photoconductive layer is disclosed in JP-A No. 5-80572 as described above. However, in the combination with the photoconductive layer having high sensitivity, the effect of the occurrence of thermal carrier in the photoconductive layer is great, so the background smear is not perfectly prevented yet. This tendency becomes an obvious problem in the case of using the charge generating material having absorption at long wavelength, typified by titanyl phthalocyanine used in the present invention.

As described above, even though there are disclosed the methods to control the background smear by means of the charge generating layer or the undercoat layer, respectively, the multiple causes of the background smear still exist, so if these are not simultaneously controlled, it is impossible to withstand under the condition of repeated usage for an extended period of time. This is because even if the cause of the background smear is very small and it is not problematic in the initial state; accompanied with the photoconductor fatigue due to the repeated usage or the progress of the component deterioration, the causes of the background smear grow. Therefore, it is necessary to eliminate the causes of the background smear as much as possible; concurrently, to enhance the stability to the photoconductor fatigue due to the repeated usage. However, methods to simultaneously resolve these causes and to enable drastically high durability have not been disclosed yet.

The present invention has accomplished the control of the background smear induced by many primary causes; concurrently, the enhancement of the stability of electrostatic property over time; and in addition, the maintenance of the stable effect on the repeated usage by minimizing any side effects on the residual potential and the environmental dependency.

The process for synthesizing titanyl phthalocyanine crystal having a specific crystal type adapted to the present invention will be explained in the following.

The process for synthesizing phthalocyanines is previously known, for example as described in "Phthalocyanine Compounds, Moser et al., 1963", "The Phthalocyanines, 1983", JP-A No. 6-293769 and the like.

In the first exemplary process, the mixture of phthalic anhydride, metal or metal halide, and urea is heated in the presence or absence of solvent having a high boiling point. A catalyst such as ammonium molybdate is employed in the process if necessary. In the second exemplary process, the mixture of phthalonitrile and metal halide is heated in the presence or absence of solvent having a high boiling point. In the process, phthalocyanines that are not capable to yield in the first exemplary process may be obtained such as aluminum phthalocyanines, indium phthalocyanines, oxovanadium phthalocyanines, oxotitanium phthalocyanines, zirconium phthalocyanines. In the third exemplary process, phthalic anhydride or phthalonitrile and ammonia are primarily reacted to produce an intermediate product such as 1,3-diimino isoindoline, then the intermediate product is reacted with a metal halide in the presence of solvent having a high boiling point. In the fourth exemplary process, phthalonitriles and metal alkoxide are reacted in the presence of urea or the like. The fourth process is appropriate for the present invention in a view point that chlorination or halogenation of aromatic ring, which is improper for electrophotographic materials, does not be induced.

As described above, for the process of the synthesizing the titanyl phthalocyanine crystal in the present invention, preferably, the raw material in the process is not halogenated titanium as described in JP-A No. 6-293769. The greatest benefit of this process is that the titanyl phthalocyanine crystal is produced substantially with no halogen elements. The impurity of halogenated titanyl phthalocyanine crystal in the titanyl phthalocyanine crystal is likely to occur the reduction of photosensitivity and charging properties in the photoconductors (see Japan Hardcopy '89, Manuscripts p. 103 (1989)). The present invention is mainly intended to and effectively uses halogen-free titanyl phthalocyanines as described in JP-A No. 2001-19871. These materials may be effectively utilized. To synthesize the halogen-free titanyl phthalocyanines, the halogenated material is not used as the raw material in the synthesizing process. Specifically, the above-mentioned process may be used.

The process for producing amorphous or lower crystallinity titanyl phthalocyanines will be explained in the following. The process comprises dissolving phthalocyanines into sulfuric acid, diluting the solution, and redepositing phthalocyanines; the process include acid paste method and acid slurry method.

Specifically, a synthesized product such as of the first to fourth process is dissolved into 10 to 50 times of concentrated sulfuric acid, insoluble substance is removed by filtration or the like if necessary, and the solution is poured slowly into 10 to 50 times of cooled water or ice water to deposit again the titanyl phthalocyanine. The deposited titanyl phthalocyanine is filtered and rinsed with de-ionized water till the filtrate turns into neutral. A paste having a content of 5 to 15% by mass is prepared after the final filtration and rinsing.

In the process for producing amorphous titanyl phthalocyanines, it is important to rinse it sufficiently with de-ionized water and to reduce the sulfuric acid as low as possible. Specifically, the rinsed de-ionized water exhibits the following properties: 6.0 to 8.0 of pH or 8 μS/cm or less (preferably 5 μS/cm or less, more preferably 3 μS/cm or less) of specific conductivity. If the pH or specific conductivity is in the range, the residual sulfuric acid does not effect on the photoconductor property in general; when outside the range, the charging property may be reduced or the optical sensitivity may be deteriorated due to the residual sulfuric acid.

The amorphous or lower crystallinity titanyl phthalocyanine adapted to the present invention may be produced as follows. Preferably, the titanyl phthalocyanine exhibit a highest diffraction peak in a range between 7.0 to 7.5° as Bragg 2θ angles in terms of the CuK-α characteristic X-ray wavelength at 1.542 Å, the half-value width of the diffraction peak is 1.0° or more. Preferably, the averaged primary particle size is 0.1 μm or less.

The process for converting crystalline configuration will be explained.

In the process, the amorphous or lower crystallinity titanyl phthalocyanine is converted to titanyl phthalocyanine crystal that exhibits a highest peak at 27.2°, main peaks at 9.4°, 9.6° and 24.0°, a peak at 7.3° as the lowest angle, and with no peaks in a range between 7.3° and 9.4°, and with no peak at 26.3° as Bragg 2θ angles (±0.2°) in terms of CuK-α characteristic X-ray wavelength at 1.542 Å.

Specifically, the amorphous or lower crystallinity titanyl phthalocyanine is converted to the titanyl phthalocyanine crystal through mixing and stirring with an organic solvent in the presence of water without drying step.

The utilized organic solvent may be any one provided that the desired crystalline type may be obtained. Specifically, tetrahydrofuran, toluene, methylene chloride, carbon disulfide, orthodichlorobenzene, 1,1,2-trichloroethane are preferred. These solvent may be used alone or in combination of two or more, or may be used with other solvents. The amount of the organic solvent utilized in the crystalline transformation is preferably 10 times or more, more preferably 30 times or more than the mass of the amorphous titanyl phthalocyanine, thereby the crystalline transformation proceeds rapidly and sufficiently, and the effect to remove impurities in the amorphous titanyl phthalocyanine may be attained satisfactorily. When the amorphous or lower crystallinity titanyl phthalocyanine is produced by way of acid paste method, it is preferred to utilize the amorphous or lower crystallinity titanyl phthalocyanine that is sufficiently removed the residual sulfuric acid as described above. If the crystalline transformation is conducted under the remaining sulfuric acid, sulfuric ion exists within the crystal particles; consequently, the ion may not be removed sufficiently even though the resulting crystal is treated with rinsing with de-ionized water. When sulfuric ion remains, desirable results may not be expected due to decrease of sensitivity and/or charging property of photoconductors. For example, JP-A No. 08-110649 describes a method for transforming crystal in which titanyl phthalocyanine dissolved in sulfuric acid is poured into an organic solvent with de-ionized water. In the method, the concentration of sulfuric ion in the titanyl phthalocyanine is too high therefore the optical sensitivity is inferior, although the resulting titanyl phthalocyanine crystal shows the similar X-ray diffraction spectrum with the desirable titanyl phthalocyanine crystal. The reason is as above described.

The process for converting crystalline configuration is similar with that of JP-A No. 2001-19871. In the charge generating substance incorporated into the inventive photoconductor, fine division of the particle size of the titanyl phthalocyanine crystal leads to higher effects. The ways to produce the particles of titanyl phthalocyanine crystal will be described below.

There exists substantially two ways to control the particle size of titanyl phthalocyanine crystal incorporated into the photoconductive layer. On way is to produce the titanyl phthalocyanine crystal particles without those having particle sizes of more than 0.25 μm; another way is producing the titanyl phthalocyanine crystal particles, dispersing the titanyl phthalocyanine crystal particles, and then removing the lager particles having particle sizes of more than 0.25 μm. Clearly, these ways may be combined.

Figure 7:
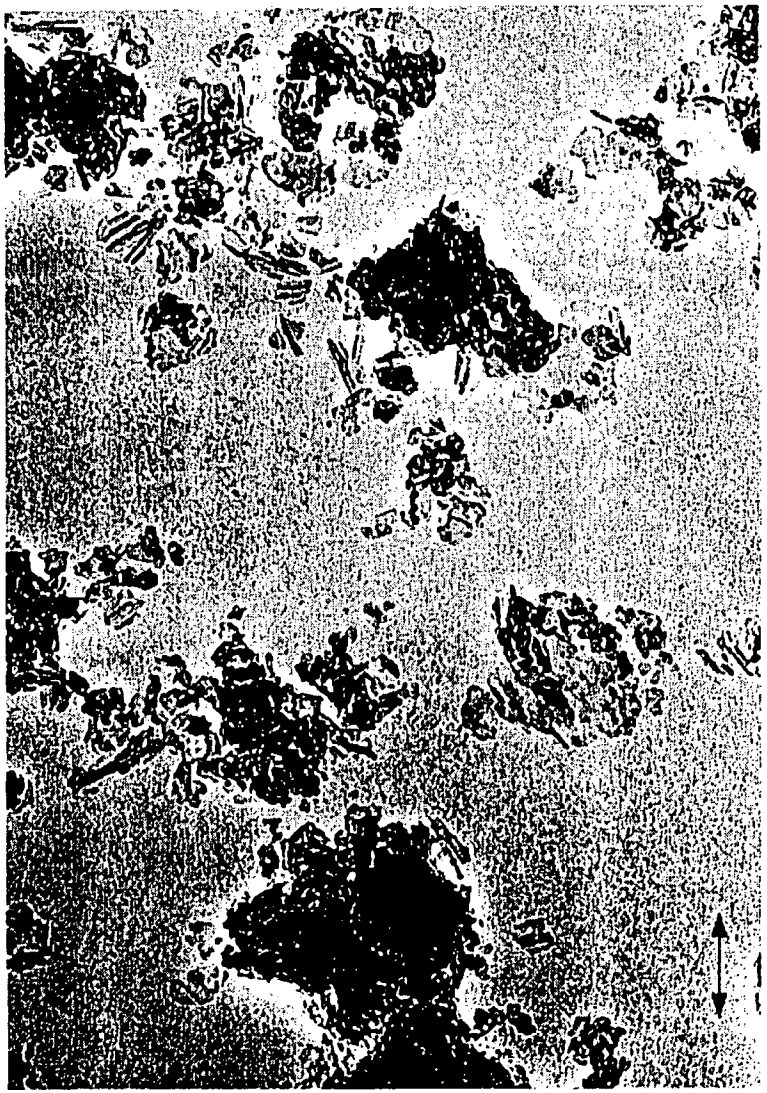
FIG. 7 shows a photograph of primary particles of amorphous titanyl phthalocyanine crystals adapted to the present invention.
Figure 8:
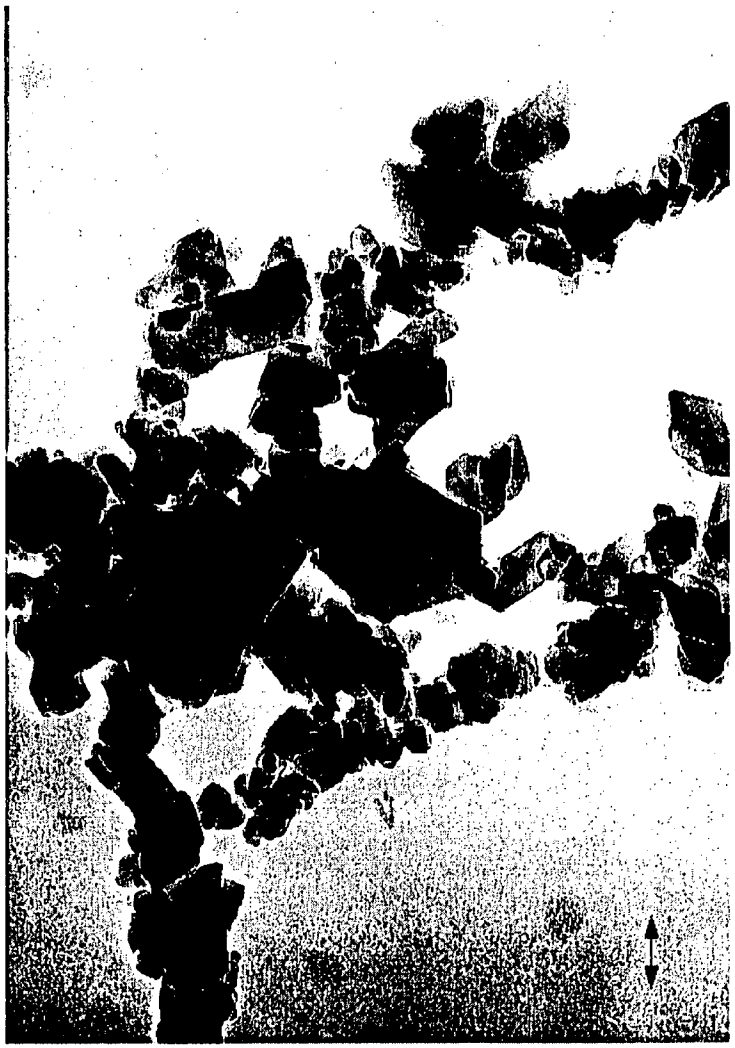
FIG. 8 shows a photograph of primary particles of transformed titanyl phthalocyanine crystals adapted to the present invention.

Initially, the way to produce the fine particles of titanyl phthalocyanine crystal will be explained. In the investigation to lower the titanyl phthalocyanine crystal, we observed that the particles of the amorphous or lower crystallinity titanyl phthalocyanine have the primary particle size of 0.1 μm or less, mostly about 0.01 to 0.05 μm, and the crystalline transformation proceed along with crystalline growth. FIG. 7 exemplarily shows an transmission electron microscope (TEM) photography of amorphous or lower crystallinity titanyl phthalocyanine particles adapted to the present invention. The scale bar in FIG. 7 is 0.2 μm. Usually, the crystalline transformation is carried out for a long period so as not to remain the raw material in the product, and filtering is carried out after the sufficient crystalline transformation to recover the titanyl phthalocyanine crystal having a desired crystal form. Accordingly, the crystal after the crystalline transformation have larger primary particle size of about 0.3 to 0.5 μm, although the primary particles of the raw material have a sufficiently low size. FIG. 8 exemplarily shows another transmission electron microscope (TEM) photography of titanyl phthalocyanine particles transformed by a conventional way. The scale bar in FIG. 8 is 0.2 μm.

In the dispersion step of the resulting titanyl phthalocyanine crystal, the dispersion is carried out by applying a high shear rate, and also a higher comminuting energy is applied depending on the necessity. As a result, a part of the crystal particles is likely to transform into an undesired crystal form.

On the contrary, according to the present invention, the instantaneous moment of the completed crystalline transformation is determined within a range that crystal growth hardly progresses along with the crystalline transformation, i.e. within a range that the particle size of the amorphous titanyl phthalocyanine crystal, for example shown in FIG. 7, is not so different from before the crystal transformation, thereby titanyl phthalocyanine crystal is produced that has a particle size as low as possible. The growth of particle size during crystal transformation is substantially proportional to the period for crystal transformation. Accordingly, it is important to raise the efficiency of transformation and to complete it within a shorter period. There exist several key ways to attain the object.

One way is to select a suitable solvent for the crystal transformation, thereby to enhance the efficiency of the crystal transformation. Another way is to stir intensely the mixture of the solvent and the aqueous paste of titanyl phthalocyanine, e.g. the amorphous titanyl phthalocyanine produced as described above, so as to contact them sufficiently, thereby to complete the crystal transformation in a shorter period. Specifically, by means of stirring with considerably high sharing rate or a device with vivid stirring such as a homomixer, the crystal transformation is performed within a shorter period. By employing these conditions, titanyl phthalocyanine crystal may be obtained without residual raw material, with sufficient crystal transformation, and substantially without the crystal growth. The optimization of the organic solvent amount for crystal transformation is also effective in these conditions. Specifically, the organic solvent is preferably utilized in a amount of 10 times or more, more preferably 30 times or more of the solid content of the amorphous titanyl phthalocyanine. Thereby, the crystal transformation may be achieved more reliably in a shorter period, and the impurities in the amorphous titanyl phthalocyanine may be removed more reliably.

Further, rapid interruption of the reaction or crystal transformation after the predetermined reaction may be effective since the size of crystal particles is proportional to the period for crystal transformation. For example, a solvent, under which the crystal transformation does not progress substantially, is added to the reactant after the crystal transformation. Examples of the solvent under which the crystal transformation does not progress include solvents of alcohols and esters. These solvents may interrupt the crystal transformation in an amount of about 10 times of the solvent that promotes the crystal transformation.

The smaller the size of primary particles of the resulting titanyl phthalocyanine is, the more advantageous for the problems on the photoconductor. However, adverse effects may be arisen in the subsequent process for filtering the pigment or stability of the dispersion, if the size is too small. That is, too small primary particles lead to a problem that the filtrating period is too long, and the particles tend to flocculate again since the surface area of the pigment particles is enlarged in the dispersion, as a result the background smear is possibly induced as the adverse affect. Accordingly, the suitable particle size of the pigment particles is about 0.05 to 0.2 μm.

Figure 9:
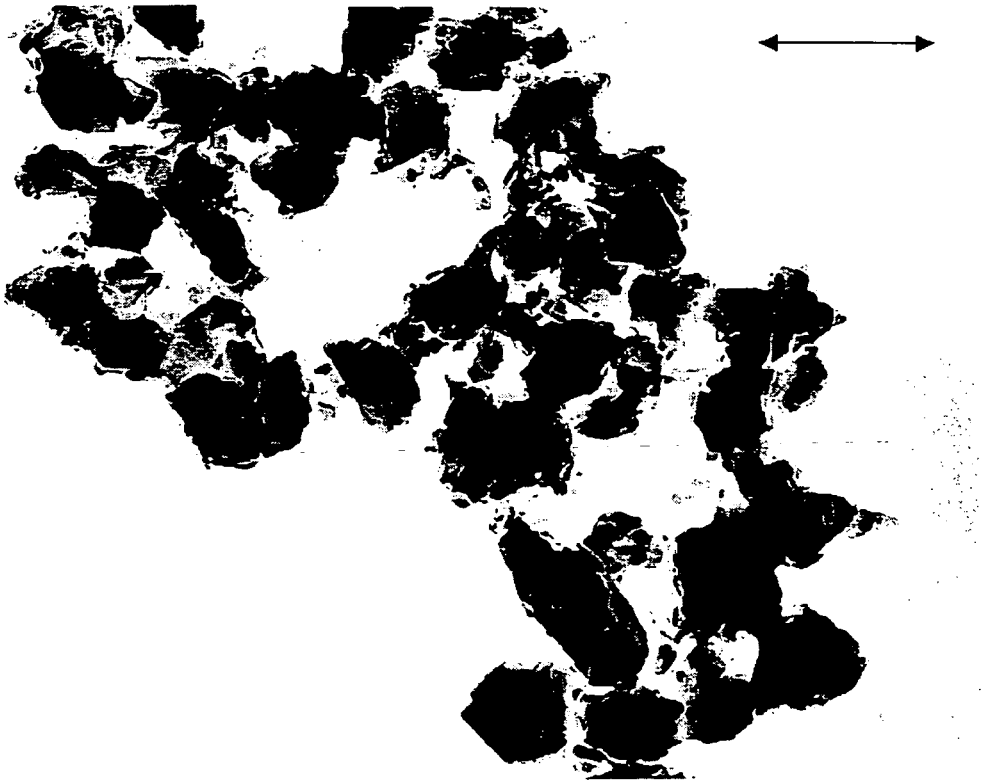
FIG. 9 shows an electron microscope photograph of titanyl phthalocyanine crystals adapted to the present invention.

FIG. 9 shows an image of transmission electron microscope (TEM) of titanyl phthalocyanine crystal that is subjected crystal transformation for a shorter period. The scale bar in FIG. 9 corresponds to 0.2 μm. Contrary to FIG. 8, the particle size is smaller and nearly uniform; larger particles existing in FIG. 8 cannot be recognized at all.

In dispersing such small primary particles of titanyl phthalocyanine crystal as shown in FIG. 9, a small volume-averaged particle size i.e. 0.25 μm or less, preferably 0.2 μm or less may be obtained by providing shearing rate enough to loosen the secondary particles formed by cohering or gathering the primary particles enables the dispersion. As a result, in order not to provide an excessive energy, as described above, it is possible to prepare a dispersion with smaller particle size, without easily transforming a part of particles to particles having an undesirable crystal type.

In the present invention, the averaged particle size refers to the volume-averaged particle size measured by Gravitational Sedimentation Particle Size Distribution Analyzer CAPA-700 (by HORIBA Ltd.,); specifically, it refers to the median size corresponding to 50% size of the cumulative distribution. In some case, the method may not detect a very small amount of larger particles, therefore, it is important to observe titanyl phthalocyanine or its dispersion by means of electron microscope such as TEM and to determine the particle size based on TEM.

As a result of investigation as to small defects, we explain the defect as follows, through observing the dispersion precisely. In a measurement of averaged particle size, the considerably large particles or coarse particles may be usually detected when such particles exist in a amount of up to several percents; however, when the amount of such particles is no more than one percent, such particles cannot be detected due to the limit of detection through the measurement of the averaged particle size. As a result, the relation between the considerably large particles or coarse particles and the small defects have not been clearly understood.

Figure 10:
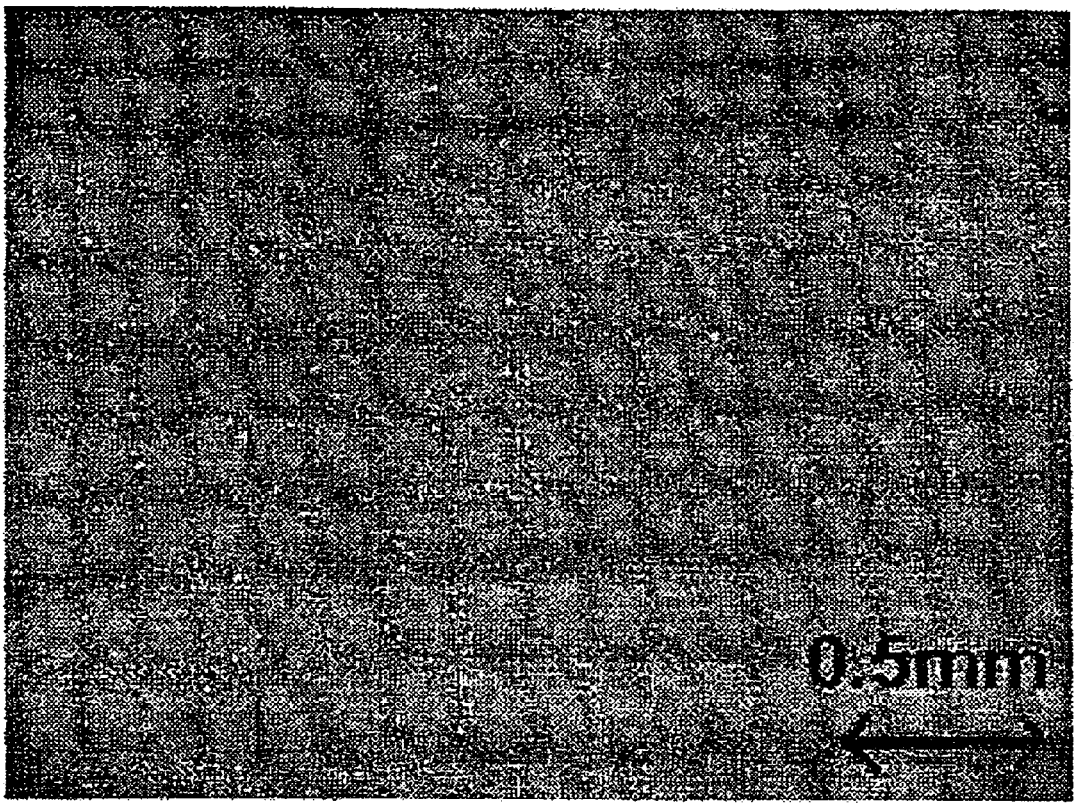
FIG. 10 shows a photograph of dispersion of titanyl phthalocyanine crystals that was dispersed for shorter period with the same dispersion condition.
Figure 11:
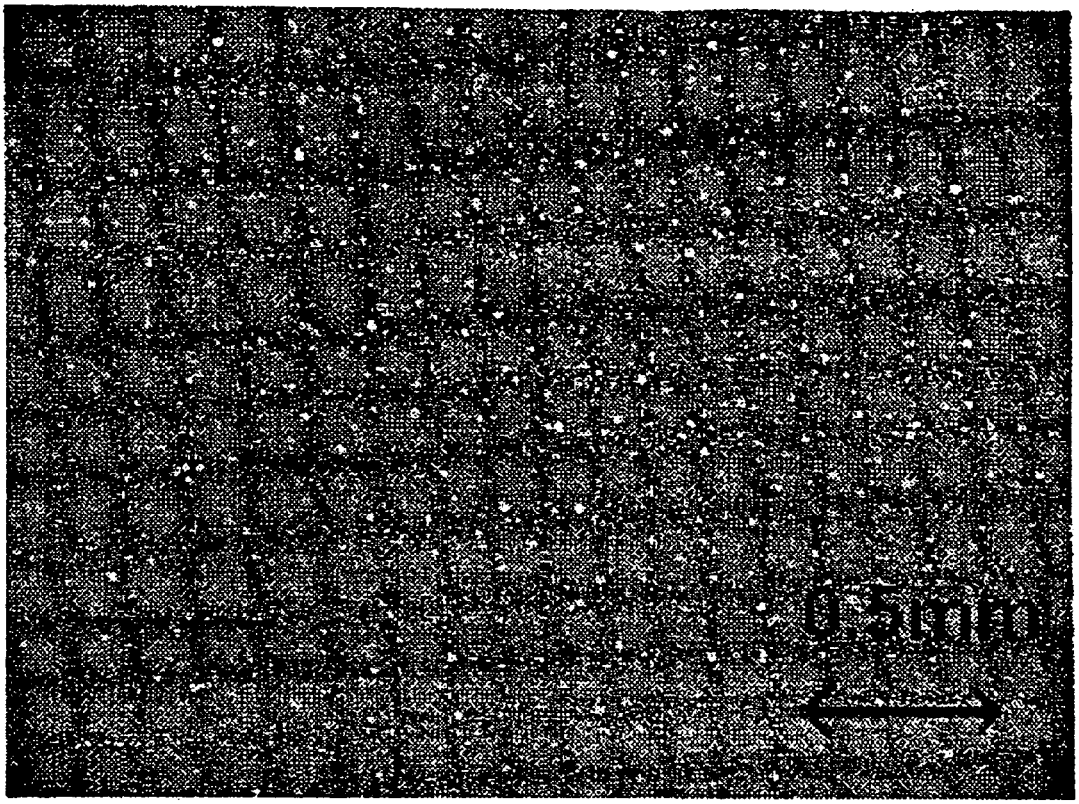
FIG. 11 shows a photograph of dispersion of titanyl phthalocyanine crystals that was dispersed for longer period with the same dispersion condition.

FIGS. 10 and 11 show images of dispersion which are same with the dispersing condition and different with the dispersing period. FIG. 10 is an image of the dispersion that was dispersed for shorter period with the same dispersing condition, which shows that relatively large amount of considerably large particles or coarse particles is observed in FIG. 10 compared with the image of FIG. 11 that was dispersed for a loner period. Black grains in FIG. 10 are coarse particles.

Figure 12:
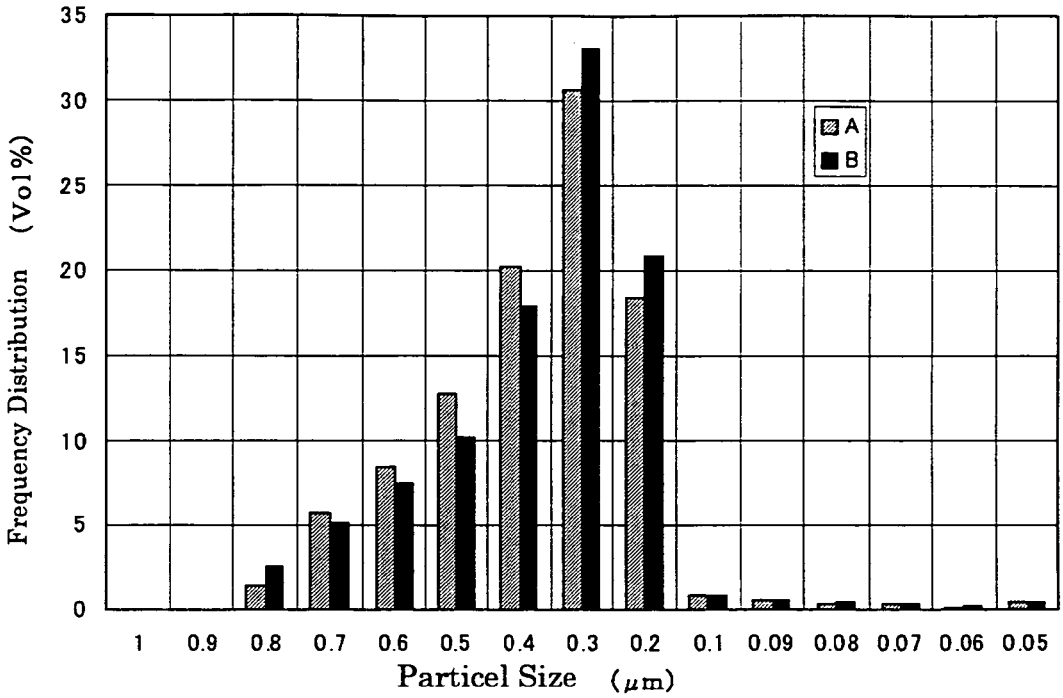
FIG. 12 shows a particle size distribution of dispersion adapted to the present invention that measured by particle size distribution analyzer.

The averaged particle size and particle distribution of the two dispersions were measured by means of CAPA-700 (by HORIBA Ltd.,) in a conventional way. The results are shown in FIG. 12. "A" in FIG. 12 corresponds to the dispersion shown in FIG. 10, "B" in FIG. 12 corresponds to the dispersion shown in FIG. 11. Comparing the results of "A" and "B", there are not significant difference. Further, the volume-averaged particle size of "A" is 0.29 μm and that of "B" is 0.28 μm. Considering the measurement error, there is not significant difference between them.

Accordingly, only the conventional measurement of the averaged particle size cannot detect the small amount of coarse particles, therefore it is understood that it is impossible to respond to the recent negative-positive developing. The small amount of coarse particles can be recognized by observing the suspension by means of an electron microscope and the like.

Based on the fact described above, producing the primary particles at the crystal transformation as small as possible is effective. The proper selection of solvent, the enhancement of crystal transforming efficiency, the shorter period of crystal transformation, and vigorous stirring of the solvent and the aqueous paste of titanyl phthalocyanine may be effectively evaluated.

The crystal transforming process may produce titanyl phthalocyanine crystal with smaller particle size such as 0.25 μm or less, preferably 0.2 μm or less. In addition to the technologies described in JP-A No. 2001-19871, the optional employment of the above described technologies as to the crystal transformation process for producing fine titanyl phthalocyanine crystal may enhance the effect of the present invention.

Then, the titanyl phthalocyanine crystal subjected to the crystal transformation is immediately filtered thereby separated from the solvent for crystal transformation. The filtering is carried out by means of a filter having appropriate pore size and the like. Preferably, evacuated filtering is employed in the step.

Then, the separated titanyl phthalocyanine crystal is subjected to optional drying step. The drier for the drying step may be any one utilized in the art; preferably a type of forced air drier is utilized when the drying is conducted under atmospheric pressure. The drying under vacuumed pressure is an effective way to raise the drying rate and to enhance the effect of the present invention. In particular, it is effective for the material that decompose or transform at higher temperatures. The vacuum degree at the drying is preferably higher than 10 mm Hg.

The resulting titanyl phthalocyanine crystal having a certain crystal form is significantly available for charge generating substance of electrophotographic photoconductor. However, the titanyl phthalocyanine crystal is unstable in the crystal form, and tends to transform at preparing the dispersion as described above. By way of synthesizing the crystal with primary particles as small as possible, dispersion with smaller particle size may be prepared without causing excessively high sharing rate at preparing the dispersion, and the crystal form may be stable without transforming from the synthesized form.

The method for removing the coarse particles from the dispersed titanyl phthalocyanine crystal will be described below.

The preparation of the dispersion may be conventional in the art, for example, the titanyl phthalocyanine crystal is dispersed into a appropriate solvent with an optional binder resin by means of a ball mill, attriter, sand mill, beads mill, or ultrasonic device. The binder may be selected with reference to the electrostatic property of the photoconductor and the like, the solvent may be selected with reference to the wettability against the pigment and the dispersibility of the pigment.

It is known that the titanyl phthalocyanine crystal that exhibits the highest peak at 27.2° as Bragg 2θ angles (±0.2°) in terms of the CuK-α characteristic X-ray wavelength at 1.542 Å may easily transform to the other crystal form through some stress such as thermal energy and mechanical shear, which is true in the titanyl phthalocyanine crystal employed in the present invention. In order to prepare a dispersion that contains fine particles, the way to prepare the dispersion should be suitably selected. In general, there exist a trade-off relation between the crystal stability and the fine division. The trade-off relation may be mitigated somewhat by optimizing the dispersing condition, however, the producing condition is likely to be limited, therefore, convenient ways are desired. For the countermeasure, the following way may be helpful.

The particles in the dispersion is divided as finely as possible to prepare a dispersion in a condition that the crystal transformation may be avoided, then the dispersion is subjected to filtering by means of a suitable filter to remove coarse particles. The way is very effective in that a small amount of remaining coarse particles, which cannot be detected easily by particle size distribution analysis, may be removed and the resulting particles are relatively of uniform particle size. Specifically, the dispersion prepared as described above is subjected to filtering by means of a filer having an effective pore size of 3 μm or less, more preferably 1 μm or less to prepare a desired dispersion. In the process, the dispersion that contains titanyl phthalocyanine crystal having exclusively small particle size of 0.25 μm or less, preferably 0.2 μm or less. The photoconductor formed from the titanyl phthalocyanine crystal is used for an image forming apparatus, making it possible to obtain a marked effect of the present invention.

The filter for filtering the dispersion is selected depending on the size of coarse particles to be removed. From investigations of the present inventors, the photoconductor, of which the resolution is required to be about 600 dpi, is affected by the coarse particles of 3 μm or more. Accordingly, the available filter has an effective pore size of 3 μm or less. More preferably, the effective pore size is 1 μm or less. By filtering the dispersion as described above, undesirable coarse particles may be filtered and removed, the dispersion having a narrow range of the particle size distribution and containing no coarse particles can be prepared.

Although the effective pore size comes to smaller, the effect to remove the coarse particle turns into higher, excessively fine pore size arises unexpected problems such as the desired pigment particles themselves are filtered, the period for filtering is too long, the filter is plugged, and the load of pump for feeding is too large, therefore a filter having an appropriate effective pore size should be selected. Needless to say, the material of the filter is selected from the materials resistant for the dispersion to be filtered.

In filtering the dispersion, if the amount of coarse particles in the dispersion to be filtrated is excessively high, the removed amount of the pigments comes to larger, so it is not preferable because the solid concentration in the dispersion after the filtration may be changed. Therefore, on filtering the dispersion, there is appropriate particle size distribution (particle size and standard deviation). As in the present invention, in order to effectively filter the dispersion without loss of the pigments and clogging in the filter due to the filtering, the volume average particle size in the dispersion liquid before the filtration is preferably 0.3 μm or less and the standard deviation is preferably 0.2 μm or less.

By properly filtering the dispersion, coarse particles may be filtered and removed, the resulting photoconductor may be decreased the background smear. As above described, although the filter having a smaller pore size may remove the coarse particles significantly or certainly, an offset may arise that the desired pigment particles themselves come to be filtered. In such a case, the synthesis technology of titanyl phthalocyanine having smaller primary particles should be taken into account, the combination of the filtering and the synthesis technology may solve the offset, thereby a significant effect may be obtained.

That is, (i) synthesizing and utilizing the fine titanyl phthalocyanine particles makes possible to shorten the dispersing period and to decrease the stress in dispersing, thereby the crystal transformation may be reduced in the step of dispersing; (ii) the size of coarse particles remaining after dispersion is smaller than that of without fine division, a filter having smaller pore size may be utilized, thereby coarse particles are removed more surely. Further, the removed amount of titanyl phthalocyanine particles comes to lower, thereby the dispersion hardly changes its composition from before to after filtering, thereby the production comes to more stable. Consequently, (iii) the resulting photoconductor can stably resist to the background smear.

The charge generating layer may be formed by dispersing the charge-generating substance, and binder resin optionally used in a suitable solvent, by means of a ball mill, attriter, sand mill, ultrasonic, coating on the conductive support, and drying it.

Suitable binder resins, which are optionally used for the charge generating layer 35, include polyamide, polyurethane, epoxy resins, polyketone, polycarbonate, silicone resins, acrylic resins, polyvinyl butyral, polyvinyl formal, polyvinyl ketone, polystyrene, polysulfone, poly-N-vinylcarbazole, polyacrylamide, polyvinyl benzal, polyester, phenoxy resins, vinyl chloride-vinyl acetate copolymers, polyvinyl acetate, polyphenylene oxide, polyamides, polyvinyl pyridine, cellulose resins, casein, polyvinyl alcohol, polyvinyl pyrrolidone, and the like resins. Among these resins, polyvinyl acetal typified by polyvinyl butyral is preferably used. The content of the binder resin in the charge-generating substance is preferably from 0 to 500 parts by mass, and preferably from 10 to 300 parts by mass, per 100 parts by mass of the charge-generating substance.

Examples of the suitable solvent for use include isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, ligroin, and the like solvents. In particular, ketone type solvents, ester type solvents and ether type solvents are preferably used. The way to coat the coating liquid is for example immersion coating, spray coating, beat coating, spinner coating, ring coating or the like. The thickness of charge generating layer is preferably 0.01 to 5 μm, more preferably 0.1 to 2 μm.

The charge transporting layer will be described in the following.

The charge transporting layer may be formed by dissolving or dispersing the charge transporting substance and binder resin in a suitable solvent, the solution or dispersion is coated on as a charge generating layer, and drying. Optionally, plasticizer, leveling agent, and anti-oxidant and the like may be added.

The charge transporting substance is classified into hole transporting substance and electron transporting substance. Examples of the electron transporting substance include chloroanil, bromoanil, tetracyanoethylene, tetracyano quinodimethan, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indino[1,2-b] thiophene 4-on, 1,3,7-trinitro-dibenzothiophene-5,5-dioxide, and benzoquinone. These are electron accepting substances.

Examples of the positive-hole transporting substance include poly-N-carbazole and its derivatives, poly-γ-carbazolylethylglutamate and its derivatives, pyrene-formaldehyde condensation products and their derivatives, polyvinyl pyrene, polyvinyl phenanthrene, polysilane, oxazole derivatives, oxadiazole derivatives, imidazole derivatives, monoarylamines, diarylamines, triarylamines, stilbene derivatives, α-phenyl stilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, and the like. These charge transporting substances may be used alone or in combination.

Examples of the binder resin include polystyrene, styrene-acrylonitrile copolymer, styrene-butadiene copolymer, styrene-maleicanhydride copolymer, polyester, polyvinyl chloride, vinylchloride-vinylacetate copolymer, polyvinyl acetate, polyvinylidene chloride, polyacrylate resin, phenoxy resin, polycarbonate, celluloseacetate resin, ethyl-cellulose resin, polyvinyl butyral, polyvinyl formal, polyvinyl toluene, poly-N-vinylcarbazole, acrylate resin, silicone resin, epoxy resin, melamine resin, urethane resin, phenol resin, alkyd resin, and the like.

The amount of the charge transporting substance is preferably 20 to 300 parts by mass, more preferably 40 to 150 parts by mass based on the 100 parts by mass of the binder resin. The layer thickness of the charge transporting layer is preferably 5 to 100 μm.

Examples of the suitable solvent for use include tetrahydrofuran, dioxane, toluene, dichloromethane, monochlorobenzene, dichloroethane, cyclohexanone, methyl ethyl ketone, acetone and the like. Among these solvents, a non-halogen solvent is preferably used to reduce a burden on environment. Specifically, cyclic ethers such as tetrahydrofuran, dioxolane and dioxane, aromatic hydrocarbons such as toluene and xylene and derivatives thereof are preferred.

In addition, the polymer charge transporting substances may be properly utilized for the binder resin of the charge transporting layer. When the charge transporting layer of polymer charge transporting substance is employed, the charge transporting layer exhibits a high wear resistance. The polymer of charge-transporting substance may be a known material, particularly, a polycarbonate having a triarylamine structure in the main chain and/or side chain performs well. In particular, the polymer charge-transporting substances expressed by Formulae (I) to (X) are appropriately utilized; these substances will be specifically explained.

Formula (I)

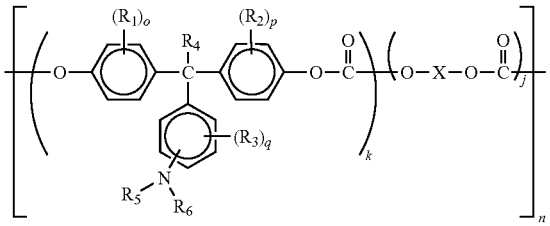

In Formula (I), $R_1$, $R_2$, $R_3$ are respectively substituted or unsubsituted alkyl groups or halogen atoms, $R_4$ is a hydrogen atom or a substituted or unsubsituted alkyl group, $R_5$, $R_6$ are substituted or unsubsituted aryl groups, o, p, q are integers in the range of 0 to 4, k, j represent compositional fractions where $0.1 \leqq k \leqq 1$, $0 \leqq j \leqq 0.9$, n represents the number of repeating units and is an integer in the range of 5 to 5000. X is an aliphatic divalent group, a cyclic aliphatic divalent group, or the divalent group expressed by the following two formulae (b) and (c). In addition, the two units in Formula (I) may be repeated alternatively or arranged in random in the polymer.

Formula (b)

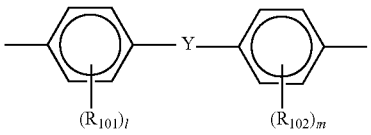

In the above formula, $R_{101}$, $R_{102}$ are respectively substituted or unsubsituted alkyl groups, an aryl group, or a halogen atom, l, m are integers in the range of 0 to 4, Y is a single bond, straight-chain, branched or cyclic alkylene group having 1 to 12 carbon atoms, —O—, —S—, —SO—, —$SO_2$—, —CO—, —CO—O-Z-O—CO— (Z is an aliphatic divalent group), or:

Formula (c)

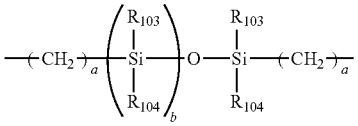

In the above formula, a is an integer in the range of 1 to 20, b is an integer in the range of 1 to 2,000, $R_{103}$, $R_{104}$ are substituted or unsubstituted alkyl groups or aryl groups. $R_{101}$, $R_{102}$, $R_{103}$, $R_{104}$ may be respectively identical or different.

Formula (II)

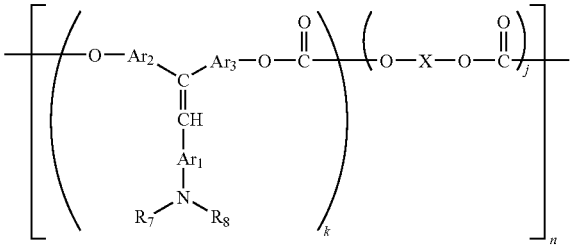

In Formula (II), $R_7$, $R_8$ are substituted or unsubstituted aryl groups, $Ar_1$, $Ar_2$, $Ar_3$ are arylene groups which may be identical or different, X, k, j and n are the same as in Formula (I). In addition, the two units in Formula (II) may be repeated alternatively or arranged in random in the polymer.

Formula (III)

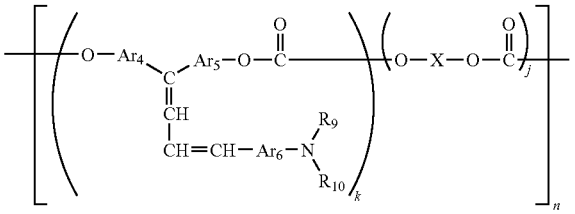

In Formula (III), $R_9$, $R_{10}$ are substituted or unsubstituted aryl groups, $Ar_4$, $Ar_5$, $Ar_6$ are arylene groups which may be identical or different, X, k, j and n are the same as in Formula (II). In addition, the two units in Formula (I) may be repeated regularly or arranged in random in the polymer. In addition, the two units in Formula (III) may be repeated alternatively or arranged in random in the polymer.

Formula (IV)

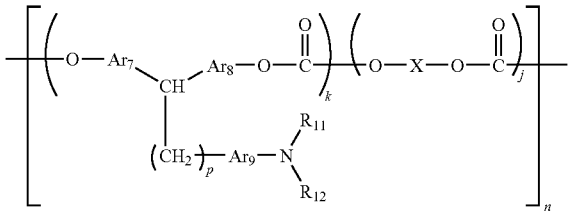

In Formula (IV), $R_{11}$, $R_{12}$ are substituted or unsubstituted aryl groups, $Ar_7$, $Ar_8$, $Ar_9$ are arylene groups which may be identical or different, p is an integer in the range of 1 to 5, X, k, j and n are the same as in Formula (I). In addition, the two units in Formula (IV) may be repeated alternatively or arranged in random in the polymer.

Formula (V)

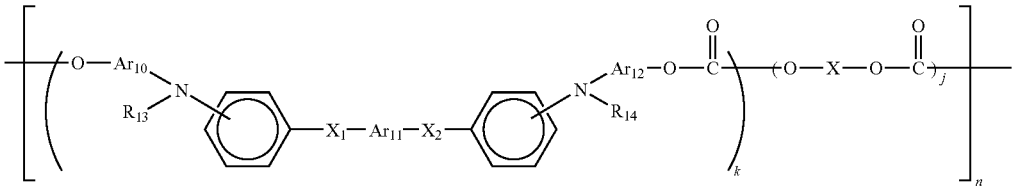

In Formula (V), $R_{13}$, $R_{14}$ are substituted or unsubstituted aryl groups, $Ar_{10}$, $Ar_{11}$, $Ar_{12}$ are arylene groups which may be identical or different, $X_1$, $X_2$ are substituted or unsubstituted ethylene groups, or substituted or unsubstituted vinylene groups. X, k, j and n are the same as in Formula (I). In addition, the two units in Formula (V) may be repeated alternatively or arranged in random in the polymer.

Formula (VI)

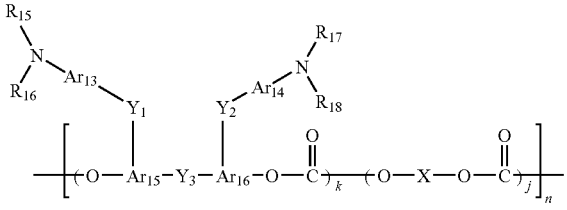

In Formula (VI), $R_{15}$, $R_{16}$, $R_{17}$, $R_{18}$ are substituted or unsubstituted aryl groups, $Ar_1$, $Ar_2$, $Ar_3$ are arylene groups which may be identical or different, $Y_1$, $Y_2$, $Y_3$ are single bond, substituted or unsubstituted alkylene groups, substituted or unsubstituted cycloalkylene groups, substituted or unsubstituted alkylene ether groups, oxygen atoms, sulfur atoms or vinylene groups. X, k, j and n are the same as in Formula (I). In addition, the two units in Formula (VI) may be repeated alternatively or arranged in random in the polymer.

Formula (VII)

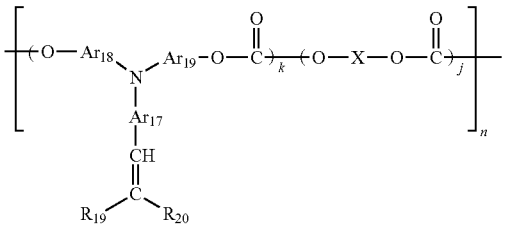

In Formula (VII), $R_{19}$, $R_{20}$ are hydrogen atoms, or substituted or unsubstituted aryl groups, and $R_{19}$, $R_{20}$ may form a ring. $Ar_{17}$, $A_{18}$, $A_{19}$ are arylene groups which may be identical or different. X, k, j and n are the same as in Formula (I). In addition, the two units in Formula (VII) may be repeated alternatively or arranged in random in the polymer.

Formula (VIII)

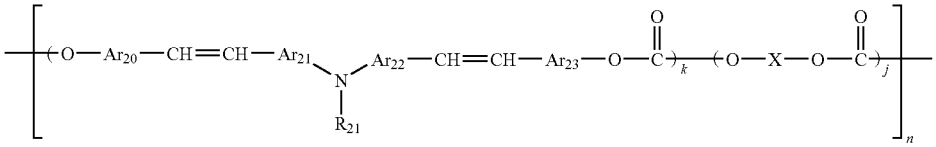

In Formula (VIII), $R_{21}$ is a substituted or unsubstituted aryl group, $Ar_{20}$, $Ar_{21}$, $Ar_{22}$, $Ar_{23}$ are arylene groups which may be identical or different, X, k, j and n are the same as in Formula (I). In addition, the two units in Formula (VIII) may be repeated alternatively or arranged in random in the polymer.

Formula (IX)

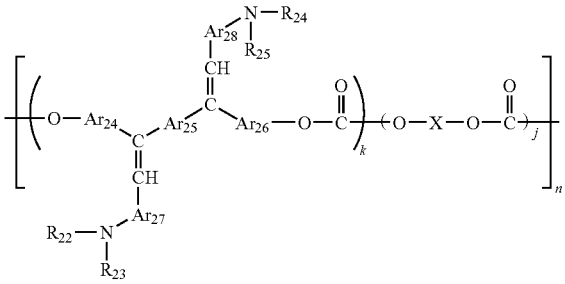

In Formula (IX), $R_{22}$, $R_{23}$, $R_{24}$, $R_{25}$ are substituted or unsubstituted aryl groups, $Ar_{24}$, $Ar_{25}$, $Ar_{26}$, $Ar_{27}$, $Ar_{28}$ are arylene groups which may be identical or different. X, k, j and n are the same as in Formula (I). In addition, the two units in Formula (IX) may be repeated alternatively or arranged in random in the polymer.

Formula (X)

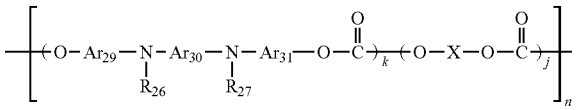

In Formula (X), $R_{26}$, $R_{27}$ are substituted or unsubstituted aryl groups, $Ar_{29}$, $Ar_{30}$, $Ar_{31}$ are arylene groups which may be identical or different. X, k, j and n are the same as in Formula (I). In addition, the two units in Formula (X) may be repeated alternatively or arranged in random in the polymer.

The polymer charge transport substances to be used for the charge transporting layer include, in addition to the above-described polymer charge transport substances, polymers which are in the form of a monomer or oligomer having an electron donating group upon formation of the charge transporting layer and have, in the end, a two dimensional or three dimensional crosslink structure by curing or crosslinking reaction after film formation.

The charge transporting layer composed of such a polymer having an electron donating group or the polymer having a crosslink structure has excellent wear resistance. Generally in an electrophotographic process, since the charge potential (potential at an unexposed region) has a certain value, wear of the surface layer of the photoconductor after repeated usage leads to an increase in electric field on the photoconductor. Since the occurring frequency of swear of the background increases with an increase in the strength of electric field, a high wear resistance of the photoconductor is advantageous against the background swear. The charge transporting layer composed of the polymer having an electron donating group has an excellent film forming property, because it is a high molecular compound by itself; and has excellent charge transport capacity, because it permits constitution of a charge transport portion with a high density compared with the charge transporting layer composed of a low molecular dispersed type polymer. The photoconductor having a charge transporting layer using a high molecular charge transport substance is expected to achieve high-speed response.

In addition, as the polymer having an electron donating group, usable are copolymers of a known monomer, block polymers, graft polymers, star polymers and crosslink polymers having an electron donating group as described, for example, in Japanese Patent Application Laid-Open (JP-A) Nos. 03-109406, 2000-206723 and 2001-34001.

In the present invention, the charge transporting layer may contain a plasticizer or a leveling agent. As the plasticizer, those ordinarily employed as a plasticizer for resins such as dibutyl phthalate and dioctyl phthalate are usable. It is preferably added in an amount of about 0% by mass to 30% by mass relative to the binder resin. Examples of the leveling agent include silicone oils such as dimethyl silicone oil and methyl phenyl silicone oil, and polymers or oligomers having a perfluoroalkyl group in their side chains. The leveling agent is preferably added in an amount of 0% by mass to 1% by mass relative to the binder resin.

The above description is about a case where the photoconductive layer has the lamination construction. However, in the present invention, the photoconductive layer can have a single layer construction. In order for the photoconductive layer to have the single layer construction, the photoconductive layer may be formed of a single layer containing at least the charge generating substance and the binder, and the materials mentioned in the description about the charge generating layer and the charge transporting layer may be preferably used as the binder resin. Further, the simultaneous use of the charge transporting substance in the single-layer photoconductive layer results in the presentation of high photosensitivity, high carrier transporting property and low residual potential, and it can be preferably used. On this occasion, for the charge transporting substance to be used, either the hole transporting substance or the electron transporting substance is selected depending on the polarity to be charged on the surface of the photoconductor. In addition, the polymer charge transporting substance also has the functions of the binder resin and the charge transporting substance, so it can be preferably used for the single-layer photoconductive layer.

A protective layer can be formed on the top surface of the photoconductor of the present invention, for the purpose of controlling the wear resistance of the photoconductor. This enables the improvement of the wear resistance of the photoconductor and the reduction of the change of the film thickness of the photoconductive layer even after the repeated use, and this also enables the reduction of the change of the electric field intensity, so the increase of background smear can be diminished. Therefore, using the protective layer enables the improvement of the durability, and thus enables the useful use of the photoconductor of the present invention with high sensitivity but without abnormal defect.

Examples of materials used for the protective layer are resins such as ABS resin, ACS resin, olefine-vinyl monomer copolymer, chlorinated polyether, aryl resin, phenol resin, polyacetal, polyamide, polyamidoimide, polyacrylate, polyallyl sulfone, polybutylene, polybutylene terephthalate, polycarbonate, polyarylate, polyethersulfone, polyethylene, polyethylene terephthalate, polyimide, acrylic resin, polymethylpentene, polypropylene, polyphenylene oxide, polysulfone, polystyrene, AS resin, butadiene-styrene copolymer, polyurethane, polyvinyl chloride, polyvinylidene chloride and epoxy resin. Polycarbonate or polyarylate are most preferably useful.

To the protective layer, it is possible to add a fluorine resin such as polytetrafluoroethylene or silicone resin or these resins having, dispersed therein, an inorganic filler such as titanium oxide, tin oxide, potassium titanate or silica or an organic filler in order to increase wear resistance.

Among the filler materials used for the protective layer of the photoconductor, the organic filler materials include fluorine resin powder such as polytetrafluoroethylene, silicone resin powder and α-carbon powder. The inorganic filler materials include powder of a metal such as copper, tin, aluminum and indium, powder of a metal oxide such as silica, tin oxide, zinc oxide, titanium oxide, indium oxide, antimony oxide, bismuth oxide, tin oxide doped with antimony and indium oxide doped with tin, and potassium titanate. In particular, use of the inorganic material is advantageous from the viewpoint of the hardness of the filler, with silica, titanium oxide and alumina being effectively used.

The filler concentration in the protective layer differs, depending on the electrophotographic processing conditions under which the photoconductor is used. The filler concentration on the outermost layer side of the protective layer is 5% by mass or more, preferably 10% by mass or more, but 50% by weight or less, more preferably 20% by mass or less based on the total solid content.

The volume average particle diameter of the filler to be employed in the present invention preferably falls within a range of 0.1 μm to 2 μm, preferably 0.3 μm to 1 μm. Excessively small average particle diameter disturbs sufficient exhibition of wear resistance, while excessively large average particle diameter deteriorates the surface of the film or disturbs formation of the film itself.

The term "average particle diameter" as used herein means a volume average particle diameter unless otherwise specifically indicated and it is determined by a ultra-centrifugal automatic particle size distribution analyzer "CAPA-700" (manufactured by HORIBA Ltd.). It is calculated as a particle diameter (median) corresponding to 50% of the cumulative distribution. It is important that the standard deviation of particles each measured simultaneously is 1 μm or less. When the standard deviation exceeds it, the particle size distribution becomes too large and a marked advantage of the present invention is not available.

The pH of the filler used in the present invention also has a great influence on the resolution or dispersibility of the filler. One of the reasons is that hydrochloric acid or the like may remain on the filler, especially the metal oxide filler, upon formation. If the residual amount is large, the occurrence of the image blur can not be prevented. The residual amount will also affect the dispersibility of the filler.

Another reason resides in a difference in the electrostatic property on the surface of the filler, especially on the metal oxide filler. Particles dispersed in a liquid usually have plus charges or minus charges. Ions having counter charges gather to keep electrical neutrality and there, an electric bilayer is formed, whereby the particles are able to have a stable state. The potential (Zeta potential) slowly decreases as the distance from the particles increases and it becomes zero in an electrically neutral region which is sufficiently distant from the particles. Accordingly, when the repulsive force between the particles becomes higher owing to an increase in the absolute value of the Zeta potential, the stability of the dispersion heightens, while when the potential approaches to zero, the particles tend to cause aggregation of the particles and the dispersion becomes unstable. On the other hand, the pH of the dispersion system causes a drastic change in the Zeta potential and at a certain pH, the potential becomes zero and an isoelectric point is formed. By setting the isoelectric point as far as that of the particles and heightening the absolute value of the Zeta potential, therefore, the dispersion system can be stabilized.

In the constitution of the present invention, it has been confirmed that when the pH of the filler at an isoelectric point is 5 or greater is preferred from the viewpoint of preventing image blur, and the more basic the filler is, the higher effects it exhibits. Basic fillers exhibiting higher pH at an isoelectric point are able to have improved dispersibility and stability when the dispersion system is acidic, because the Zeta potential becomes high.

The pH of the filler in the present invention is the pH at an isoelectric point based on the Zeta potential. The Zeta potential is measured an electrophoretic light scattering spectrophotometer (manufactured by Otsuka Electronics Co., Ltd.).

As a filler which does not easily cause image blur, those exhibiting high insulation (specific resistance: $10^{10}$ Ω·cm or greater) are preferred, with those having a pH of 5 or greater and those having a dielectric constant of 5 or greater being used especially effectively. Fillers having a pH of 5 or greater and those having a dielectric constant of 5 or greater may be used alone or those having a pH of 5 or greater and those having a pH of 5 of less in combination as a mixture of two or more. Moreover, fillers having a dielectric constant of 5 or less and that having a dielectric constant of 5 or greater can be used in combination as a mixture of two or more. Of these fillers, α-alumina of a hexagonal close packed structure exhibiting high insulation, having high heat stability and moreover, having high wear resistance is particular effective from the viewpoint of preventing image blur or improving wear resistance.

In the present invention, the specific resistance of the filler is defined as follows. Powders such as filler differ in specific resistance depending on their filling ratio so that it must be measured under predetermined conditions. In the present invention, a measuring apparatus having a similar structure to that described in JP-A Nos. 05-94049 (FIG. 1) and 05-113688 (FIG. 1) was used for measuring the specific resistance of the filler and the values measured were used. In the measuring apparatus, the electrode area is 4.0 $cm^2$. Prior to measurement, a load of 4 kg is applied to an electrode on one side for 1 minute and the amount of the sample is adjusted so that the distance of the electrodes will be 4 mm. Measurement is conducted while applying a load (1 kg) to the upper electrode and the applied voltage is 100V. In a region having a specific resistance of $10^6$ Ω·cm, it was measured using HIGH RESISTANCE METER (manufactured by Yokogawa HEWLETT PACKARD), while in a region having a specific resistance not exceeding $10^6$ Ω·cm, a digital multimeter (Fluke) was employed for the measurement. The specific resistance determined is the definition of the specific resistance in the present invention.

The dielectric constant of the filler was measured as follows. A cell similar to the above-mentioned measurement of the specific resistance was used, a static capacitance was measured after applying a load, thereby determined a dielectric constant. For the measurement of static capacitance, a dielectric loss measuring set (manufactured by Ando Electric Co., Ltd.) was used.

These filler can be subjected to surface treatment with at least one surface treating agent and it is preferred from the viewpoint of the dispersibility of the filler. Lowering in the dispersibility of the filler not only increases a residual potential but also lowers the transparency of the film, generates film defects and moreover lowers the wear resistance. This may lead to serious problems that disturb the achievement of high durability and high resolution. As the surface treating agent, any one conventional surface treating agent can be used, and preferably the one which can keep the insulation property of the filler. Examples of the surface treating agent include a titanate coupling agent, aluminum coupling agent, zircoaluminate coupling agent or higher fatty acid, a silane coupling agent in combination thereof $Al_2O_3$, $TiO_2$, $ZrO_2$, silicone, aluminum stearate or a mixture thereof is preferred in consideration of the dispersibility of the filler and image blur. The treatment only with a silane coupling agent has a strong influence on image blur, but the influence can sometimes be suppressed by treating with a mixture of the surface treatment agent and the silane coupling agent. Although the amount of the surface treatment varies depending on the average primary particle size of the filler, it is preferably 3% by mass to 30% by mass, more preferably 5% by mass to 20% by mass. The surface treatment amount less than the above-range is not effective for dispersing the filler, while the surface treatment amount exceeding the above-described range causes a drastic increase in the residual potential. These filler materials may be used either alone or in combination as a mixture. The surface treatment amount of the filler is defined as a mass ratio of the surface treating agent to the filler.

The filler material may be dispersed by using a suitable disperser. The filler is preferably dispersed to the level of primary particles and contains less aggregates from the viewpoint of the transmittance of the protective layer.

The protective layer may contain a charge transport substance in order to reduce the residual potential and improve response.

As the charge transport substance, materials as described in the explanation of the charge transporting layer can be used. When a low-molecular charge transport substance is used as the charge transport substance, a concentration gradient may be disposed in the protective layer. A reduction in the concentration on the surface side is effective for improving wear resistance. The term "concentration" as used herein means a mass ratio of the low molecular charge transport substance to the total weight of all the materials constituting the protective layer. The term "concentration gradient" means a gradient of the concentration adjusted to be lower on the surface side at the above-described mass ratio. Use of a high molecular charge transport substance is considerably advantageous for heightening the durability of the photoconductor.

For the forming method of the protective layer, the ordinal coating method in the art is employed. A suitable thickness of the protective layer is about 0.1 μm to 10 μm. Except a filler dispersing protective layer, the known materials such as a-C and a-SiC formed by the vacuum thin-film forming method can be employed as the protective layer.

Further, as a protective layer with another mode, a cross-linked protective layer having a charge transporting structure is effectively used. Using the cross-linked protective layer having the charge transporting structure results in the additionally effective realization to control the increase of electric field intensity due to the repeated use, and it is effective in the control of the background smear. Further, since the flaw resistance of the surface of the photoconductor is also high and filming is difficult to occur, it has also an effect to reduce the occurrence of the image defect, so it is effective and useful to realize high durability. In addition, from the point of homogeneity as a protective layer compared to the filler dispersed type protective layer, the cross-linked protective layer has higher homogeneity. This results in the uniform wear of the photoconductor surface layer by a cleaning member or the like and also results in the uniform electrostatic characteristic of the photoconductor in a very small region, so it can be further effectively used compared to the filler dispersed type protective layer.

The cross-linked protective layer having the charge transporting structure has an outstanding three-dimensional structure since radical polymerizable monomer having three functionalities or more is cured, and is a surface layer with a considerably high cross-linked density, high hardness and a high elasticity, and is uniform, highly smooth, highly wear resistant, and flaw resistant. As described above, it is important to increase the cross-linked density of the surface of the photoconductor, i.e. to increase the number of crosslinked bond per unit volume; on the other hand, an internal stress may be generated since a number of bonds are formed by the instantaneous crosslinking reaction. The internal stress increases as the thickness of the cross-linked protective layer comes to thicker, therefore, cracks or peelings tend to occur when the protective layer is entirely hardened. The cracks and/or peelings may occur with time under the effect of temperature alternations and hazards such as charging, developing, transferring, and cleaning, even if initially the cracks and/or peelings do not appear.

In order to solve the problem, softening ways of the curing resin layer may be effective such as (i) introduction of polymer component into the cross-linked layer and the cross-linked structure, (ii) employment of mono- or di-functional radical polymerizable monomer in relatively large amount, and (iii) employment of a multifunctional monomer having at least a flexible group. However, these ways unexceptionally lead to lower cross-linked density of the cross-linked layer, and remarkable improvement in the wear resistance cannot be attained. On the contrary, in the photoconductor according to the present invention, the cross-linked protective layer having the charge transporting structure has an outstanding three-dimensional network construction, and the cross-linked protective layer of 1 μm to 10 μm is provided on the charge transporting layer. As a result, the photoconductor in accordance with the present invention may have remarkably high wear resistance without occurrences of cracks and/or peelings. Then thickness of the cross-linked protective layer is 2 μm to 8 μm, the aforesaid problems may be solved more easily, and the materials can be selected more widely in order to crosslink in higher density for further improving the wear resistance.

The reason that the cracks and peelings may be prevented in the inventive photoconductor is considered that the internal stress does not grow significantly since the cross-linked protective layer having the charge transport structure is thin in the thickness, the internal stress of the cross-linked protective layer as the surface layer may be relaxed due to the presence of underlying charge transporting layer. Therefore, the polymer material is not required to incorporate in a large amount into the cross-linked protective layer having the charge transporting structure, and the flaws and toner filming are less likely to occur, which are caused due to the incompatibility with the cured product formed from the reaction between the polymer material and the radical polymerizable composition such as a radical polymerizable monomer and a radical polymerizable compound having a charge transporting structure. In addition, when the entire layer of the cross-linked protective layer is cured by irradiating optical energy, the curing reaction may be insufficient, since the transmittance is limited due to the absorption of optical energy by the property of the charge transporting structure. In accordance with the present invention, the thickness of the cross-linked protective having the charge transporting structure is as thin as 10 μm or less, the curing reaction progresses inside the layer uniformly, and the higher abrasion resistance may be maintained inside the layer as the surface. Further, in the formation of the cross-linked protective layer having the charge transporting structure according to the present invention, in addition to the radical polymerizable monomer having three or more functionalities, a radical polymerizable compound having one functionality is employed, which is incorporated into the cross-linked bonds during the curing of the radical polymerizable monomer having three or more functionalities. On the contrary, when a low molecular charge transporting substance without a functional group is incorporated into the cross-linked layer, the deposition of the low molecular charge transporting substance and/or whiting may be induced, and the mechanical strength of the cross-linked layer comes to lower. On the other hand, when the charge transporting material having two or more functionality is employed as the main component, the distortion in the cured resin structure comes to remarkably large since the bulk of the charge transporting structure is considerably high, although the cross-linked density turns into higher since the component is fixed in the cross-linked structure at the plural bonds; consequently, the internal stress in the cross-linked protective layer comes to higher.

Further, the photoconductor according to the present invention exhibits proper electric properties, therefore, shows superior repeatability; and higher durability and higher stability may be achieved. These advantages are derived by that a radical polymerizable compound having one functionality and a charge transporting structure is utilized as the constituent material of the cross-linked protective layer having the charge transporting structure, and the radical polymerizable compound is fixed as pendants between the crosslinked bonds. When the charge transporting substance without a functional group is incorporated into the cross-linked layer, the deposition and/or whiting may be induced as described above, and decrease of sensitivity and deterioration of electric properties under repeated usages such as increase of residual potential are significant. When the charge transporting compound having two or more functionality is employed, the intermediate structure such as cation radical is not stable under charge transporting, therefore, the decrease of sensitivity and the increase of residual potential are likely to occur.

The deterioration of the electric properties results in the images such as decrease of image density and the thinned letters. In addition, the photoconductor according to the present invention may be designed as the underlying charge transporting layer with higher mobility having less charge traps as the prior photoconductor, thereby the electrical adverse effect of the cross-linked protective layer having the charge transporting structure may be minimized.

In the formation of the cross-linked protective layer having the charge transporting structure according to the present invention, the wear resistance may be remarkably enhanced by making insoluble the cross-linked protective layer having the charge transporting structure against organic solvents. The cross-linked protective layer having the charge transporting structure is formed by curing a radical polymerizable monomer having three or more functionalities and no charge transporting structure and a radical polymerizable compound having one functionality and a charge transporting structure, and exhibits an outstanding three-dimensional network structure as the entire layer. By the way, the cross-linked protective layer may have lower cross-linked density at local sites, or formed as an aggregate of fine hardened products with high density of cross-linking due to additives of other components such as mono- or di-functional monomer, polymer binder, anti-oxidant, leveling agent, and plasticizer, incorporation of a dissolved component from underlying layer, and curing conditions. Such a cross-linked protective layer exhibits lower bonding strength between the hardened products, a solubility against organic solvents, and is likely to occur the local abrasion and/or delamination of fine hardened products during the repeated usages in the electrophotographic process. Through making the cross-linked protective layer having the charge transporting structure insoluble against organic solvents, the cross-linked protective layer bears the inherent outstanding three-dimensional network structure, possesses higher cross-linked level, and the hardened product may be polymerized with chain reactions in a wide ranges, thereby the abrasion resistance is remarkably improved.

Next, the component materials of the coating liquid of the cross-linked protective layer having the charge transporting structure are described.

The radical polymerizable monomer having tree or more functionalities and no charge transporting structure, which is used in the present invention refers to a monomer which does not contain a hole transporting structure, such as, for example, triarylamine, hydrazone, pyrazoline, carbazole and the like, and an electron transporting structure such as, for example, fused polycyclic quinone, diphenoquinone and an electron pulling aromatic ring having cyano group or nitro group, but has a three or more of radical polymerizable functional groups. The radical polymerizable functional group may be any one which has a carbon-carbon double bonds and is a radical polymerizable group. Examples of the radical polymerizable functional group include, for example, a 1-substituted ethylene functional group and a 1,1-substituted ethylene functional groups.

(1) Examples of the 1-substituted ethylene functional group include a functional group represented by the following formula (10).

$$CH_2{=}CH{-}X_1{-} \qquad \text{Formula (10)}$$

In the formula, $X_1$ represents arylene group such as phenylene group, naphthylene group and the like, which may be substituted, alkynylene group which may be substituted, —CO— group, —COO— group, —CON($R_{10}$)— group, or —S— group. $R_{10}$ represents an alkyl group such as hydrogen, methyl group and ethyl group; aralkyl group such as benzyl group, naphthylmethyl group and phenethyl group; and aryl group such as phenyl group and naphthyl group.

Concrete examples of these substituents include vinyl group, styryl group, 2-methyl-1,3-butadienyl group, vinylcarbonyl group, acryloyloxy group, acryloylamino group, vinylthioether group and the like.

(2) Examples of the 1,1-substituted ethylene functional group include a functional group represented by the following formula (11).

$$CH_2{=}C(Y){-}X_2{-} \qquad \text{Formula (11)}$$

In the formula, Y represents an alkyl group which may be substituted, an aralkyl group which may be substituted, an aryl group such as phenyl group, naphthyl group which may be substituted, a halogen atom, a cyano group, a nitro group, an alkoxy group such as methoxy group or ethoxy group, —$COOR_{11}$ group, or —$CONR_{12}R_{13}$. $R_{11}$ represents a hydrogen atom, an alkyl group such as methyl group, ethyl group and the like which may be substituted, an aralkyl group such as benzyl and phenethyl group which may be substituted, an aryl group such as phenyl group and naphthyl group which may be substituted. $R_{12}$ and $R_{13}$ represent a hydrogen atom, an alkyl group such as methyl group, ethyl group and the like which may be substituted, an aralkyl group such as benzyl group, naphthylmethyl group or phenethyl group which may be substituted, or an aryl group such as phenyl group and naphthyl group which may be substituted and may be identical or different. $X_2$ represents a substituent as defined for $X_1$ of the formula (10) and a single bond, an alkylene group. In addition, at least any one of Y and $X_2$ is an oxycarbonyl group, a cyano group, alkenylene group, or an aromatic ring.

Concrete examples of these substituents include alpha-chloro acryloyloxy group, methacryloyloxy group, alpha-cyanoethylene group, alpha-cyanoacryloyloxy group, alpha-cyanophenylene group, methacryloylamino group and the like.

Examples of the substituent which is additionally substituted to the subsituents of $X_1$, $X_2$ and Y include a halogen atom, a nitro group, a cyano group, an alkyl group such as methyl group, ethyl group and the like, an alkoxy group such as methoxy group, ethoxy group and the like, an aryloxy group such as phenoxy group and the like, an aryl group such as phenyl group, naphthyl group and the like, and an aralkyl group such as benzyl group, phenethyl group and the like.

Among these radical polymerizable functional groups, acryloyloxy group and methacryloyloxy group are particularly useful and compounds having 3 or more of acryloyloxy groups may be prepared, for example, by esterification or transesterification of a compound having 3 or more hydroxy groups in the molecule with acrylic acid (salt), acrylic acid halide, acrylic acid ester. Also, a compound having 3 or more methacryloyloxy groups may be similarly prepared. The radical polymerizable functional groups in a monomer having 3 or more radical polymerizable functional groups may be identical or different.

Concrete examples of the radical polymerizable monomer having three or more functionalities and no charge transporting structure are exemplified below but are not limited thereto.

That is, the radical polymerizable monomer which can be used in the present invention includes trimethylolpropanetriacrylate (TMPTA), trimethylolprop anetrimethacrylate, HPA-modified trimethylolpropanetriacrylate, EO-modified trimethylolpropane triacrylate, PO-modified trimethylolpropane triacrylate, caprolactone-modified trimethylolpropane tria crylate, HPA-modified trimethylolpropane trimethacrylate, pentaerythritol triacrylate, pentaerythritol tetraacrylate (PETTA), glycerol triacrylate, ECH-modified glycerol triacrylate, EO-modified glycerol triacrylate, PO-modified glycerol triacrylate, tris(acryloxyethyl)isocyanurate, dipentaerythritol hexacrylate (DPHA), caprolactone-modified dipentaerythritol hexacrylate, dipentaerythritolhydroxy pentaacrylate, alkyl-modified dipentaerythritol pentaacrylate, alkyl-modified dipentaerythritol tetraacrylate, alkyl-modified dipentaerythritol triacrylate, dimethylolpropane tetraacrylate (DTMPTA), pentaerythritolethoxy tetraacrylate, EO-modified phosphonic acid triacrylate, 2,2,5,5,-tetrahydroxymethylcyclopentanone tetraacrylate and the like, which may be used alone or in combination of two or more thereof.

As the radical polymerizable monomer having three ore more functionalities and no charge transporting structure which can be used in the present invention, a ratio (molecular weight/number of functional group) of molecular weight to the number of functional group in the monomer is preferably 250 or less to form a dense cross-linkage in the cross-linked protective layer. If the ratio is greater than 250, the cross-linked protective layer becomes soft, which may cause somewhat reduction in abrasion resistance. Therefore, in case of using a monomer having a modifying group such as HPA, EO, PO and caprolactone, it is not preferable to use a monomer having an excessively long modifying group alone. The compositional ratio of the radical polymerizable monomer having three or more functionalities and no charge transporting structure used in the cross-linked protective layer having the charge transporting layer is 20% to 80% by mass, preferably 30% to 70% by mass relative to the total amount of the cross-linked protective layer. If the monomer component is less than 20% by mass, 3-dimensional cross-linkage density of the cross-linked protective layer having the charge transporting structure is reduced and thus it cannot accomplish a significant improvement in abrasion resistance as compared to the conventional thermoplastic binder resins. Also, if it exceeds 80% by mass, the content of the charge transport compound is reduced, causing deterioration in electrical properties. Though it is impossible to define a generally preferable range since the required abrasion resistance or electrical properties vary according to a used process and the thickness of the cross-linked protective layer also varies according thereto, the content is most preferably is in the range of 30% to 70% by mass, considering the balance between both properties.

The a radical polymerizable compound having one functionality and a charge transporting structure refers to a compound which contains a hole transporting structure, such as, for example, triarylamine, hydrazone, pyrazoline, carbazole and the like, and an electron transporting structure such as, for example, fused polycyclic quinone, diphenoquinone and an electron pulling aromatic ring having cyano group or nitro group, and has one radical polymerizable functional group. The radical polymerizable functional group includes functional groups represented by the radical polymerizable monomers described above. Particularly, acryloyloxy group, and methacyloyloxy group are useful. Further, as the charge transporting structure, a triarylamine structure is highly effective, and particularly, a compound represented by the following General Formula (1) or (2) may be used to maintain good electrical properties such as sensitivity and residual potential.

General Formula (1)

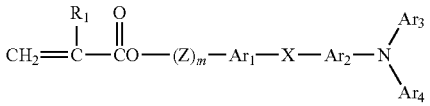

General Formula (2)

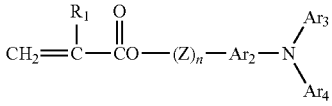

In the formulae, $R_1$ represents a hydrogen atom, a halogen atom, an alkyl group which may be substituted, an aralkyl group which may be substituted, an aryl group which may be substituted, a cyano group, a nitro group, an alkoxy group, —$COOR_7$, a halogenated carbonyl group or $CONR_8R_9$. $R_7$ represents a hydrogen atom, an alkyl group which may be substituted, an aralkyl group which may be substituted or an aryl group which may be substituted, and $R_8$ and $R_9$ represent a hydrogen atom, a halogen atom, an alkyl group which may be substituted, an aralkyl group which may be substituted or an aryl group which may be substituted, which may be identical or different. $Ar_1$ and $Ar_2$ represent a substituted or unsubstituted arylene group, which may be identical or different. $Ar_3$ and $Ar_4$ represent a substituted or unsubstituted aryl group, which may be identical or different. X represents a single bond, a substituted or unsubstituted alkylene group, a substituted or unsubstituted cycloalkylene group, a substituted or unsubstituted alkylene ether group, a oxygen atom, a sulfur atom or a vinylene group. Z represents a substituted or unsubstituted alkylene group, a substituted or unsubstituted alkylene ether group or an alkyleneoxycarbonyl group. m and n represent an integer of 0 to 3.

Concrete examples of the General Formulae (1) and (2) are as follows.

In the General Formulae (1) and (2), the alkyl group as a substituent of $R_1$ includes, for example, methyl group, ethyl group, propyl group, butyl group and the like, the aryl group includes phenyl group, naphthyl group and the like, the aralkyl group includes benzyl group, phenethyl group, naphthylmethyl group and the like, the alkoxy group includes methoxy group, ethoxy group, propoxy group the like, which may be substituted by a halogen atom, a nitro group, a cyano group, an alkyl group such as methyl group, ethyl group and the like, an alkoxy group such as methoxy group, ethoxy group and the like, an aryloxy group such as phenoxy group and the like, an aryl group such as phenyl group, naphthyl group and the like, an aralkyl group such as benzyl group, phenethyl group and the like.

Particularly preferred examples of the substituents of $R_1$ are a hydrogen atom and methyl group.

The substituted or unsubstituted $Ar_3$ and $Ar_4$ are an aryl group and the examples of the aryl group include fused polycyclic hydrocarbon groups, non-fused cyclic hydrocarbon groups and polycyclic groups.

The fused polycyclic hydrocarbon group is preferably one having 18 or less carbon atoms to form a ring, including, for example, pentanyl group, indenyl group, naphthyl group, azulenyl group, heptaprenyl group, biphenylenyl group, a s-indacenyl group, s-indacenyl group, fluorenyl group, acenaphthylenyl group, pleiadene adenyl group, acenaphthenyl group, phenalenyl group, phenathryl group, antholyl group, fluorandenyl group, acephenanthrylenyl group, aceanthrylenyl group, triphenylenyl group, pyrenyl group, chrysene, and naphthacenyl group.

The non-fused hydrocarbon group includes an univalent group of a monocyclic hydrocarbon compound such as benzene, diphenyl ether, polyethylenediphenyl ether, diphenylthioether and diphenylsulphone, an univalent group of a non-fused polycyclic hydrocarbon compound, such as biphenyl, polyphenyl, diphenylalkane, diphenylalkene, diphenylalkyne, triphenylmethane, distyrylbenzene, 1,1-diphenylcycloalkane, polyphenylalkane and polyphenylalkene, or an univalent group of a cyclic hydrocarbon compound such as 9,9-diphenylfluorene.

The polycylic group includes a univalent group of carbazole, dibenzofuran, dibenzothiphene, oxadiazole, and thiadiazole.

Also, the aryl group represented by $Ar_3$ and $Ar_4$ may be substituted by a substituent, for example, as follows.

(1) a halogen atom, a cyano group, a nitro group and the like.

(2) an alkyl group, preferably a $C_1$ to $C_{12}$, particularly a $C_1$ to $C_8$, more preferably a $C_1$ to $C_4$ straight-chained or branched alkyl group, wherein the alkyl group may be further substituted by a fluorine atom, a hydroxy group, a cyano group, a $C_1$ to $C_4$ alkoxy group, phenyl group, or a phenyl group substituted by a halogen atom, a $C_1$ to $C_4$ alkyl group or a $C_1$ to $C_4$ alkoxy group. Concretely, it includes methyl group, ethyl group, n-butyl group, i-propyl group, t-butyl group, s-butyl group, n-propyl group, tri-fluoromethyl group, 2-hydroxyethyl group, 2-ethoxyethyl group, 2-cyanoethyl group, 2-methoxyethyl group, benzyl group, 4-chlorobenzyl group, 4-methylbenzyl group, 4-phenylbenzyl group and the like.

(3) an alkoxy group (—$OR_2$), wherein $R_2$ represents an alkyl group as defined in (2). Concretely, it includes methoxy group, ethoxy group, n-propoxy group, i-propoxy group, t-butoxy group, n-butoxy group, s-butoxy group, i-butoxy group, 2-hydroxyethoxy group, benzyloxy group, tri-fluoromethoxy group and the like.

(4) an aryloxy group, wherein the aryl group may be phenyl group and naphthyl group, which may be substituted by a $C_1$ to $C_4$ alkoxy group, a $C_1$ to $C_4$ alkyl group or a halogen atom. Concretely, it includes phenoxy group, 1-naphthyloxy group, 2-naphthyloxy group, 4-methoxyphenoxy group, 4-methylphenoxy group and the like.

(5) an alkylmercapto group or arylmercapto group. Concretely, it includes methylthio group, ethylthio group, phenylthio group, p-methylphenylthio group and the like.

(6)

Formula (d)

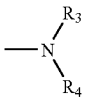

In the formula, $R_3$ and $R_4$ represent each independently a hydrogen atom, an alkyl group as defined in (2), or aryl group. The aryl group includes, for example, phenyl group, biphenyl group or naphthyl group, which may be substituted by a $C_1$ to $C_4$ alkoxy group, a $C_1$ to $C_4$ alkyl group or a halogen atom, or $R_3$ and $R_4$ may form a ring together.

Concretely, it includes amino group, diethylamino group, N-methyl-N-phenylamino group, N,N-diphenylamino group, N, N-di(tryl)amino group, dibenzylamino group, piperidino group, morpholino group, pyrrolidono group and the like.

(7) an alkylenedioxy group or alkylenedithio group such as methylenedioxy group or methylenedithio group.

(8) a substituted or unsubstituted styryl group, a substituted or unsubstituted β-phenylstyryl group, a diphenylaminophenyl group, ditolylaminophenyl group and the like.

The arylene group represented by $Ar_1$ and $Ar_2$ includes a divalent group derived from an aryl group represented by $Ar_3$ and $Ar_4$.

X represents a single bond, a substituted or usubstituted alkylene group, a substituted or usubstituted cycloalkylene group, a substituted or usubstituted alkylene ether group, an oxygen atom, a sulfur atom, or vinylene group.

The substituted or unsubstituted alkylene group is a $C_1$ to $C_{12}$, preferably $C_1$ to $C_8$, more preferably $C_1$ to $C_4$ straight chained or branched alkylene group, wherein the alkylene group may be further substituted by a fluorine, a hydroxy group, a cyano group, an $C_1$ to $C_4$ alkoxy group, a phenyl group, or a phenyl group substituted by a halogen atom, a $C_1$ to $C_4$ alkyl group or a $C_1$ to $C_4$ alkoxy group. Concretely, it includes methylene group, ethylene group, n-butylene group, i-propylene group, t-butylene group, s-butylene group, n-propylene group, trifluoromethylene group, 2-hydroxyethylene group, 2-ethoxyethylene group, 2-cyanoethylene group, 2-methoxyethylene group, benzylidene group, phenylethylene group, 4-chlorophenylethylene group, 4-methylphenylethylene group, 4-biphenylethylene group and the like.

The substituted or unsubstituted cycloalkylene group is a $C_5$ to $C_7$ cyclic alkylene group, wherein the cyclic alkylene group may be substituted by a fluorine atom, a $C_1$ to $C_4$ alkyl group or a $C_1$ to $C_4$ alkoxy group. Concretely, it includes cyclohexylidene group, cyclohexylene group, 3,3-dimethylcyclohexylidene group and the like.

The substituted or usubstituted alkylene ether group represents ethyleneoxy, propyleneoxy, ethylene glycol, propyleneglycol, diethyleneglycol, tetraethylene glycol or tripropyleneglycol, wherein the alkylene group may be substituted by a hydroxyl group, methyl group, ethyl group and the like.

The vinylene group is represented by the following formula (e) or (f).

Formula (e)

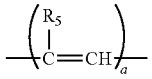

Formula (f)

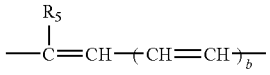

In the formulae (e) and (f), $R_5$ represents hydrogen, an alkyl group which is the same as defined in (2) or an aryl group which is the same with the aryl group represented by $Ar_3$ and $Ar_4$, "a" represents 1 or 2, and "b" represents 1 to 3.

Z represents a substituted or usubstituted alkylene group, a substituted or usubstituted alkylene ether group, or an alkyleneoxycarbonyl group.

The substituted or usubstituted alkylene group includes the alkylene groups as defined for X.

The substituted or usubstituted alkylene ether group includes the alkylene ether groups as defined for X.

The alkyleneoxycarbonyl group includes caprolactone-modified groups.

The radical polymerizable compound having one functionality and a charge transporting structure is more preferably a compound having General Formula (3).

General formula (3)

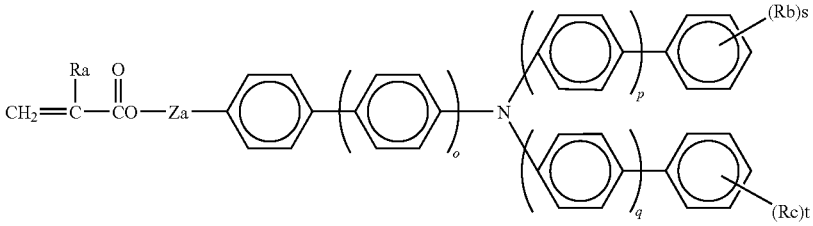

In the formula, "o," "p" and "q" each represent an integer of 0 or 1, Ra represents a hydrogen atom, a methyl group, Rb and Rc represent a substituent other than a hydrogen atom which is a $C_{1-6}$ alkyl group and may be different when they are two or more, "s" and "t" represent an integer of 0 to 3, and Za represents a single bond, a methylene group, an ethylene group, or a group expressed by the following formula (g), formula (h) or formula (i).

formula (g)

formula (h)

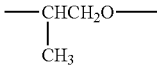

formula (i)

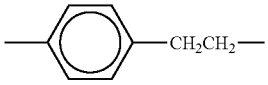

The compound represented by the above general formula (3) is preferably a compound wherein Rb and Rc are methyl group or ethyl group.

The radical polymerizable compound having one functionality and a charge transporting structure of the general formulae (1) and (2), particularly the general formula (3), which is used in the present invention, cannot be a terminal structure, sine the polymerization is accomplished by opening of the carbon-carbon double bond at both sides, but is inserted interposed in a continuous polymer chain. In a polymer crosslinked by polymerization with tri- or more-functional radical polymerizable monomer, it exists in the main chain of the polymer and in the cross-linkage between a main chain and a main chain (the cross-linkage includes a intermolecular cross-linkage between one polymer and the other polymer and an intramolecular cross-linkage between one site where a folded main chain is present in a polymer and the other site which is derived from a monomer polymerized at a position remote from the one site in the main chain). However, even when it is present in the main chain or it is present in the cross-linkage, it has at least three aryl groups radially oriented from a nitrogen atom in the triarylamine structure suspended from the chain and, though being bulky, is not directly bonded to the chain but suspended from the chain, for example, by a carbonyl group, thereby it is versatilely fixed for three dimensional orientation. Therefore, since the triarylamine structures can be properly oriented spatially adjacent to each other in a polymer, they do not lead to large structural distortion in a molecule, and it can be expected that when applied in a surface layer of an electrophotographic photoconductor, it may provide an intramolecular structure relatively avoiding interruption of a charge transport passage.

Concrete examples of the radical polymerizable compound having one functionality and a charge transporting structure according to the present invention are shown below, but are not limited to compounds of these structures.

No. 1

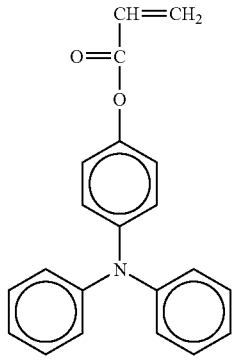

No. 2

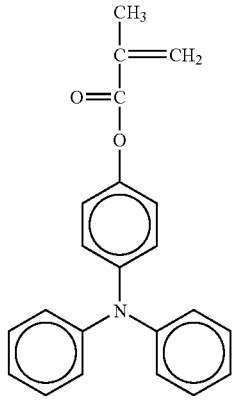

No. 3

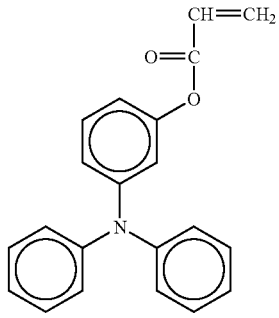

-continued
No. 4
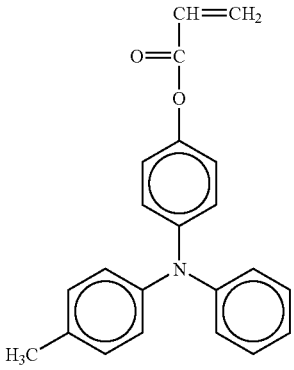
No. 5
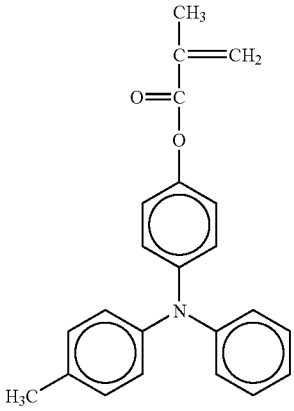
No. 6
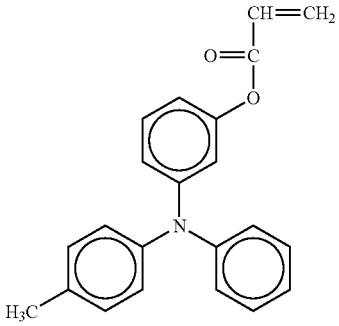
No. 7
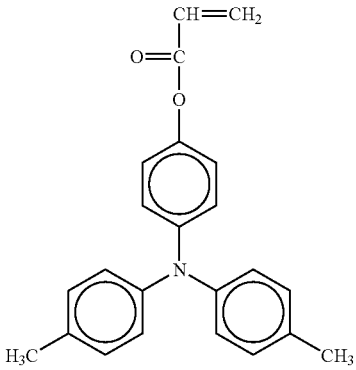
-continued
No. 8
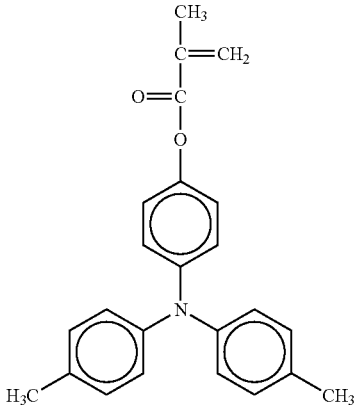
No. 9
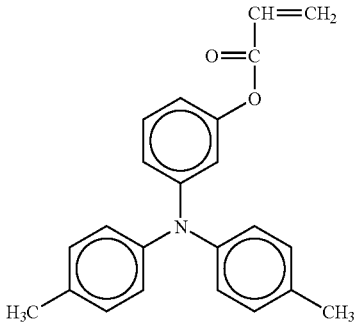
No. 10
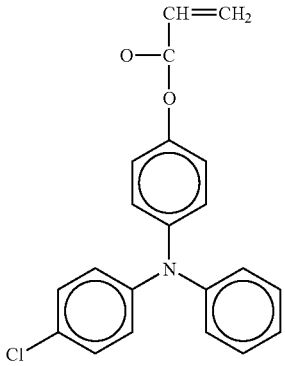
No. 11
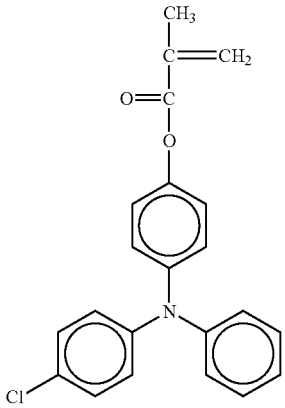

-continued
No. 12
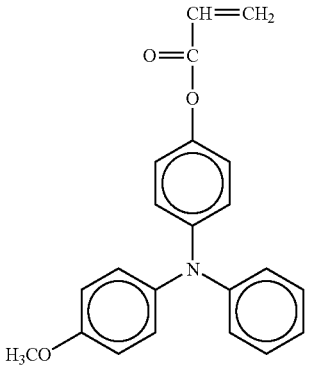
No. 13
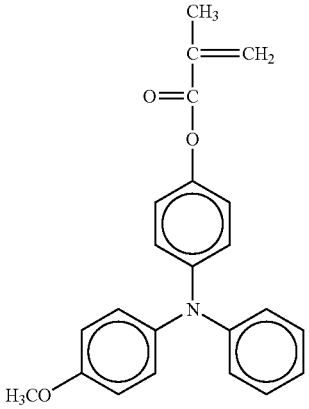
No. 14
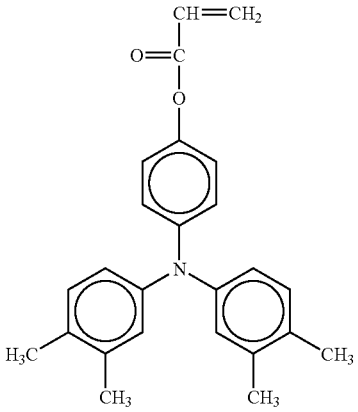
No. 15
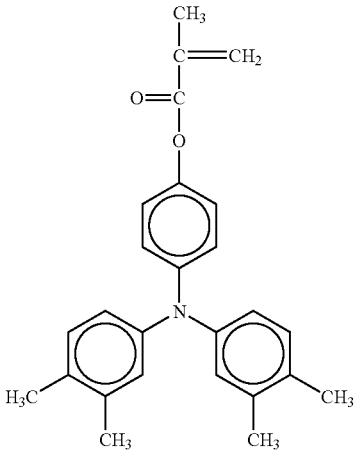
-continued
No. 16
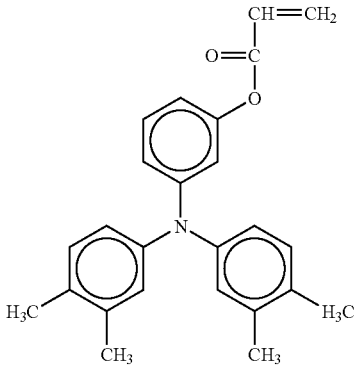
No. 17
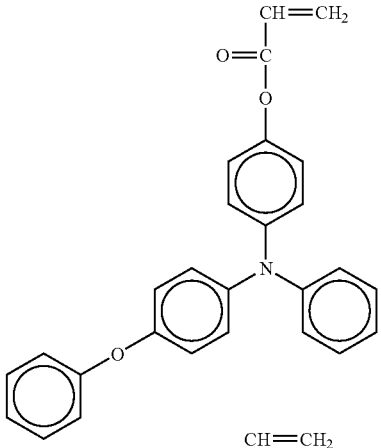
No. 18
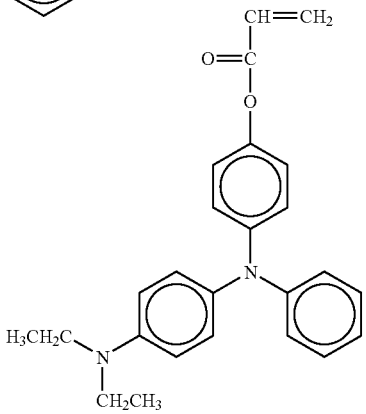
No. 19
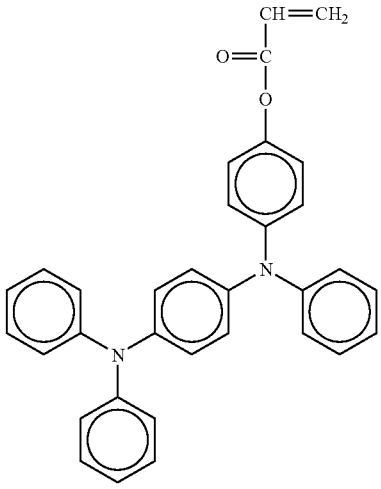

-continued
No. 20
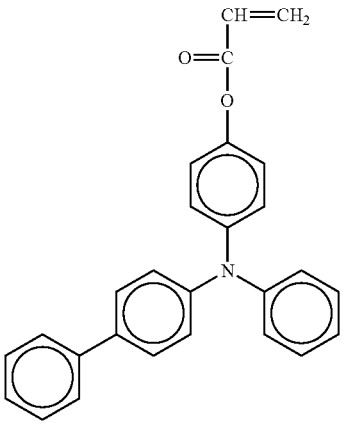
No. 21
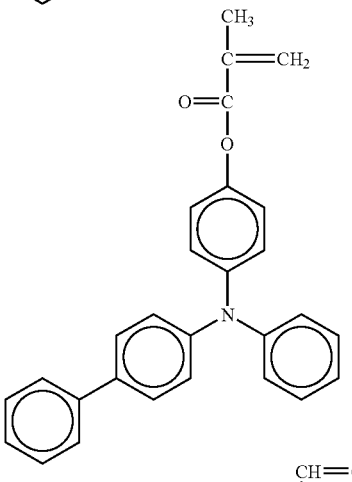
No. 22
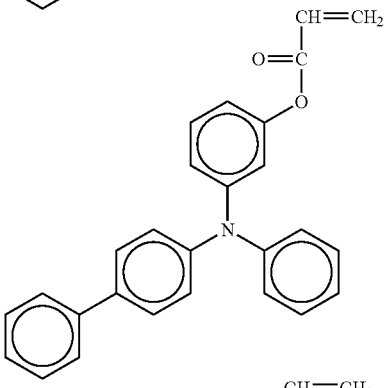
No. 23
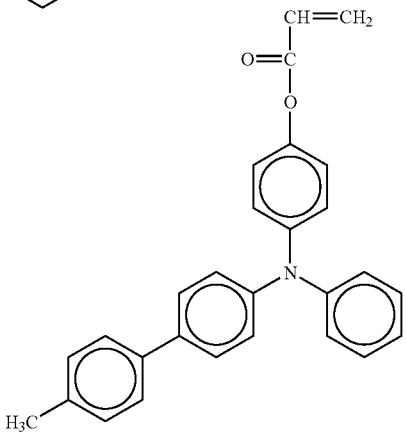
-continued
No. 24
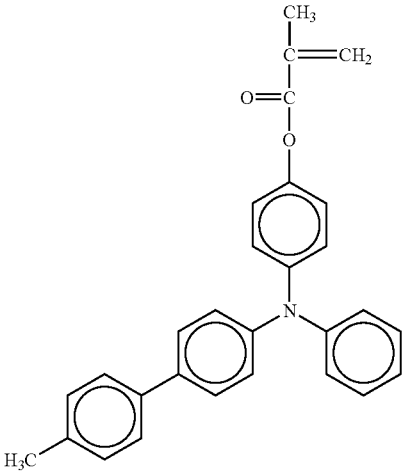
No. 25
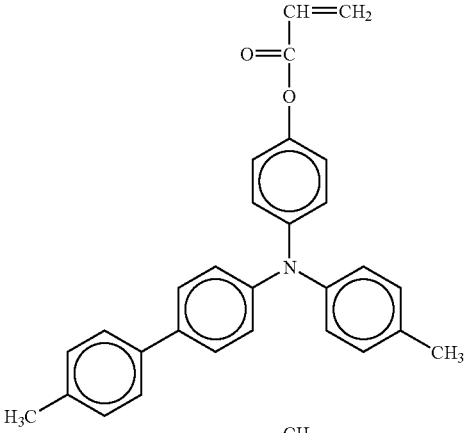
No. 26
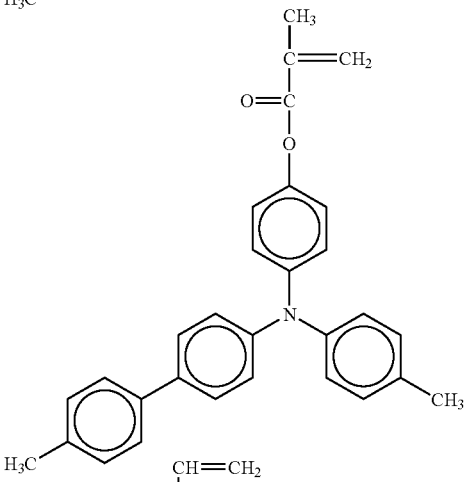
No. 27
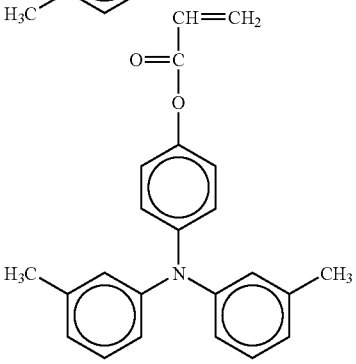

-continued
No. 28
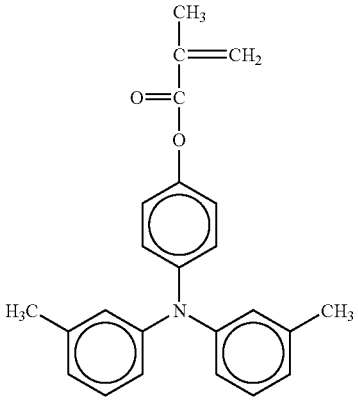
No. 29
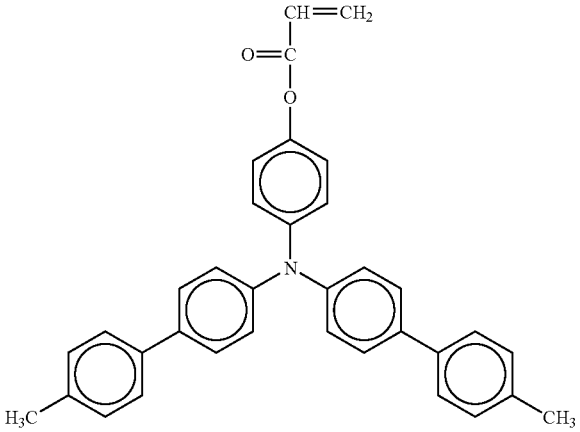
No. 30
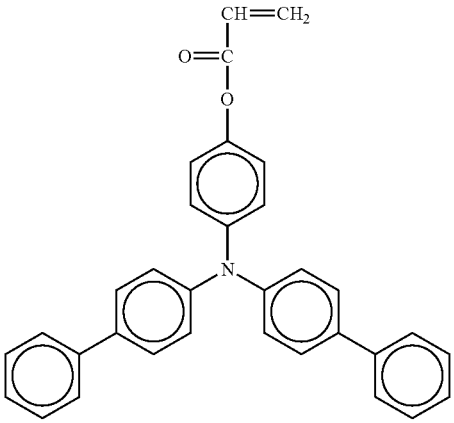
No. 31
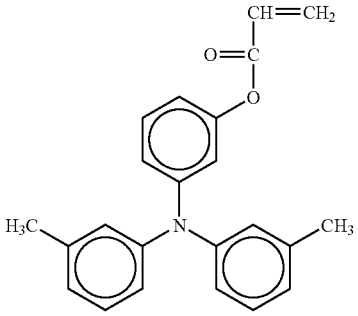
-continued
No. 32
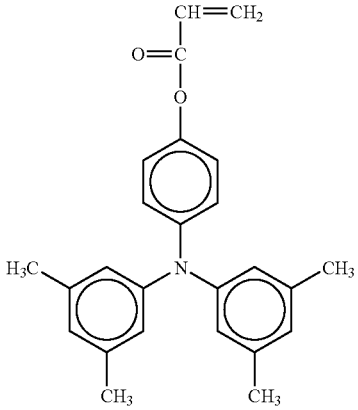
No. 33
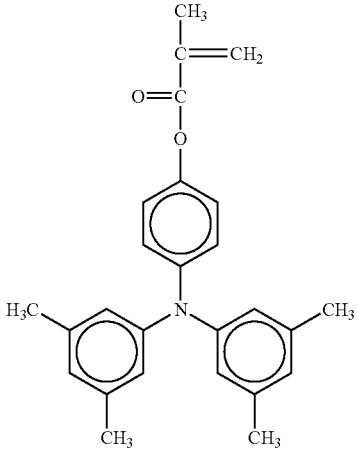
No. 34
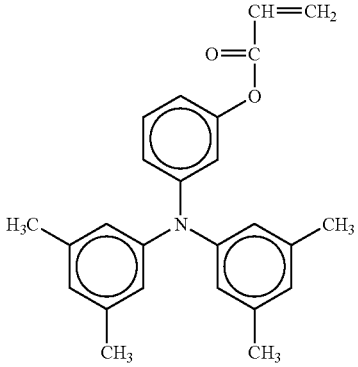
No. 35
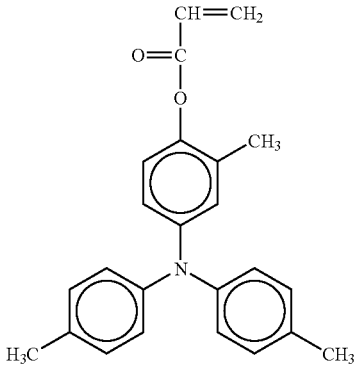

-continued
No. 36
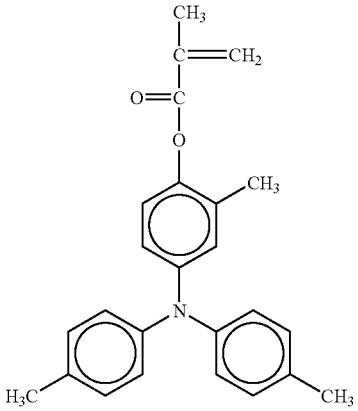
No. 37
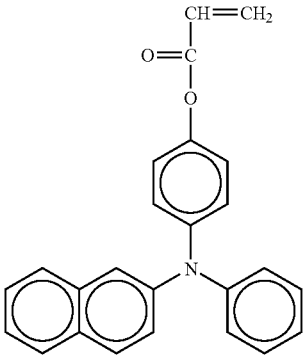
No. 38
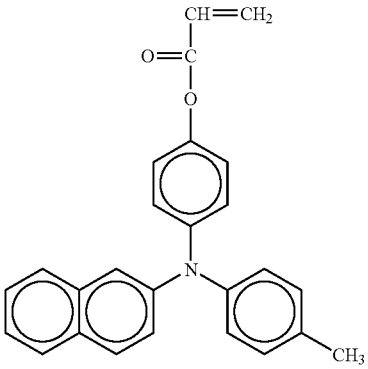
No. 39
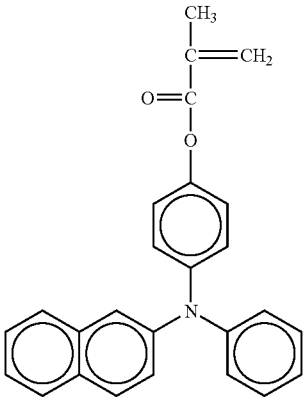
-continued
No. 40
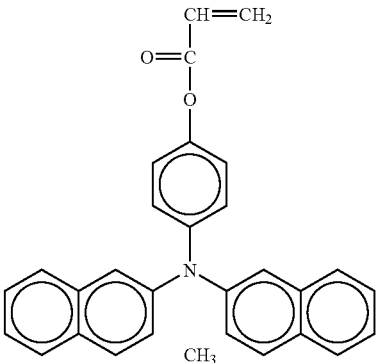
No. 41
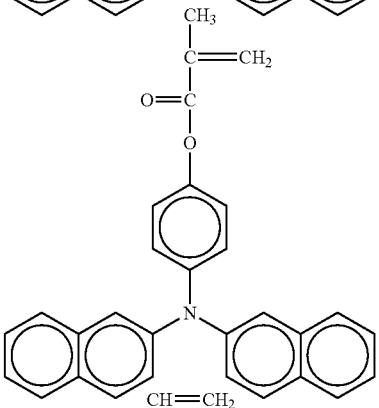
No. 42
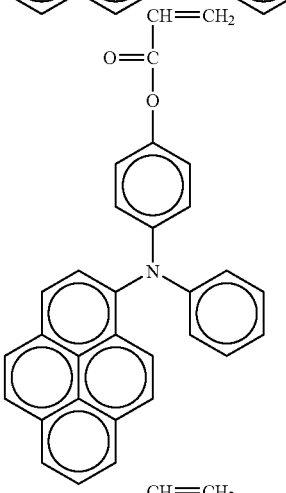
No. 43
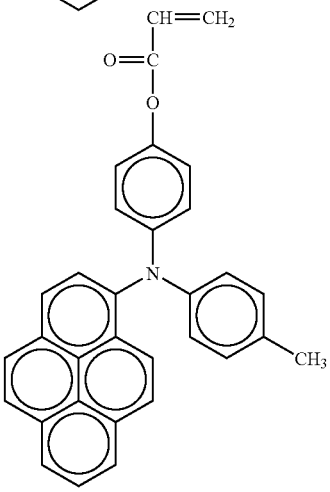

-continued
No. 44
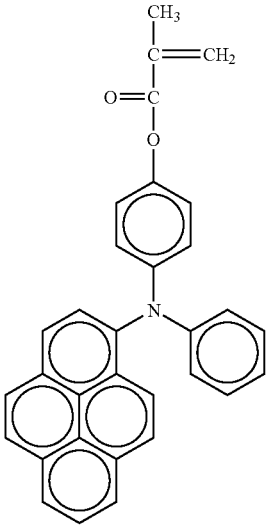
No. 45
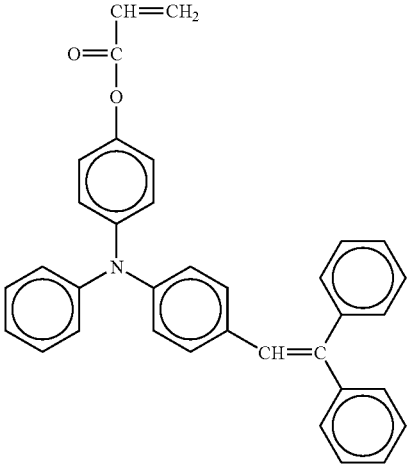
No. 46
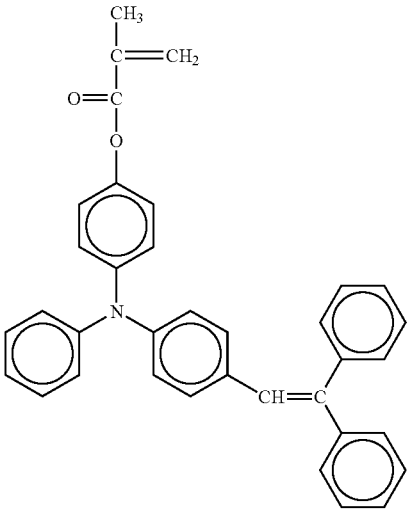
-continued
No. 47
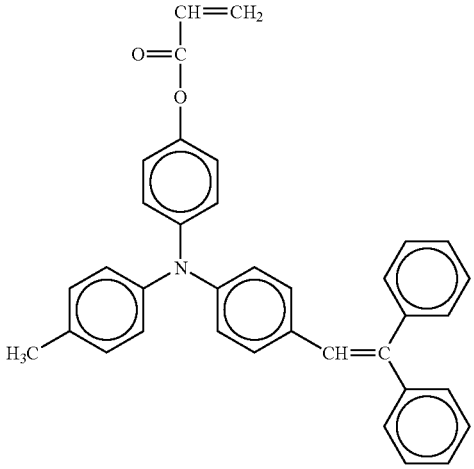
No. 48
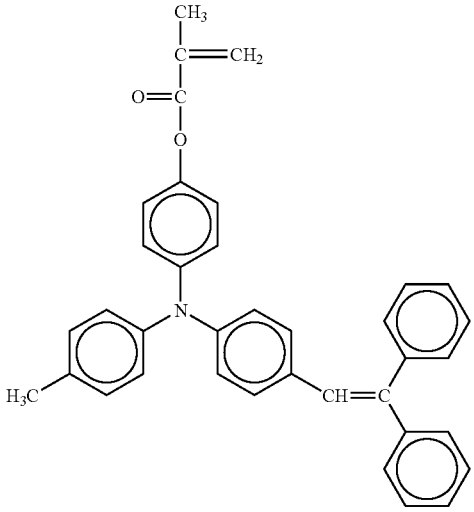
No. 49
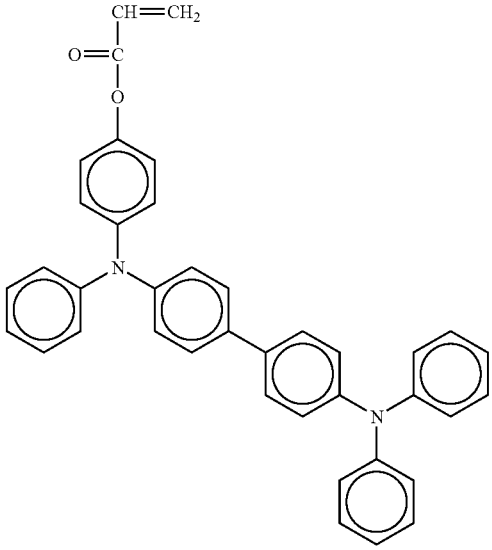

-continued
No. 50
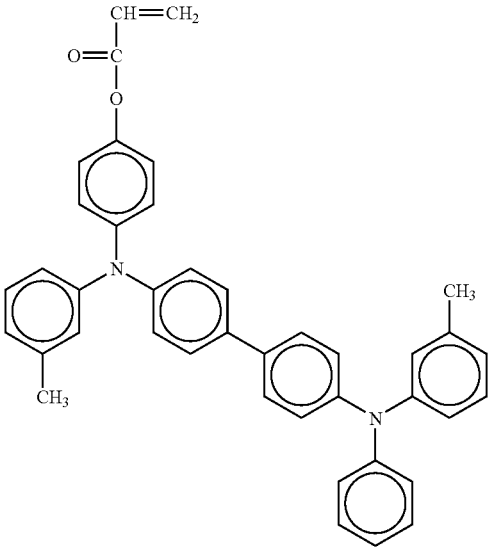
No. 51
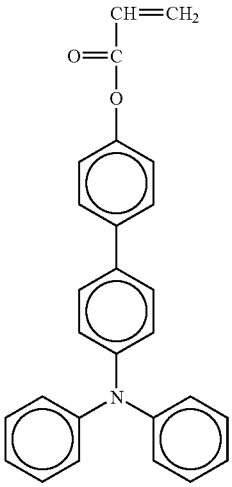
No. 52
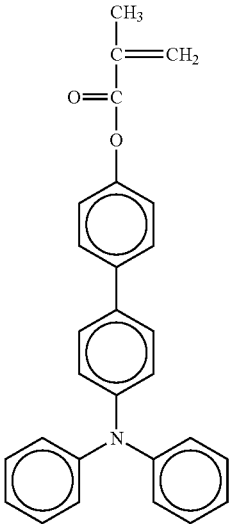
-continued
No. 53
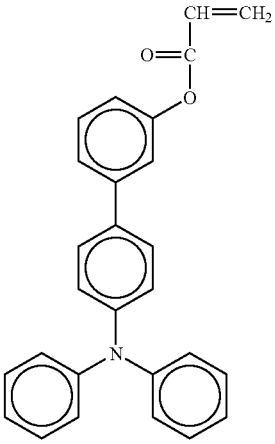
No. 54
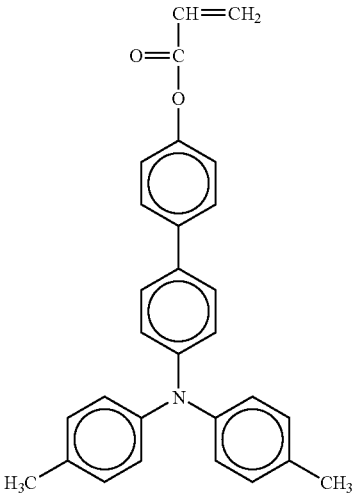
No. 55
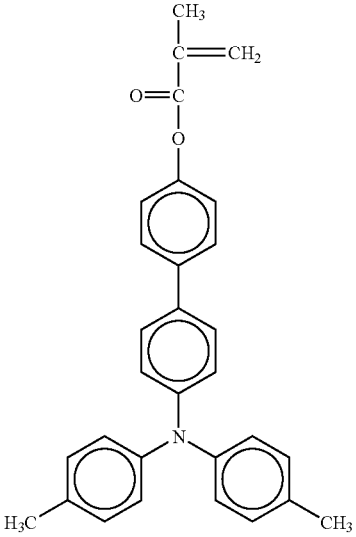

-continued
No. 56
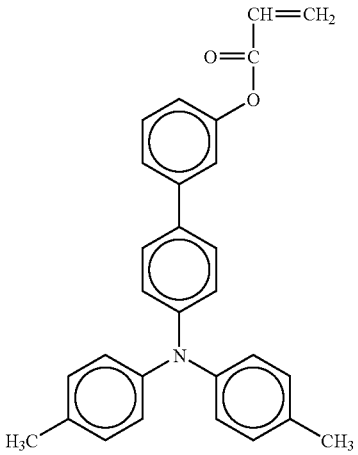
No. 57
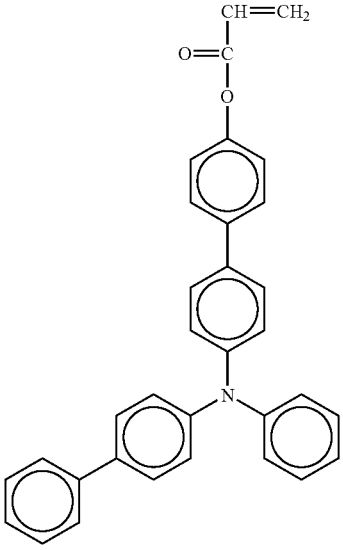
No. 58
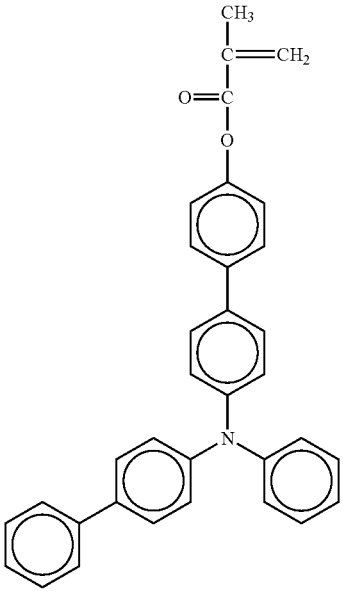
-continued
No. 59
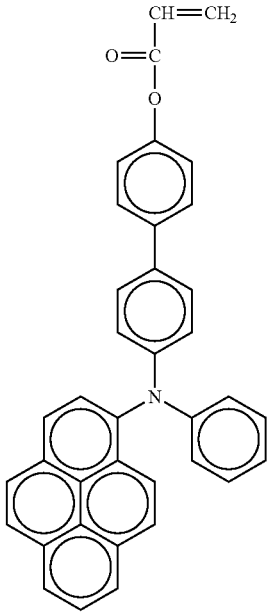
No. 60
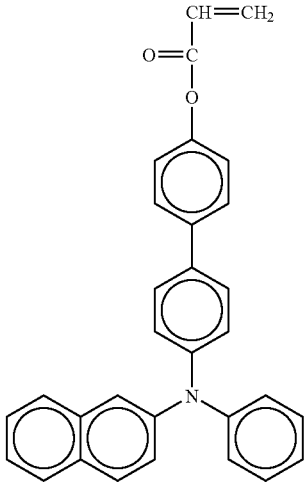
No. 61
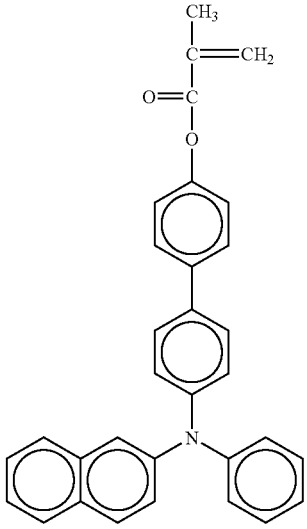

-continued
No. 62
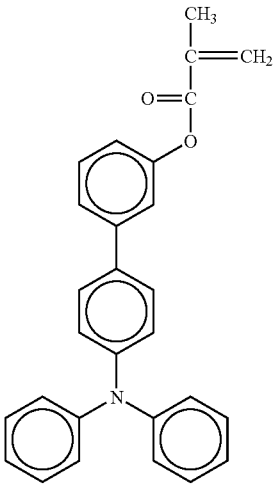
No. 63
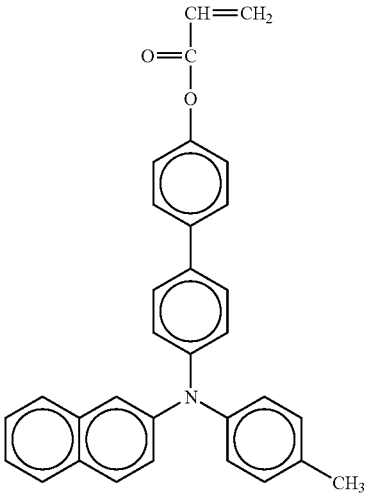
No. 64
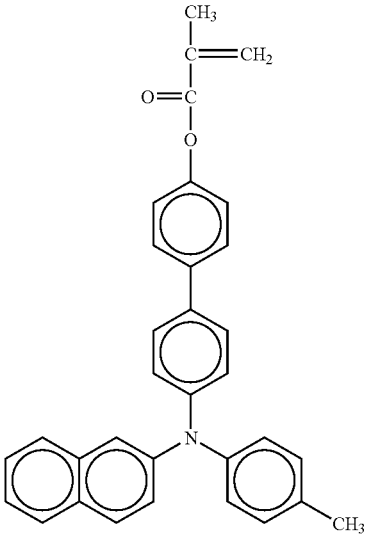
-continued
No. 65
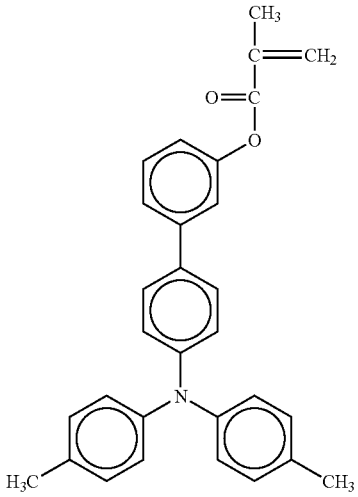
No. 66
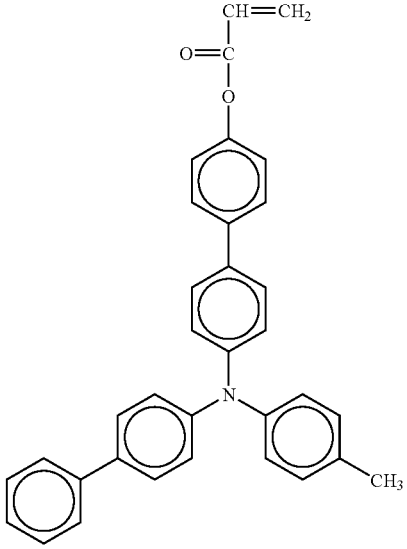
No. 67
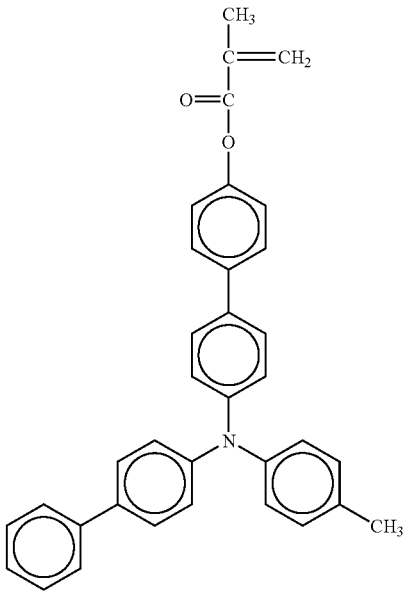

-continued
No. 68
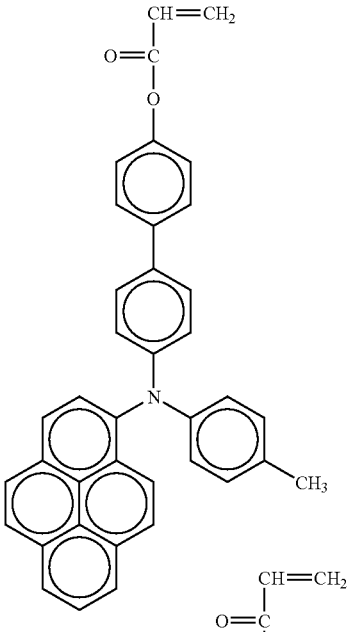
No. 69
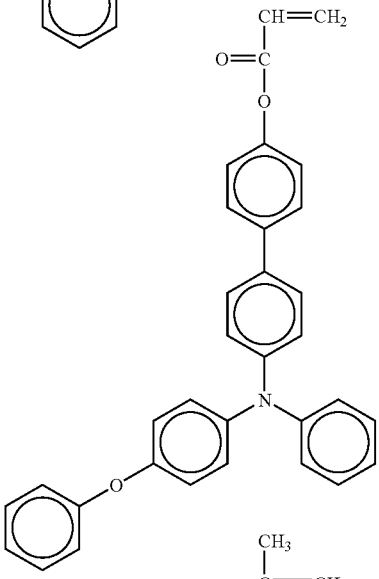
No. 70
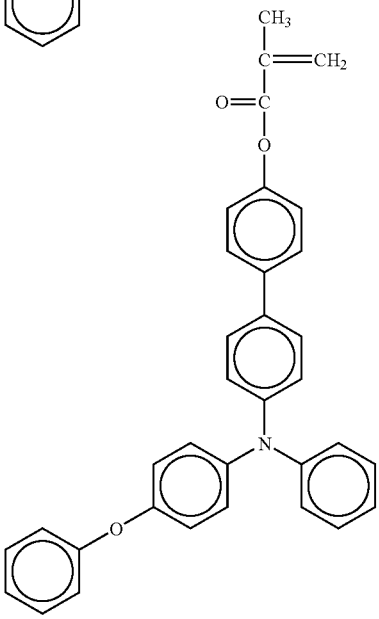
-continued
No. 71
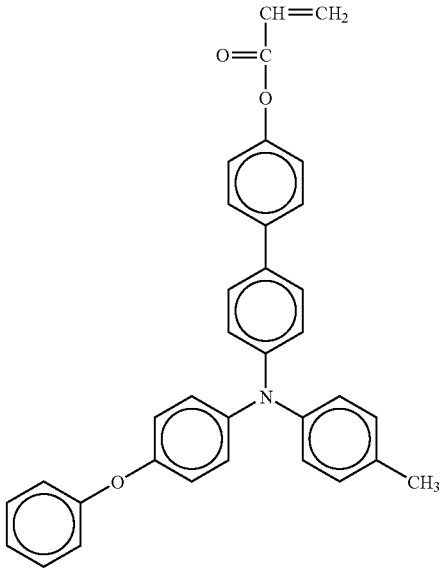
No. 72
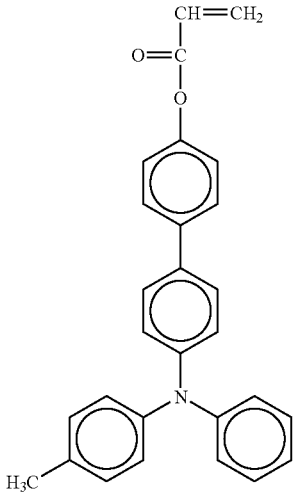
No. 73
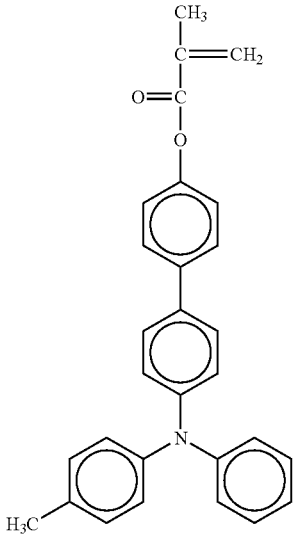

-continued
No. 74
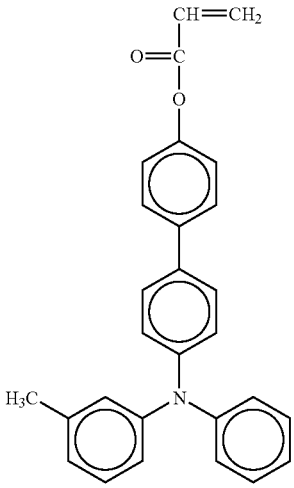
No. 75
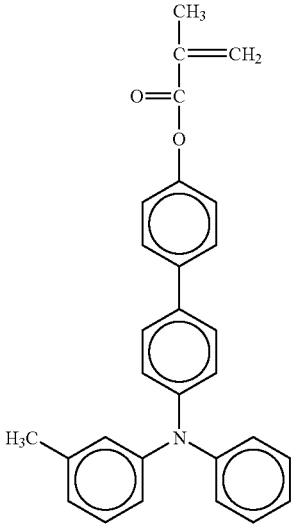
No. 76
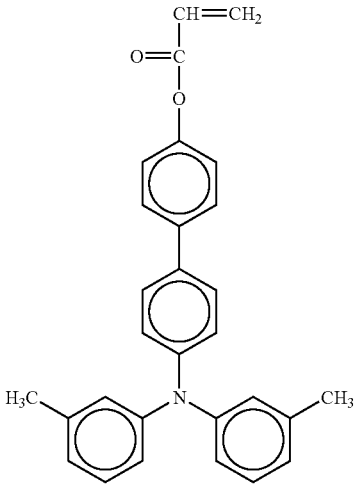
-continued
No. 77
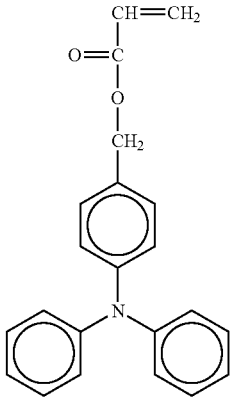
No. 78
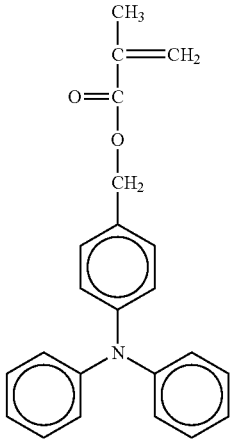
No. 79
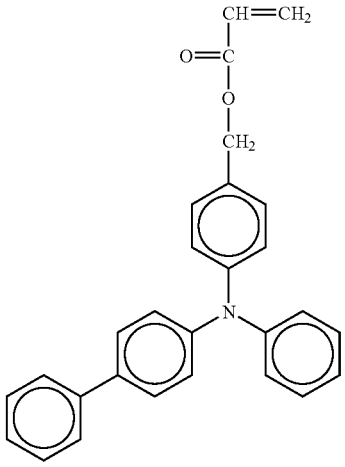

-continued
No. 80
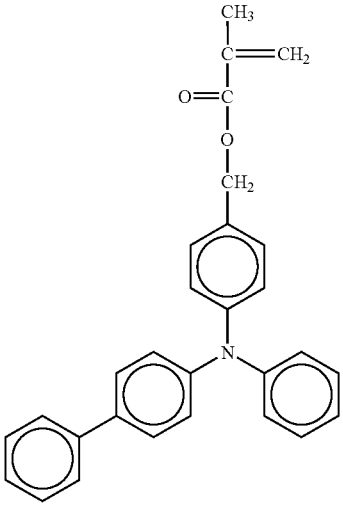
No. 81
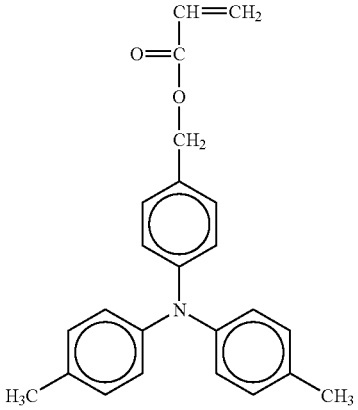
No. 82
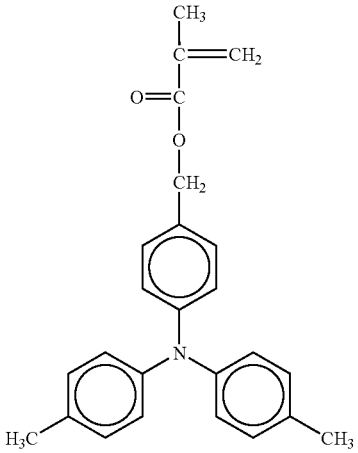
-continued
No. 83
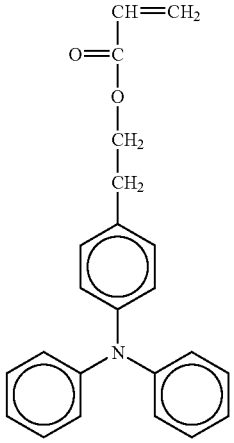
No. 84
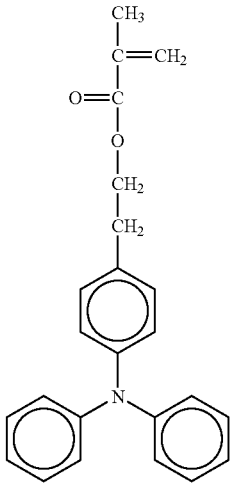
No. 85
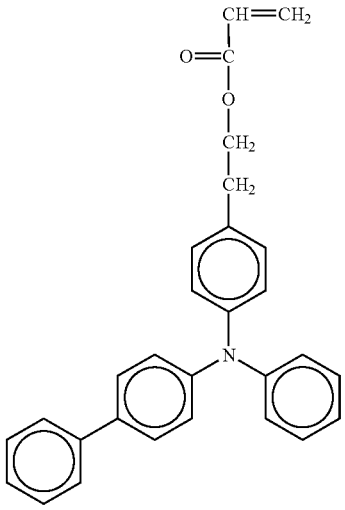

-continued
No. 86
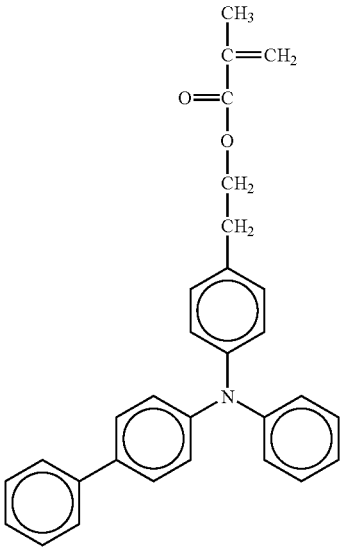
No. 87
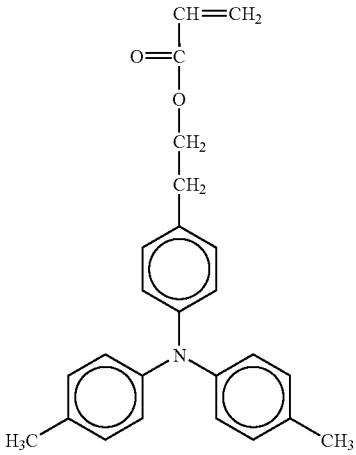
No. 88
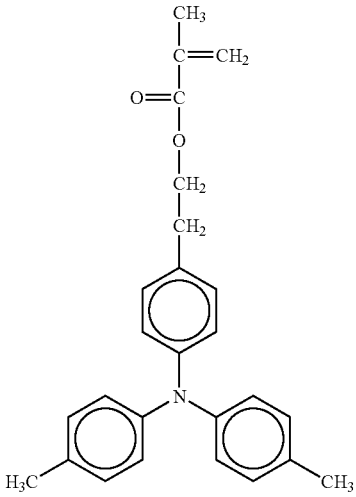
-continued
No. 89
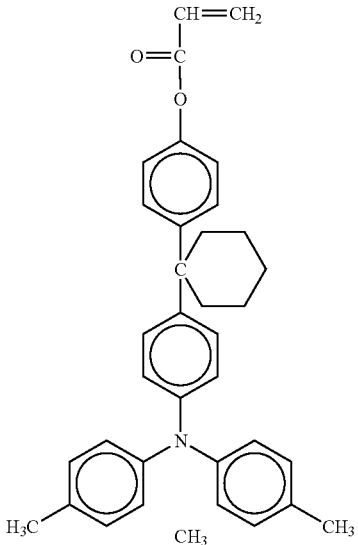
No. 90
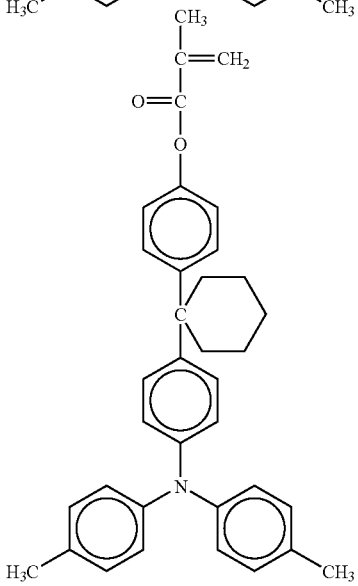
No. 91
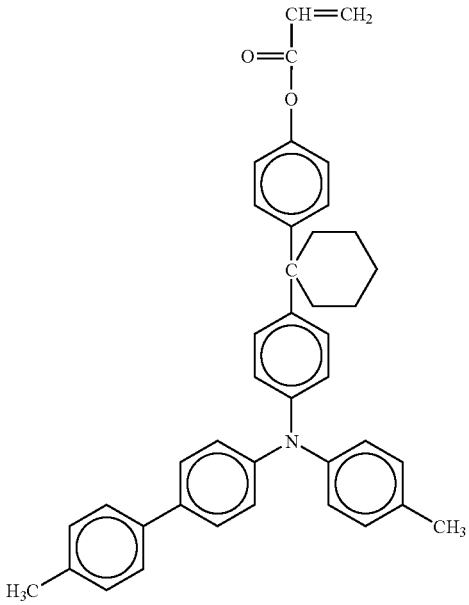

-continued
No. 92
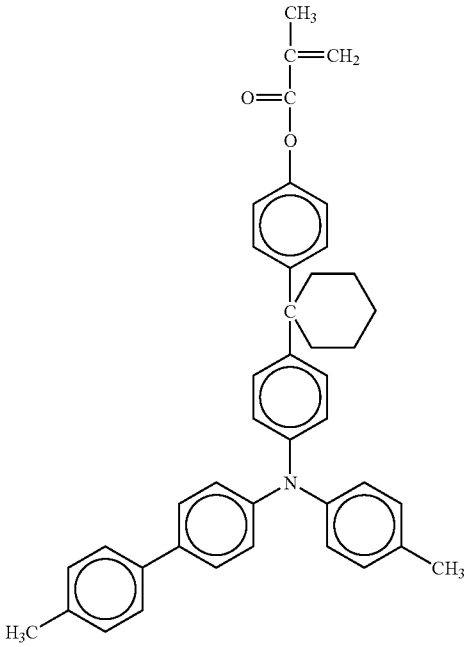
No. 93
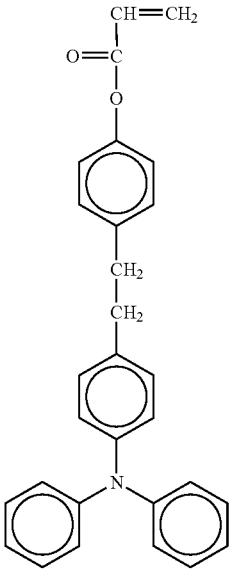
-continued
No. 94
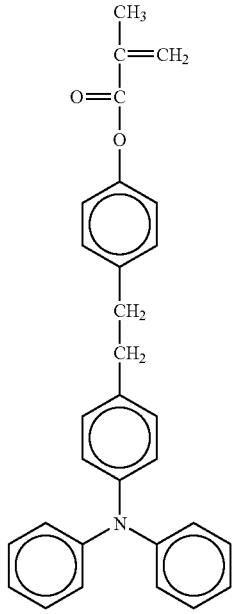
No. 95
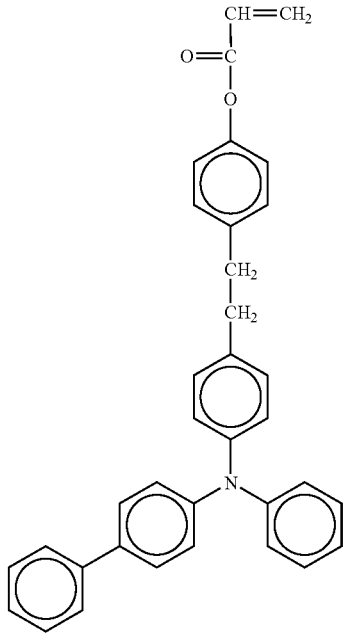

-continued
No. 96
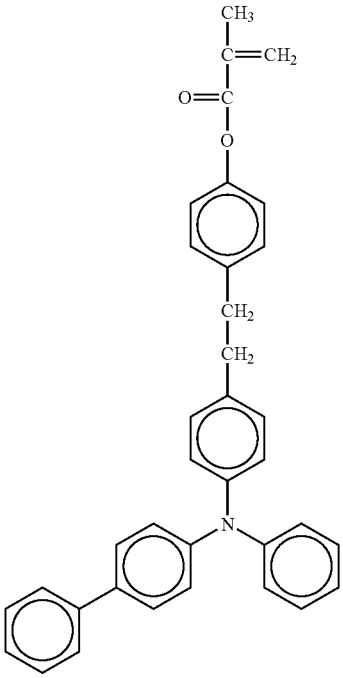
No. 97
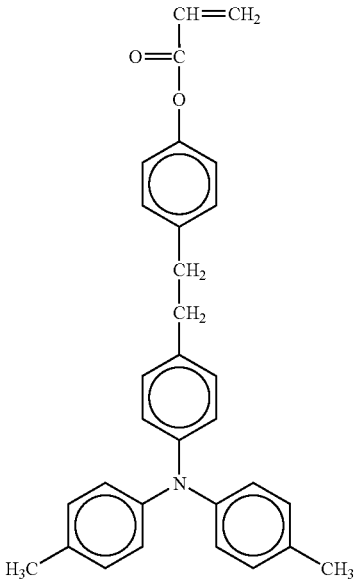
-continued
No. 98
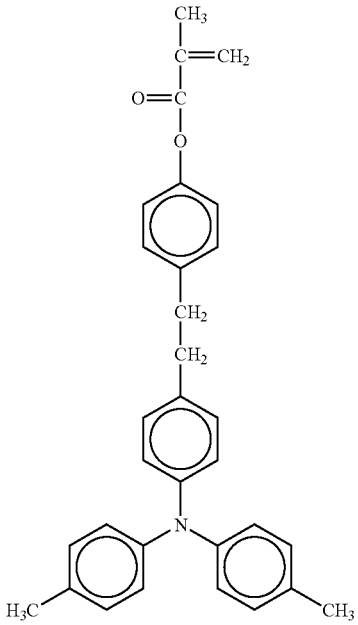
No. 99
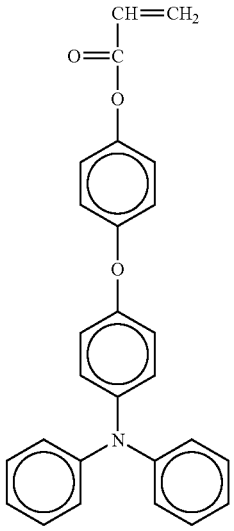

-continued
No. 100
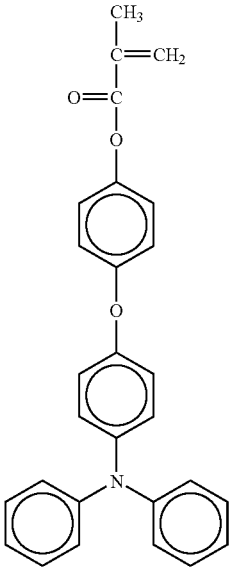
No. 101
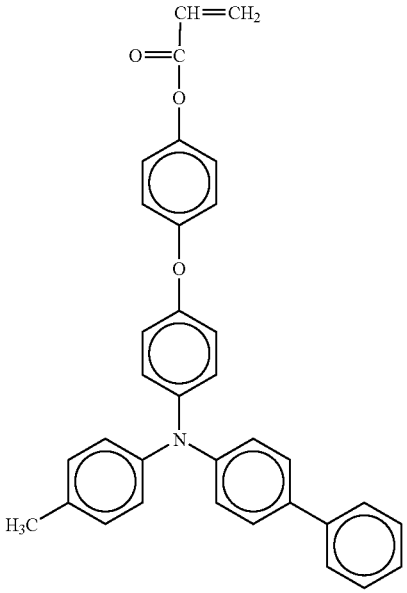
-continued
No. 102
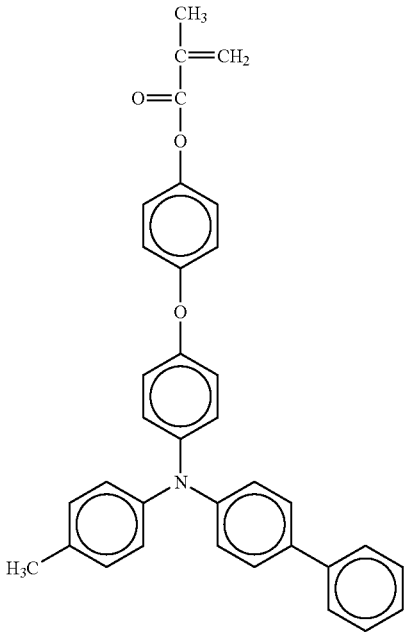
No. 103
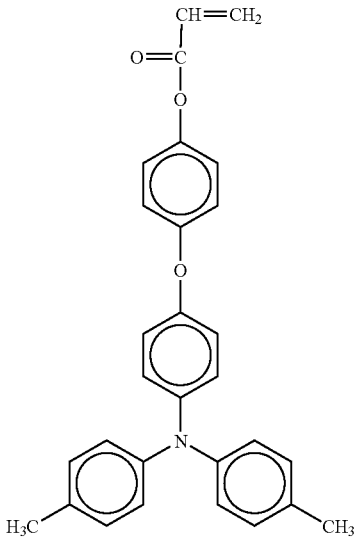

-continued
No. 104
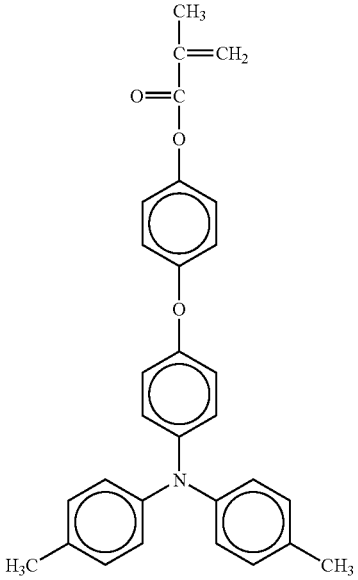
No. 105
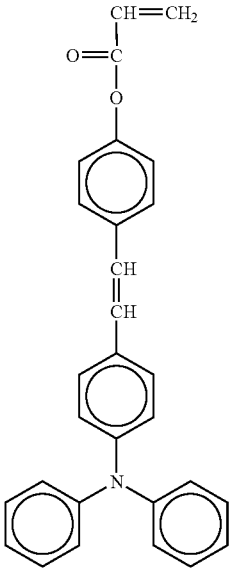
-continued
No. 106
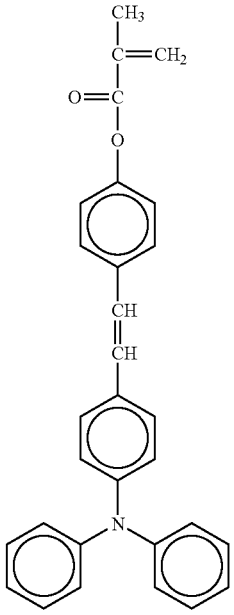
No. 107
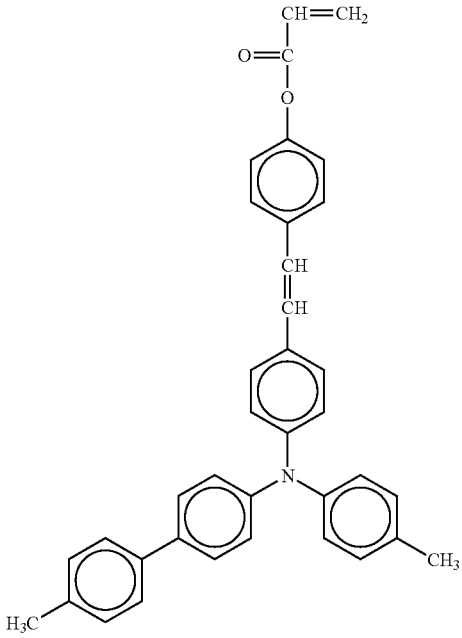

-continued
No. 108
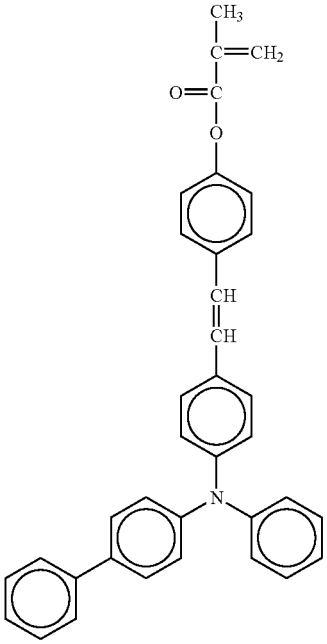
No. 109
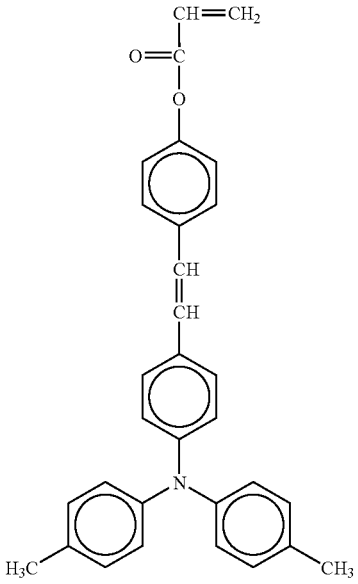
-continued
No. 110
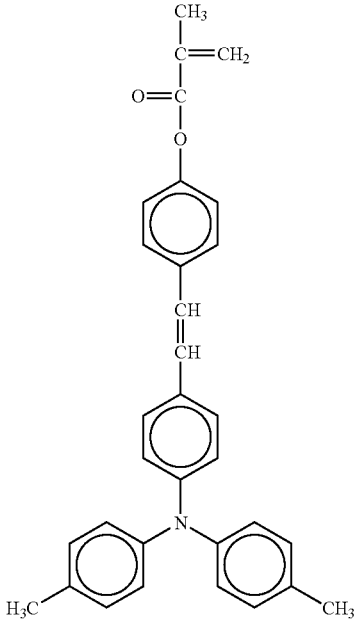
No. 111
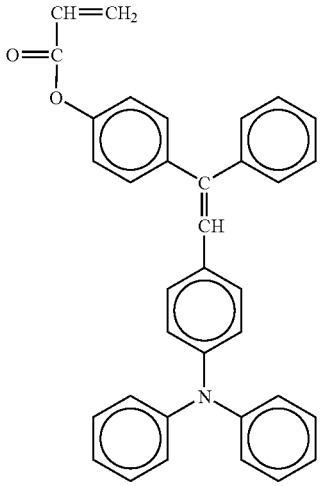
No. 112
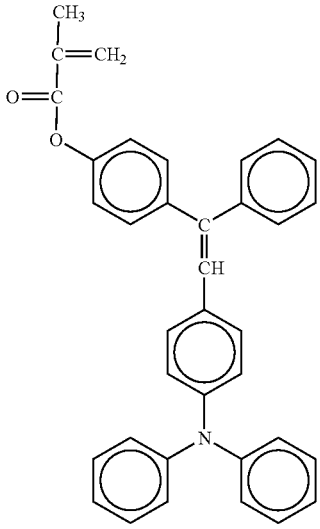

-continued
No. 113
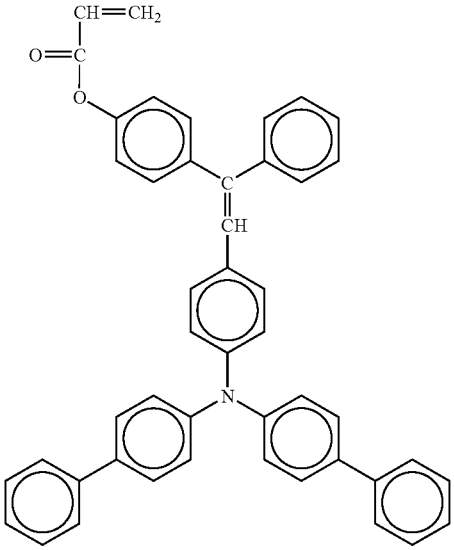
No. 114
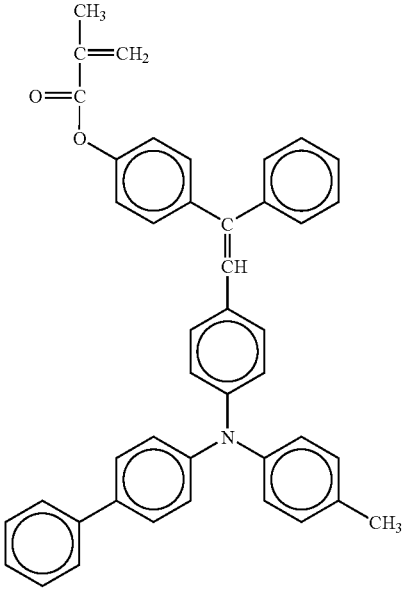
No. 115
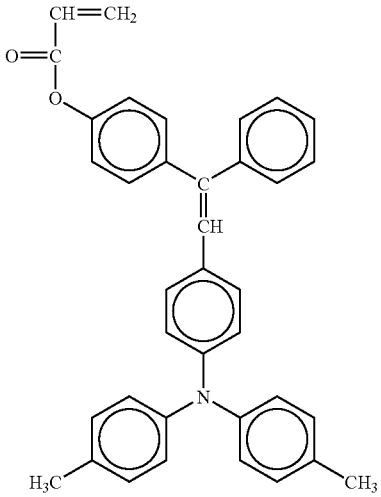
-continued
No. 116
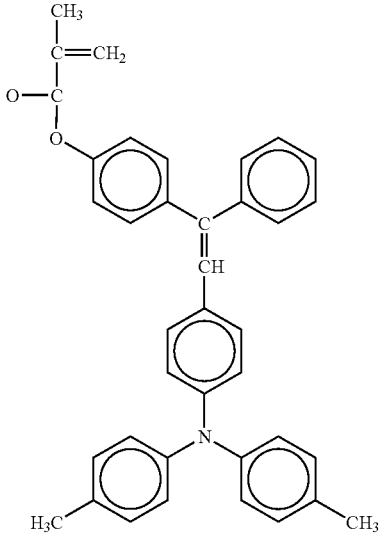
No. 117
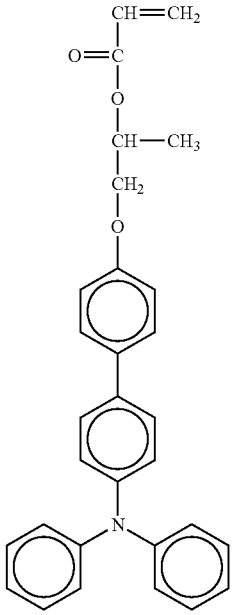

-continued
No. 118
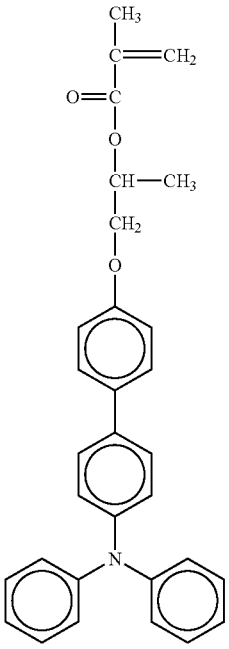
No. 119
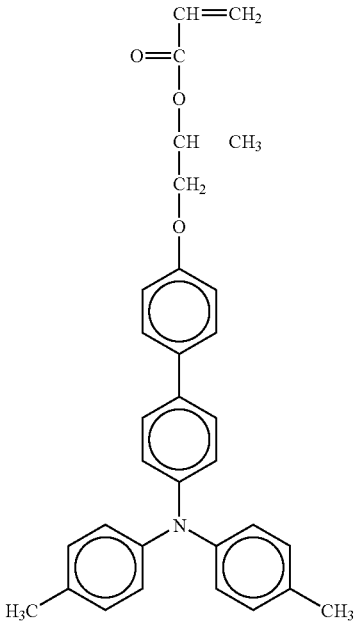
-continued
No. 120
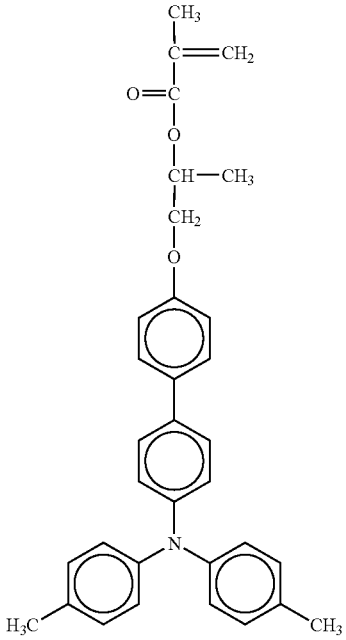
No. 121
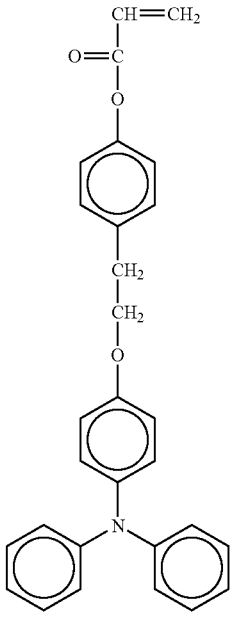

-continued
No. 122
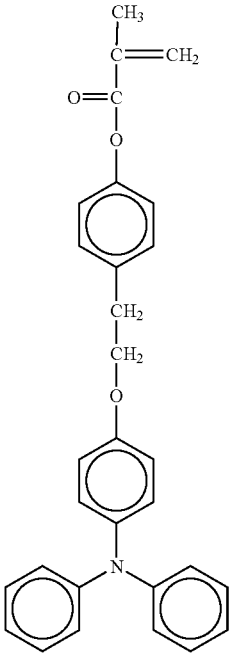
No. 123
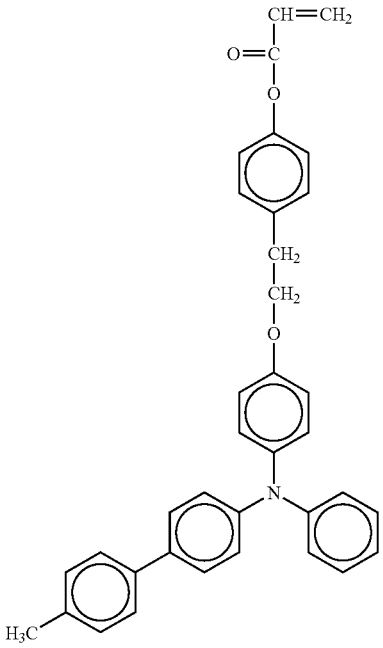
-continued
No. 124
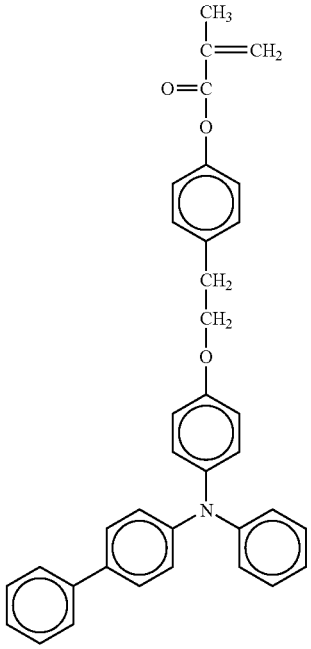
No. 125
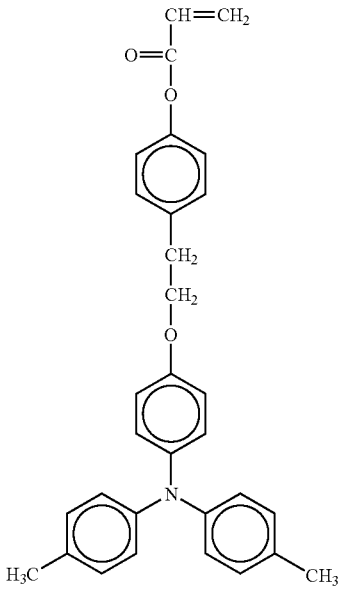

-continued
No. 126
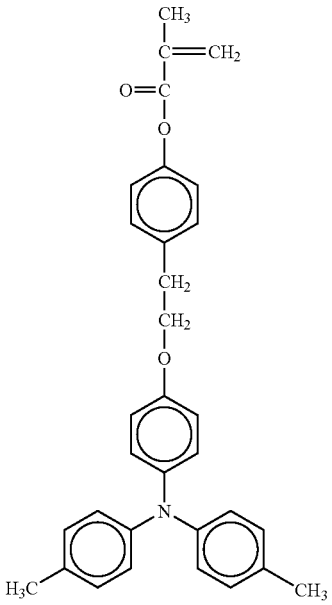
No. 127
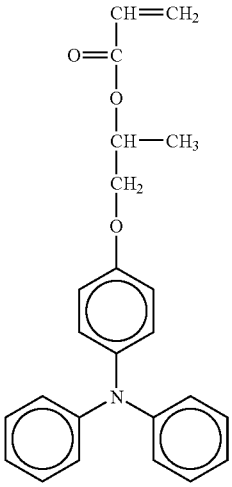
No. 128
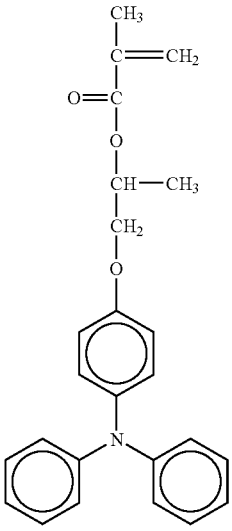
-continued
No. 129
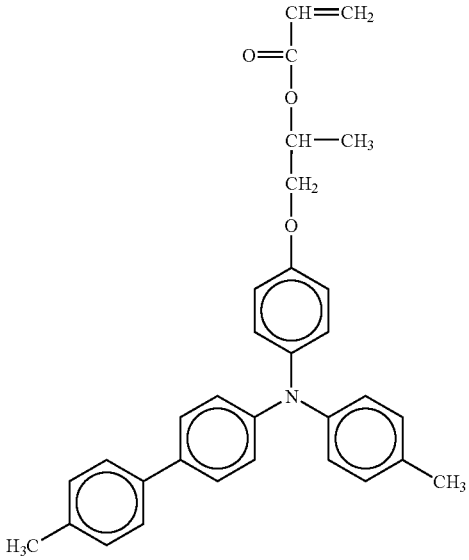
No. 130
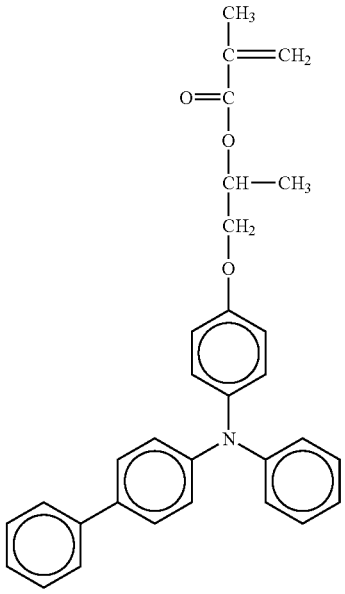

-continued
No. 131
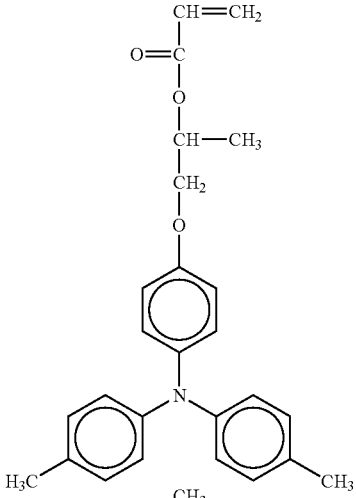
No. 132
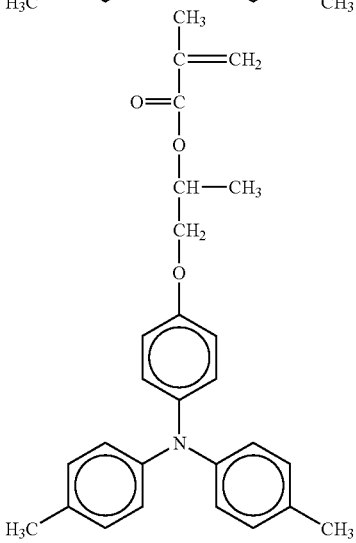
No. 133
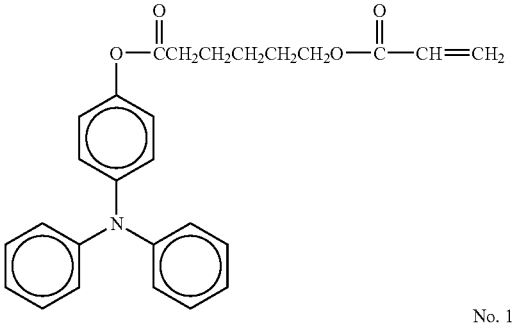
No. 134
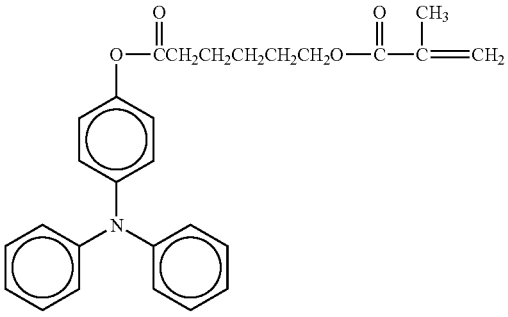
-continued
No. 135
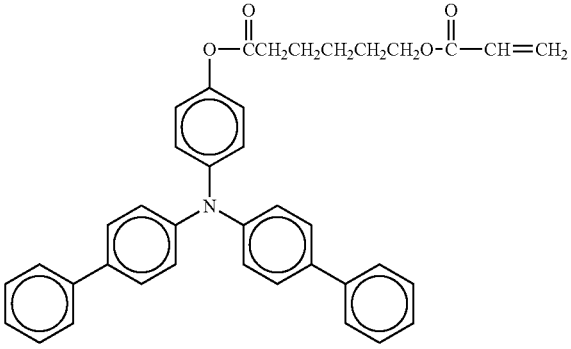
No. 136
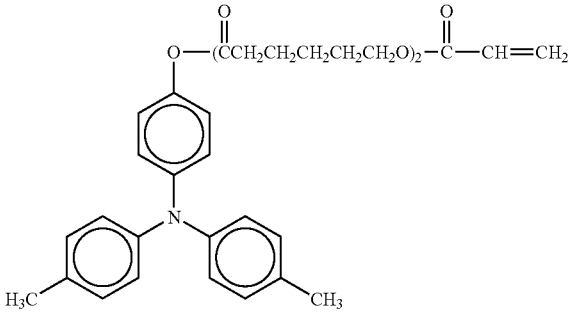
No. 137
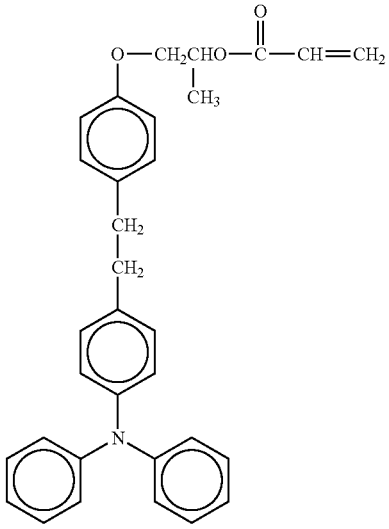

-continued
No. 138
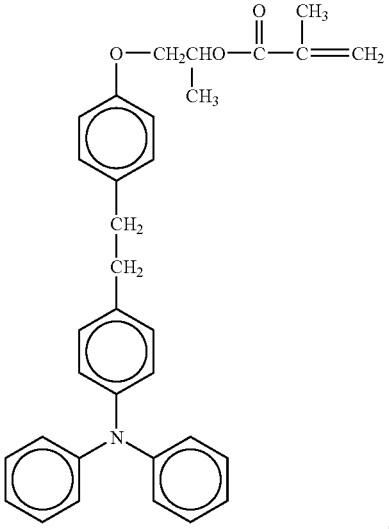
No. 139
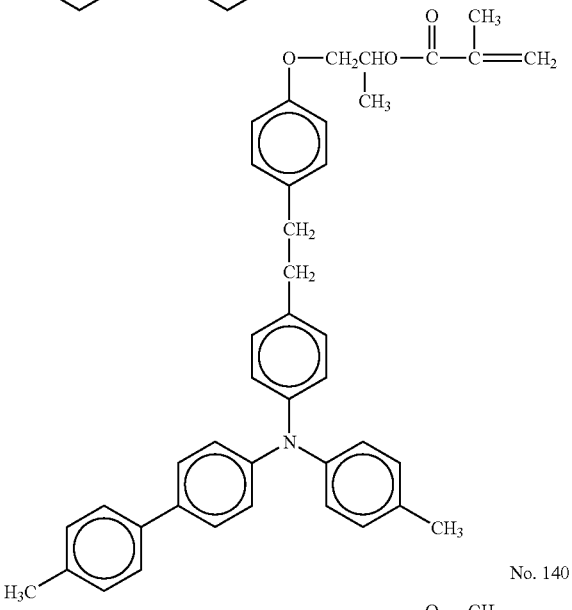
No. 140
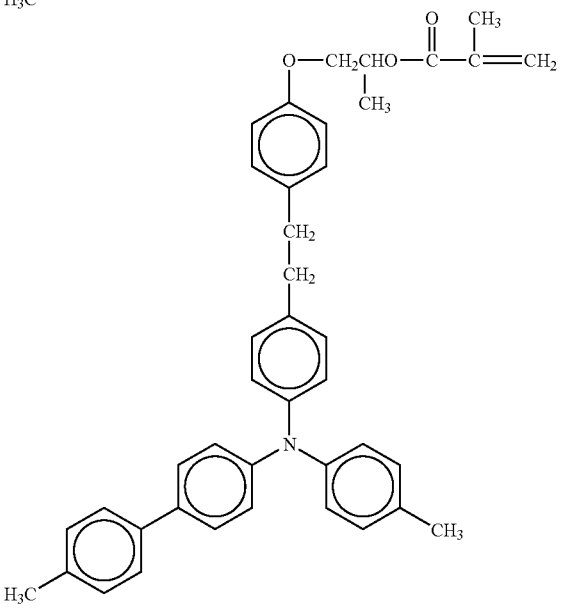
-continued
No. 141
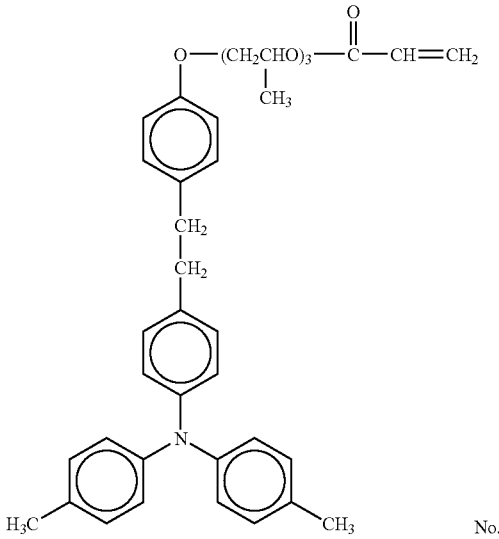
No. 142
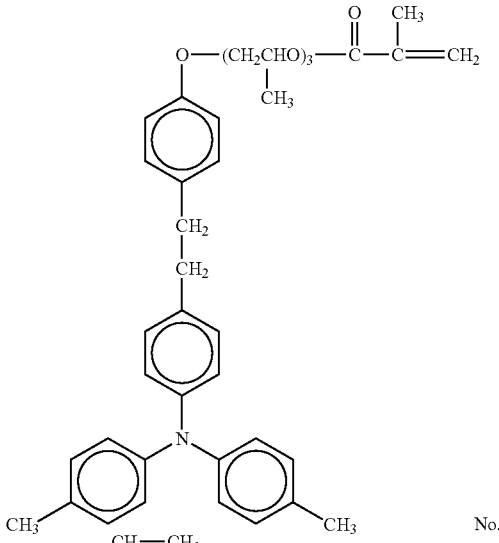
No. 143
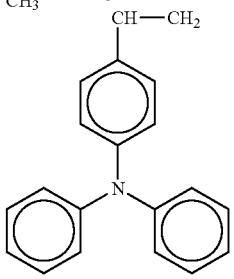
No. 144
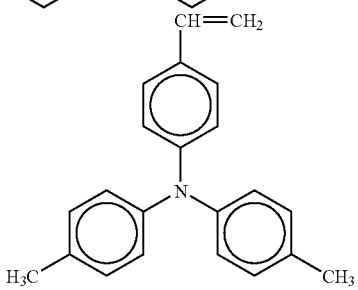

-continued
No. 145
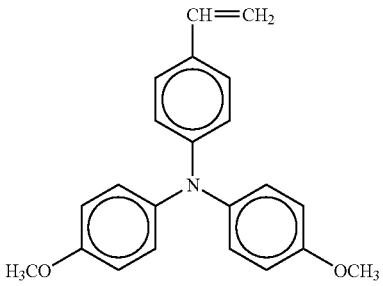
No. 146
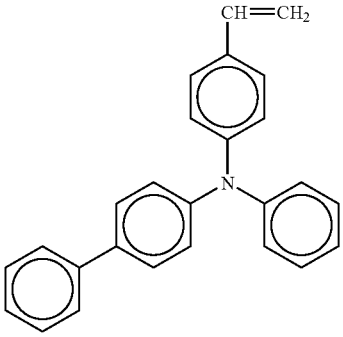
No. 147
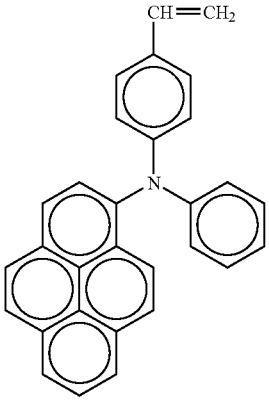
No. 148
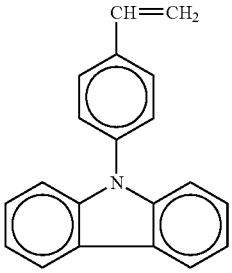
No. 149
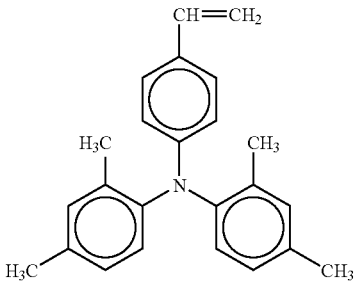
-continued
No. 150
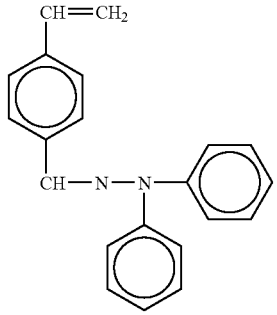
No. 151
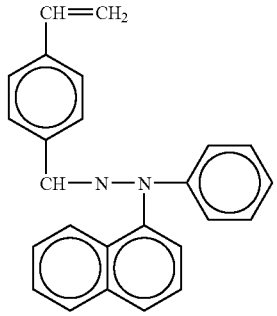
No. 152
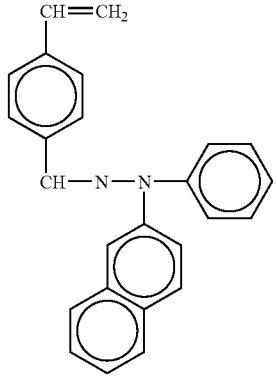
No. 153
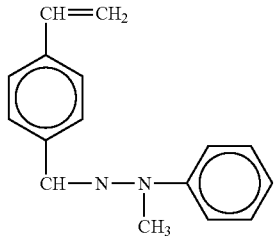
No. 154
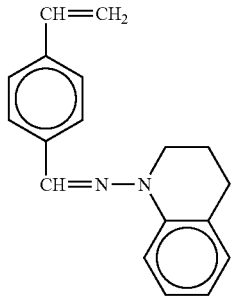

-continued

No. 155

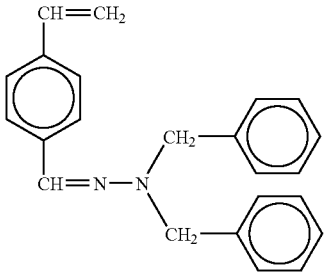

No. 156

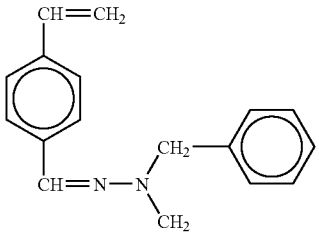

No. 157

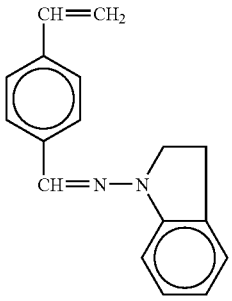

No. 158

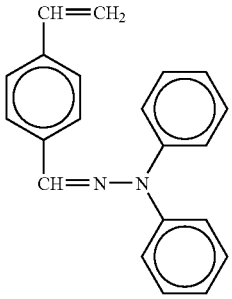

No. 159

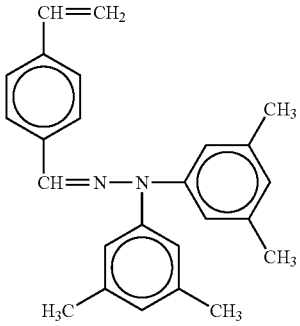

-continued

No. 160

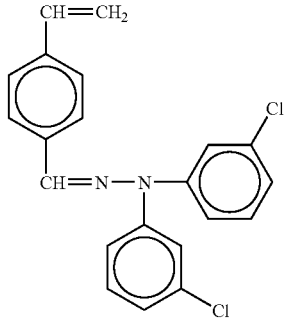

Further, the radical polymerizable compound having one functionality and a charge transporting structure used in the present invention is important, since it provides for the cross-linked protective layer having the charge transporting structure. This ingredient is 20% to 80% by mass, preferably 30% to 70% by mass, based on the total amount of the cross-linked protective layer having the charge transporting structure. If this ingredient is less than 20% by mass, the charge transporting ability of the cross-linked protective layer cannot be sufficiently maintained, thereby causing deterioration of electrical properties such as reduction of sensitivity, increase of residual potential and the like owing to repeated use. If it exceeds 80% by mass, the content of the monomer having three or more functionalities and no charge transporting structure is reduced, thereby the cross-linked density is reduced and high abrasion resistance cannot be attained. Though it is impossible to uniformly mention the added amount of this ingredient since the required electrical properties and abrasion resistance vary according to processes to be used, the amount is most preferably in the range of 30 to 70% by mass considering balance between two properties.

The cross-linked protective layer having the charge transporting layer adapted to the present invention is formed by curing at least a radical polymerizable monomer having three or more functionalities and no charge transporting structure and a radical polymerizable compound having one functionality and a charge transporting structure. However, in order to control viscosity during coating, to relieve stress of the cross-linked protective layer having the charge transporting structure, to lower the surface energy or to reduce friction coefficient, a mono-functional and bi-functional radical polymerizable monomer or radical polymerizable oligomer may be combinedly used. As the radical polymerizable monomer and the oligomer, known substances can be used.

Examples of the mono-functional radical monomer include 2-ethylhexyl acrylate, 2-hydroxyethyl acrylate, 2-hydroxypropyl acrylate, tetrahydrofurfuryl acrylate, 2-ethylhexylcarbitol acrylate, 3-methoxybutyl acrylate, benzyl acrylate, cyclohexyl acrylate, isoamyl acrylate, isobutyl acrylate, methoxytriethyleneglycol acrylate, phenoxytetraethyleneglycol acrylate, cetyl acrylate, isotearyl acrylate, stearyl acrylate, styrenemonomer and the like.

Examples of the bi-functional radical polymerizable monomer include 1,3-butanediol diacrylate, 1,4-butanediol diacrylate, 1,4-butanediol dimethacrylate, 1,6-hexanediol diacrylate, 1,6-hexanediol dimethacrylate, diethyleneglycol diacrylate, neopentylglycol diacrylate, EO-modified bisphenol A diacrylate, EO-modified bisphenol F diacrylate, neopentylglycoldiacrylate and the like.

Examples of the functional monomer include a fluorinated monomer such as octafluoropentylacrylate, 2-perfluorooctylethyl acrylate, 2-perfluorooctylethyl methacrylate, 2-perfluoroisononylethyl acrylate and the like, a vinyl monomer, acrylate and methacrylate having a polysiloxane group such as acryloylpolydimethylsiloxaneethyl, methacryloylpolydimethylsiloxaneethyl, acryloylpolydimethylsiloxanepropyl, acryloylpolydimethylsiloxanebutyl, diacryloylpolydimethylsiloxanediethyl and the like, which have 20 to 70 siloxane repeating units, as described in JP-B No. 5-60503, JP-B No. 6-45770.

The radical polymerizable oligomer includes, for example, epoxy acrylate, urethane acrylate and polyester acrylate oligomers. However, when a large amount of a mono- and bifunctional radical polymerizable monomer or radical polymerizable oligomer is added, the 3-dimensional cross-linkage density of the cross-linked protective layer having the charge transporting structure is substantially reduced, causing reduction of abrasion resistance. Therefore, the content of these monomers or oligomers is limited 50 parts by mass or less, preferably 30 parts by mass or less, relative to 100 parts by mass of the radical polymerizable monomer having three ore more functionalities.

Further, the cross-linked protective layer having the charge transporting structure according to the present invention is formed by curing at least a radical polymerizable monomer having three ore more functionalities and no charge transporting structure and a radical polymerizable compound having one functionality and a charge transporting structure but may further comprise a polymerization initiator in the cross-linked protective layer having the charge transporting structure, as needed, to effectively perform the cross-linking reaction.

Examples of the thermal polymerization initiator include a peroxide type initiators such as 2,5-dimethylhexane-2,5-dihydroperoxide, diqumyl peroxide, benzoylperoxide, t-butylqumyl peroxide, 2,5-dimethyl-2,5-di (peroxybenzoyl)hexene-3, di-t-butylperoxide, t-butylhydroperoxide, qumene hydroperoxide, lauroyl peroxide and the like, and an azo type initiator such as azobisisobutylnitrile, azobiscyclohexanecarbonitrile, methyl azobisisobutyrate, azobisisobutylamidine hydrochloride, 4,4'-azobis-4-cyanovaleroic acid and the like.

Examples of the photopolymerization initiator include an acetophenone type initiator such as diethoxyacetophenone, 2,2-dimethoxy-1,2-diphenylethan-1-one, 1-hydroxy-cyclohexyl-phenyl-ketone, 4-(2-hydroxyethoxy)phenyl-(2-hydroxy-2-propyl)ketone, 2-benzyl-2-dimethylamino-1-(4-morpholinophenyl)butanone-1,2-hydroxy-2-methyl-1-phenylpropane-1-one, 2-methyl-2-morpholino(4-methylthiophenyl)propane-1-one, 1-phenyl-1,2-propanedione-2-(o-ethoxycarbonyl)oxime and the like or a ketal type photopolymerization initiator, a benzoinether type photopolymerization initiator such as benzoin, benzoinmethyl ether, benzoinethylether, benzoinisobutylether, benzoinisopropyl ether and the like, a benzophenone type photopolymerization initiator such as benzophenone, 4-hydroxybenzophenone, methyl o-benzoylbenzoate, 2-benzoylnaphthalene, 4-benzoylbiphenyl, 4-benzoylphenylether, acrylated benzophenone, 1,4-benzoylbenzene and the like, a thioxanthone type photopolymerization initiator such as 2-isopropylthioxanthone, 2-chlorothioxanthone, 2,4-dimethylthioxanthone, 2,4-diethylthioxanthone, 2,4-dichlorothioxanthone and the like, and other examples of the photopolymerization initiator include such as ethylanthraquinone, 2,4,6-trimethylbenzoyldiphenylphosphine oxide, 2,4,6-trimethylbenzoylphenylethoxyphosphine oxide, bis(2,4,6-trimethylbenzoyl)phenylphosphine oxide, bis(2,4-dimethoxybenzoyl)-2,4,4-trimethylpentylphosphine oxide, methylphenylglyoxyester, 9,10-phenanthrene compounds, acridine compounds, triazine compounds, imidazole compounds and the like. Also, it is possible to use a compound capable of promoting photopolymerization alone or in combination with the photopolymerization initiator, which, for example, includes triethanolamine, methyldiethanolamine, ethyl 4-dimethylaminobenzoate, isoamyl 4-dimethylaminobenzoate, (2-dimethylamino)ethylbenzoate, 4,4'-dimethylaminobenzophenone and the like.

The foregoing polymerization initiators may be used alone or as a mixture of two or more thereof. The content of the polymerization initiator is 0.5 to 40 parts by mass, preferably 1 to 20 parts by mass relative to 100 parts by mass of the total amount of the radical polymerizable component.

Further, the coating liquid for the cross-linked protective layer having the charge transporting structure according to the present invention may contain various additives such as a plasticizer for the purpose of relieving stress and improving adhesion, a leveling agent, a low molecular charge transporting material non-reactive with radical and the like, as needed. These additives may be any of those known to the art. The plasticizer which can be used in the present invention includes those commonly used in a resin, such as dibutylphthalate, dioctylphthalate and the like, and its added amount is limited to 20% by mass or less, preferably 10% by mass or less, relative to the total solid content of the coating liquid. Also, the leveling agent which can be used in the present invention include silicone oils such as dimethyl silicone oil, methylphenyl silicone oil and the like, or polymers or oligomers having a perfluoroalkyl group in a side chain and its added amount is suitably 3% by mass or less, relative to the total solid content of the coating liquid.

The cross-linked protective layer having the charge transporting structure according to the present invention is formed by applying a coating liquid comprising at least a radical polymerizable monomer having three or more functionalities and no charge transporting structure and a radical polymerizable compound having one functionality and a charge transporting structure, followed by curing. When the radical polymerizable monomer is a liquid, the coating liquid may be applied with another ingredient dissolved therein. Also, it may be diluted in a solvent before application, as needed. Here, examples of the usable solvent include alcohols such as methanol, ethanol, propanol, butanol and the like, ketones such as acetone, methylethylketone, methyl isobutylketone, cyclohexanone and the like, esters such as ethyl acetate, butyl acetate and the like, ethers such as tetrahydrofuran, dioxane, propylether and the like, halogenated compounds such as dichloromethane, dichloroethane, tolly chloroethane, chlorobenzene and the like, aromatics such as benzene, toluene, xylene and the like, and cellosolves such as methylcellosolve, ethylcellosolve, cellosolve acetate and the like. These solvents may be used alone or as a mixture of two or more thereof. The dilution in the solvent varies according to solubility of the composition, coating process and desired membrane thickness and is not particularly limited. The coating is performed by dipping coating, spray coating, bead coating, ring coating and the like.

According to the present invention, after the coating liquid is applied, curing is carried out by applying an external energy to form a cross-linked protective layer having the charge transporting structure. Here, examples of the external energy which can be used include heat, light and radiation. The process for applying heat energy is carried out by heating from the coating surface side or substrate side using air, gas of for example nitrogen, vapor, or various heating media, far infrared rays, electronic wave. The heating temperature is preferably between 100° C. and 170° C. When it is less than 100° C., reaction rate is slow and not completely finished. When it is higher than 170° C., the reaction progresses non-uniformly, causing a large distortion in the cross-linked protective layer having the charge transporting structure. In order to uniformly progress the curing, it is an effective way to complete the reaction by heating at a relatively low temperature of less than 100° C. and further heating at 100° C. or higher. The light energy which can be used includes UV irradiating source such as a high pressure mercury lamp and metal halide lamp having a light emitting wavelenth mainly in the UV region. Also, it is possible to select a visible light source in accordance with the absorption wave length of the radical polymerizable components or photopolymerization initiators. The irradiation amount is preferably from 50 $mW/cm^2$ to, 1000 $mW/cm^2$. If it is less than 50 $mW/cm^2$, the curing takes much time. If it is stronger than 1000 $mW/cm^2$, the reaction nonuniformly progresses, thereby the roughness of the cross-linked protective layer having the charge transporting structure becomes severe. The irradiation energy includes those using electronic rays. Among the foregoing energies, owing to easiness of controlling the reaction rate and convenience of the apparatus, heat and light energy may be effectively used.

The thickness of the cross-linked protective layer having the charge transporting structure is 1 μm or more and 10 μm or less, preferably is 2 μm or more and 8 μm or less. When the thickness is more than 10 μm, cracks and peelings are likely to occur; when the thickness is less than 8 μm, the cross-linking density may be more increased due to the allowable margin, and the selection of materials to enhance the wear resistance and design to harden the resins etc. may come be possible. On the other hand, the radical polymerization reaction is susceptible to oxygen obstruction, i.e. the cross-linking does not progress or tends to become non-uniform due to radical trap at the surface exposed to atmosphere. The phenomena is significant when the layer thickness is less than 1 μm. The thinner layer thickness of the cross-linked protective layer having the charge transporting structure possibly leads to decrease in wear resistance and non-uniform abrasion. Further, in the coating step of the cross-linked protective layer having the charge transporting structure, the components of underlying charge transporting layer tend to include into the cross-linked protective layer, in particular, the inclusion extends over the entire cross-linked protective layer if the layer is thinner, and resulting in the affection of curing reaction and the decrease of cross-linking density. For these reasons, when the layer thickness is 1 μm, the cross-linked protective layer having the charge transporting structure exhibits proper wear resistance and flaw resistance. However, should the cross-linked protective layer is shaved locally to the underlying charge transporting layer during the repeated usages, the abrasion at the shaved regions come to be enlarged, the density non-uniformity of intermediate images is often induced due to the fluctuation of charging ability and sensitivity. Accordingly, the layer thickness of the cross-linked protective layer is preferably 2 μm or more for assuring the prolonged life and the higher image quality.

In the construction of the charge generating layer, charge transporting layer, cross-linked protective layer having the charge transporting structure laminated in this order, the wear resistance and the flaw resistance are remarkably high when the upper most layer of the cross-linked protective layer is insoluble against organic solvents. The solubility against organic solvents may be evaluated by dropping a droplet of organic solvent such as tetrahydrofuran, dichloromethane, which have generally high solubility against polymer materials, on the surface of the photoconductor, and observing the surface after air drying by means of a stereoscopic microscope. When the photoconductor has higher solubility, such phenomena may be observed as the central portion of the droplet turns into concave and the periphery raise, the whiting or fogging appears due to deposition or crystallization of the charge transporting material, and wrinkles appear due to swelling and then shrinking. On the contrary, such phenomena do not appear and the appearance is the same with before dropping in the insoluble photoconductor.

In order to make the cross-linked protective layer having the charge transporting structure against organic solvents, such factors are important and are to be controlled, (i) composition of coating liquid for cross-linked protective layer and the content of the respective components, (ii) solvent for diluting the coating liquid for cross-linked protective layer and the solid content, (iii) the way to coat the coating liquid for cross-linked protective layer, (iv) curing conditions of the cross-linked protective layer, (v) insolubilization of the underlying charge transporting layer. By the way, the insolubilization may not be attained by one of these factors.

As for the constituent material of coating liquid for the cross-linked protective layer having the charge transporting material, when additives such as binder resin, anti-oxidant, plasticizer etc. that does not have a radical polymerizable functional group are included in a large amount other than the radical polymerizable monomer having three or more functionalities and no charge transporting structure and the radical polymerizable compound having one functionality and the charge transporting structure, the cross-linked protective layer is possibly lower in the cross-linking density, tends to cause the phase separation between the reaction-cured products and the additives, and is likely to be soluble against organic solvents. Accordingly, it is important to suppress the solid content of the additives to 20% by mass or less based on the total solid content of the coating liquid specifically. Further, in order to prevent the dilution of the cross-linking density, preferably, the total amount of the mono- or di-functional radical polymerizable monomer, reactive oligomer, and reactive polymer is 20% by mass or less based on the radical polymerizable monomer having three or more functionalities. Further, when radical polymerizable compound having two or more functionalities and the charge transporting structure is incorporated in a large amount, the resulting layer tends to cause a distortion since a bulky structure is fixed in the cross-linking structure at plural bonds, tends to be a flocculent of fine cured products, and thereby the layer may be soluble against organic solvents. The content of radical polymerizable compound having two or more functionalities and charge transporting structure is preferably 10% by mass or less based on the radical polymerizable compound having one functionality and charge transporting structure, although the content depends on the structure of compound.

As for the solvent for diluting the coating liquid for the cross-linked protective layer having the charge transporting structure, when a solvent is employed of which the evaporating velocity is relatively slow, the remaining solvent may hinder the curing or increase the incorporated amount of the underlying components, consequently may lead to uneven curing or decrease of the cured density, and to soluble against organic solvents. Specifically, tetrahydrofuran, mixture of tetrahydrofuran and methanol, ethyl acetate, methyl ethyl ketone, ethyl cellosolve, and the like are available, and is selected corresponding to the coating step. As for the solid content, when it is too low, the layer tends to be soluble against organic solvents, whereas the upper limit is defined by film thickness, viscosity of the coating liquid, and the like.

Specifically, the solid content is preferably 10 to 50% by mass. As for the coating way to prepare the cross-linked protective layer, such way is desirable that the content of solvent is lower and the period to contact with the solvent is shorter. Specifically, spray coating method and ring coating method with limited coating amount are preferable. In order to prevent the inclusion of underlying, such way may be effective as employment of polymer charge transporting material as the charge transporting layer, and provision of an intermediate layer insoluble against the solvent of the coating liquid for the cross-linked protective layer.

As for the curing conditions of the cross-linked protective layer having the charge transporting structure, insufficient energy of heating or irradiation results in incomplete curing to increase the solubility against organic solvents; whereas excessively large energy leads to uneven curing reaction, increase of un-crosslinked portions and radical stoppages, and flocculent of fine cured products, resulting in solubility against organic solvents. In order to make the layer insoluble against the organic solvents, 100 to 170° C. and 10 minutes to 3 hours are preferable in thermal heating conditions; 50 to 1000 mW/cm$^2$, 5 seconds to 5 minutes, and temperature raise of 50° C. or less to suppress the uneven curing reaction are preferable in curing by UV-ray irradiation.

The method to make the cross-linked protective layer having according to the present invention insoluble against organic solvent will be exemplified. When an acrylate monomer having three acryloyloxy groups and a triaryl amine compound having one acryloyloxy group are utilized, the ratio of the used amount is 7:3 to 3:7. An polymerization initiator is added 3 to 20% by mass based on the total amount of the acrylate compound, and a solvent is added to prepare a coating liquid. For example, when, as for the underlying charge transporting layer, doner of triaryl amine is utilized as the charge transporting material and polycarbonate is utilized as the binder resin, and the surface layer is coated through spraying method, the solvent of the coating liquid is preferably tetrahydrofuran, 2-butanone, or ethyl acetate, and the amount is 3 to 10 times the entire acrylate compound.

Then, an undercoat layer, charge generating layer, and charge transporting layer are coated on the support of alumina cylinder, then the coating liquid of the cross-linked protective layer is coated by spraying method etc. on the charge transporting layer. Then, the coating is subjected to air drying or drying at lower temperature for shorter period, e.g. 25 to 80° C. for 1 to 10 minutes, thereafter is hardened by UV curing or heating.

In ultraviolet irradiation, a metal halide lamp may be used at an illuminance of preferably 50 mW/cm$^2$ to 1000 mW/cm$^2$. For example, when ultraviolet rays at 200 mW/cm$^2$ are applied, the rays are applied from different directions uniformly for about 30 seconds.

The temperature of the photoconductor should be controlled so as not to exceed 50° C.

When the composition is cured by heating, the heating temperature is preferably from 100° C. to 170° C. When a blast oven is used as a heater and the heating temperature is set at 150° C., the heating time is from about 20 minutes to about 3 hours.

After the completion of curing, the article is heated at 100° C. to 150° C. for 10 to 30 minutes to reduce residual solvent. Thus, a photoconductor of the present invention is prepared.

An image forming apparatus adapted to utilize the photoconductor according to the present invention will be explained in detail in the following.

Figure 13:
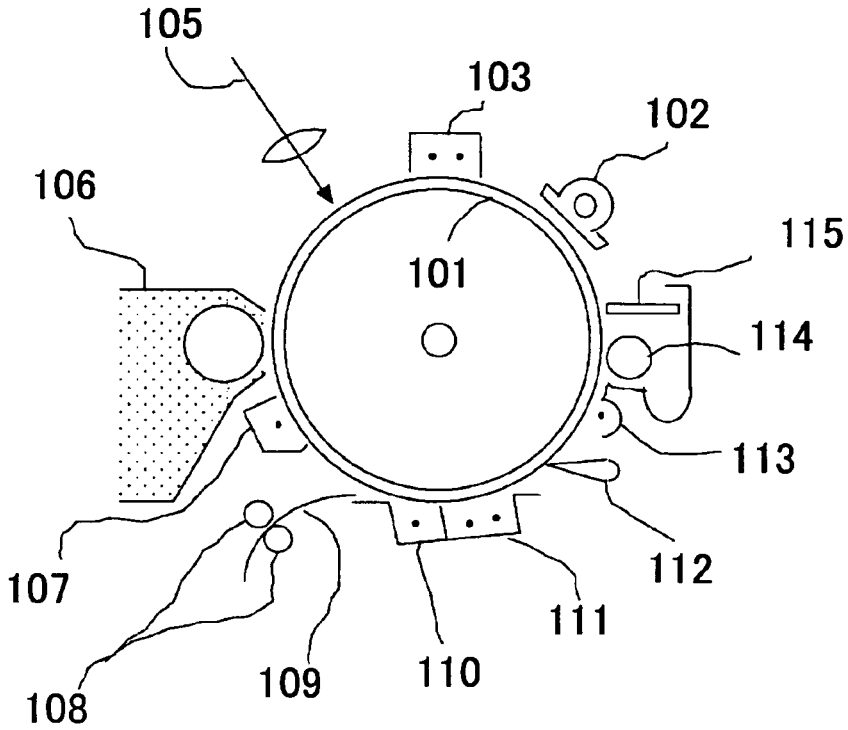
FIG. 13 is a schematic diagram for the purpose of describing an electrophotographic process and an image-forming apparatus according to the present invention.

The image forming apparatus according to the present invention comprises a photoconductor; a charging unit configured to charge the photoconductor; an exposing unit configured to expose the charged photoconductor by the charging unit with a recording light to form a latent electrostatic image on the photoconductor; a developing unit configured to supply a developer to the latent electrostatic image to form a visible toner image on the photoconductor; and a transferring unit configured to transfer the toner image onto a transfer material, wherein the photoconductor comprises a support, an intermediate layer and a photoconductive layer in this order, the intermediate layer is formed using a coating liquid which comprises at least one of alcohol solvents and N-methoxymethylated nylon, and the N-methoxymethylated nylon has solution viscosity within a range from 43 mPa·s to 50 mPa·s when dissolving into methanol at 30° C. in a concentration of 20% by mass. FIG. 13 is a schematic diagram for the purpose of describing an electrophotographic process and an image forming apparatus according to the present invention.

In FIG. 13, a photoconductor 101 comprises an intermediate layer and a photoconductive layer containing a charge generating layer and a charge transporting layer. The intermediate layer is formed using a coating liquid containing N-methoxymethylated nylon which has solution viscosity within a range from 43 mPa·s to 50 mPa·s according to the above-mentioned methanol viscosity measuring method. The photoconductor 101 is drum-shape, and may be sheet-shaped or endless belt shaped. Any known chargers such as a corotron, a scorotron, a solid state charger, a charging roller and a transferring roller can be used for a charging roller 113 served as a charging unit, a pre-transferring charger 107, a transferring charger 110, a separation charger 111 and a pre-cleaning charger 113.

As the charging system, a contact charging system or non-contact charging system is preferred. The contact charging system has high charge efficiency with less ozone formation and can achieve a downsized apparatus.

As for light sources such as an exposing unit 105 and a charge-eliminating lamp 102, light emitters such as a fluorescent lamp, tungsten lamp, halogen lamp, mercury lamp, sodium lamp, light emitting diode (LED), semiconductor laser (LD), and electro luminescence may be employed.

For providing light only at the desired spectral region, filters such as a sharply cutting filter, bandpass filter, near-infrared cutting filter, dichroicfilter, interference filter, and conversion filter for color temperature may be employed.

Among these light sources, LED and LD are appropriately utilized since the irradiating energy is higher, and these irradiate longer wavelength of 600 to 800 nm to which the titanyl phthalocyanine is highly sensitive.

The light source irradiates the photoconductor with light for providing a transfer step, charge-eliminating step cleaning step or pre-exposure and other steps in conjunction with light irradiation, in addition to the steps shown in FIG. 13.

The toner developed on the photoconductor 101 by a developing unit 106 is transferred to the transfer paper 109, but not all of it is transferred, and some toner remains on the photoconductor 101. This toner is removed from the photoconductor by a fur brush 114 and blade 115. Cleaning may also be performed only by the cleaning brush, the cleaning brush being any of those known in the art including a fur brush and magnetic fur brush. In FIG. 13, the numeral 103 denotes an charger, the numeral 108 denotes a resist roller and the numeral 112 denotes a separating tongue.

When a positive charge is applied to the photoconductor and image exposure is performed, a positive latent electrostatic image will be formed on the photoconductor surface. If the latent image is developed with a toner (charge detecting particles) of negative polarity, a positive image will be obtained, and a negative image will be obtained if the latent image is developed with a toner of positive polarity. On the other hand, when a negative charge is applied to the photoconductor and image exposure is performed, a negative latent electrostatic image will be formed on the photoconductor surface. If the latent image is developed with a toner (charge detecting particles) of positive polarity, a positive image will be obtained, and a negative image will be obtained if the latent image is developed with a toner of negative polarity. Methods known in the art are applied for the developing unit and, methods known in the art are also used for the charge-eliminating unit.

Next, an image forming apparatus according to another embodiment of the present invention will be described below.

The image forming apparatus according to another embodiment comprises a plurality of image forming units. The plurality of image forming units each comprise at least a photoconductor, a charging unit, an exposing unit, a developing unit, and a cleaning unit, which are arranged around the photoconductor. The photoconductor comprises a support, an intermediate layer and a photoconductive layer in this order, the intermediate layer is formed using a coating liquid containing N-methoxymethylated nylon which has solution viscosity within a range from 43 mPa·s to 50 mPa·s according to the above-mentioned methanol viscosity measuring method. In the case of a color image forming apparatus using multicolor toners, a plurality of the image forming units are mounted in the apparatus according to the number of the colors. Each image forming unit may be fixed to the image forming apparatus or may be independently replaceable.

Figure 14:
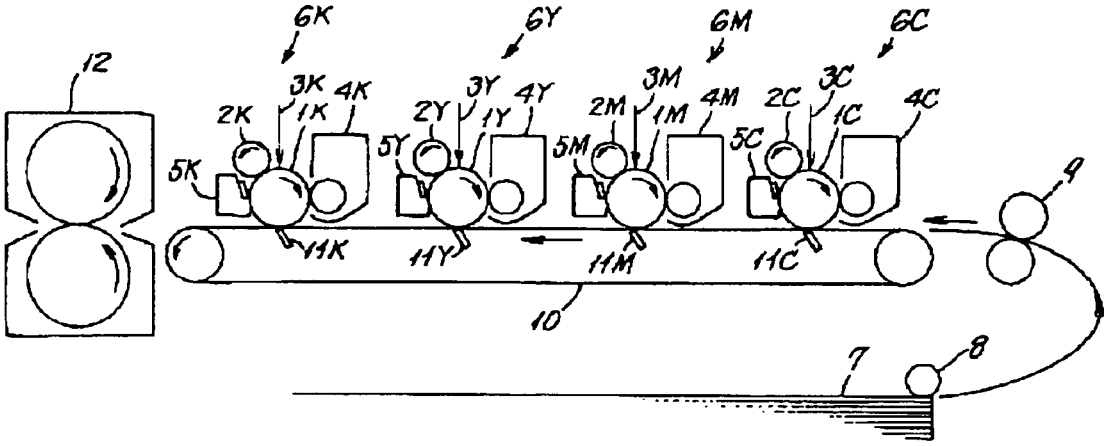
FIG. 14 is a schematic diagram showing an image-forming apparatus of tandem type according to the present invention.

FIG. 14 is a schematic diagram showing the image forming apparatus comprising a plurality of the image forming units, which is generally called a full-color electrophotographic apparatus of tandem type, and the modifications described hereinafter are included in the present invention.

In FIG. 14, the symbols 1C, 1M, 1Y, and 1K designate drum-shaped photoconductors. The photoconductors 1C, 1M, 1Y, 1K rotates in the direction indicated by the arrow in FIG. 14, and charging members 2C, 2M, 2Y, 2K served as charging units, developing units 4C, 4M, 4Y, 4K, and cleaning members 5C, 5M, 5Y, 5K served as cleaning units are disposed. The charging members 2C, 2M, 2Y, 2K are arranged to charge uniformly the photoconductor surfaces.

From the back side of the photoconductor between the charging members 2C, 2M, 2Y, 2K and developing member 4C, 4M, 4Y, 4K, laser light 3C, 3M, 3Y, 3K is irradiated from exposing units (not shown), thereby latent electrostatic images are formed on photoconductors 1C, 1M, 1Y, 1K. The four image forming units 6C, 6M, 6Y, 6K, of which the center are photoconductors 1C, 1M, 1Y, 1K respectively, are arranged in parallel along transfer conveying belt 10. The transfer conveying belt 10 contacts with photoconductors 1C, 1M, 1Y, 1K between the developing members 4C, 4M, 4Y, 4K and the cleaning members 5C, 5M, 5Y, 5K of the respective image forming units 6C, 6M, 6Y, 6K, and transferring brushes 11C, 11M, 11Y, 11K are arranged at the rear side or rear face of the photoconductor side of the transfer conveying belt 10 in order to apply transferring bias. The constitutions of 6C, 6M, 6Y, 6K are substantially the same except that the colors in the developing apparatuses are different each other.

In the constitution of the color electrophotographic apparatus shown in FIG. 14, the image forming is achieved as follows. At first, photoconductors 6C, 6M, 6Y, 6K are charged by charging members 1C, 1M, 1Y, 1K rotating as the arrow direction, i.e. co-rotating direction with the photoconductor in the respective image forming elements 6C, 6M, 6Y, 6K, then the latent electrostatic images of the respective colors are produced through laser lights 3C, 3M, 3Y, 3K irradiated from the light-exposing part (not shown).

Then, toner images are formed through developing the latent images by developing units 4C, 4M, 5Y, 4K. The developing units 5C, 4M, 4Y, 4K respectively conduct developing by the toner of C (cyan), M (magenta), Y (yellow), K (black), and the toner images of the respective colors formed on the four photoconductors 1C, 1M, 1Y, 1K are overlapped on the transferring paper.

The transferring paper 7 is sent from the tray by means of feeding paper roller 8, is stopped at a moment by means of a pair of resist roller 9, then is sent to transfer conveying belt 10 while adjusting a timing with the image forming on the photoconductor. The transferring paper 7 sustained on transfer conveying belt 10 is conveyed, and the transfer with the respective color images is carried out at the contacting site or transferring part with the respective photoconductor 1C, 1M, 1Y, 1K.

The toner images on the photoconductors are transferred on transferring paper 7 by the electric field formed by the potential difference between the transferring bias applied on transferring brush 11C, 11M, 11Y, 11K and photoconductor 1C, 1M, 1Y, 1K. Then, recording paper 57 having toner images of four colors overlapped at the four transferring portions is conveyed to fixing apparatus 12, where the toner is fixed, then the recording paper 7 is conveyed out to the discharged paper portion (not shown). The residual toner on the respective photoconductors 1C, 1M, 1Y, 1K, having not been transferred at the transferring portions, is recovered by the cleaning devices 5C, 5M, 5Y, 5K. As for the image forming elements shown in FIG. 14, the color is arranged C (cyan), M (magenta), Y (yellow), K (black) in order from upstream to downstream of the conveying direction of the recording paper. The order is not necessarily defined as such and may be arranged optionally.

In addition, when the prints with only black color are required, the mechanism that the image forming element other than black (6C, 6M, 6Y) being stopped may be effectively arranged in the present invention. Further, in FIG. 14, the charging member contact mechanism with the photoconductor as shown in FIG. 14 and a suitable gap (approximately 10 μm to 200 μm) is provided, therefore, the abrasion wear may be reduced for both of the members, and the toner filming on the charging member may also be reduced successfully.

The image forming unit explained above may be fixed into such apparatuses as a copier, facsimile machine, and printer, alternatively, may be detachably mounted thereto in a form of a process cartridge.

Further, the process cartridge does not mean the image formation unit used for the full-color image forming apparatus as described above, but is a detachably construction to the mono-color image forming apparatus. The present invention also includes the process cartridge, which comprises a photoconductor, and at least one unit selected from the group consisting of a charging unit, an exposing unit, a developing unit, a transferring unit, a cleaning unit, and a charge-eliminating unit, wherein the photoconductor comprises a support, and an intermediate layer and a photosensitive layer, the intermediate layer is formed using a coating liquid containing N-methoxymethylated nylon which has solution viscosity within a range from 43 mPa·s to 50 mPa·s according to the above-mentioned methanol viscosity measuring method. Furthermore, among the above units, the units incorporated in the process cartridge are incorporated in the image forming apparatus.

More specifically, the process cartridge according to the present invention, comprises: a photoconductor, and at least one unit selected from the group consisting of a charging unit configured to charge the photoconductor, an exposing unit configured to expose the charged photoconductor by the charging unit with a recording light to form a latent electrostatic image on the photoconductor, a developing unit configured to supply a developer to the latent electrostatic image to form a visible toner image on the photoconductor, a transferring unit configured to transfer the toner image onto a transfer material, a cleaning unit configured to clean the toner remaining on the photoconductor after the transferring, and a charge-eliminating unit configured to eliminate the latent electrostatic image on the photoconductor after the transferring, which is mounted detachably to a main body of an image forming apparatus, the photoconductor comprises a support, and an intermediate layer and a photosensitive layer in this order, the intermediate layer is formed using a coating liquid which comprises at least one of alcohol solvents and N-methoxymethylated nylon, and the N-methoxymethylated nylon has solution viscosity within a range from 43 mPa·s to 50 mPa·s when dissolving into methanol at 30° C. in a concentration of 20% by mass.

Figure 15:
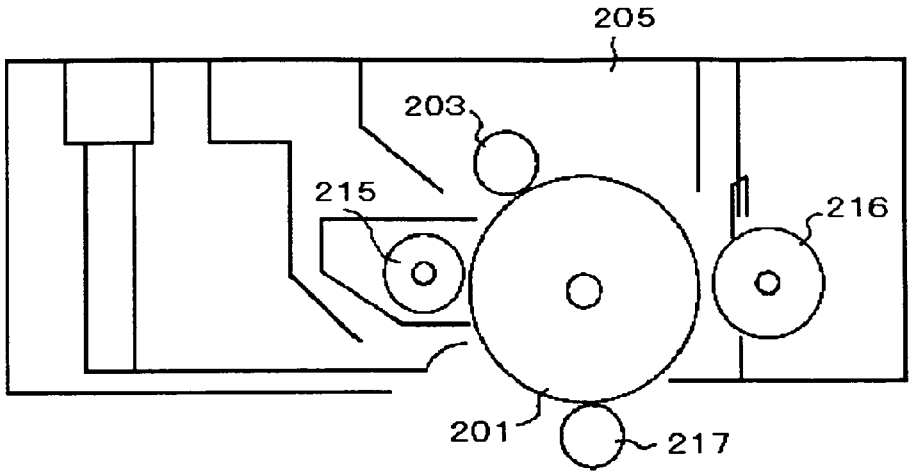
FIG. 15 is a diagram showing an example of a process cartridge according to the present invention.

Although the shape of the process cartridge is various, a common process cartridge is shown in FIG. 15. In FIG. 15, the numerals 201, 203, 205, 215, 216, and 217 denote a photoconductor, a charging roller, an image exposing unit, a cleaning brush, a developing roller, and a transferring roller, respectively.

EXAMPLES

The present invention will be illustrated in further detail with reference to several examples in the following, which are not intended to limited the scope of the present invention.

Wherever "parts" are mentioned in the following examples, they are based on mass.

Synthesis Example 1 of N-methoxymethylated Nylon 100 parts of 6-nylon on the market, 75 parts of formaldehyde, 160 parts of methanol and 2 parts of phosphoric acid were mixed and agitated, and the temperature was increased to 125° C. by taking 1 hour. After maintaining at 125° C. for 30 minutes, the mixture was cooled down to room temperature by taking 45 minutes. The mixture was translucent gel.

In order to neutralize phosphoric acid, the gel was dissolved into 95% ethanol containing excessive ammonia. This solution was poured into water, and polyamide was educed.

The educed polyamide was filtrated, was rinsed with ion-exchange water twice and dried, resulting in N-methoxymethylated nylon. The N-methoxymethylated nylon was referred to as "Material A".

Synthesis Examples 2 to 5 of N-methoxymethylated Nylon

N-methoxymethylated nylons were synthesized in the same manner with the Synthesis Example 1, except for a little changing in the reaction temperature, respectively, which were referred to as "Materials B to E".

The synthesized N-methoxymethylated nylons (Materials A to E) were evaluated per lot as follows.

N-methoxymethylated nylon of 5 g was weighed out, respectively, it was added to 20 g of methanol, heated and agitated, and a solution of 20% by mass was prepared. After the dissolution, the temperature of the solution was maintained at 30°.

Continuously, a viscosity was measured using a viscometer on the market (manufactured by Toki Sangyo Co., Ltd.: TVE-30L) under the following condition. The viscosity measurement results are shown in Table 1.

(Viscometer Measurement Conditions)
Cone/plate rotor: 1°34'×R24
Temperature of measurement circulation water: 30° C.
Pre-heating time: 1 min.
Number of rotations: 5 rpm

TABLE 1

| | Viscosity at 30° C. (mPa · s) |
|---|---|
| Material A | 40 |
| Material B | 44 |
| Material C | 47 |
| Material D | 50 |
| Material E | 55 |

Synthesis Example 6 of N-methoxymethylated Nylon

The method according to JP-B No. 6-93129, N-methoxymethylated nylon was re-precipitated.

More specifically, 20 g of the Material E were dissolved into 200 g of methanol by heating. After the dissolution, the temperature was cooled down to room temperature; the methanol solution was instilled into stirring 2,500 g of acetone by taking 40 minutes; and N-methoxymethylated nylon was re-precipitated.

The obtained precipitation was separated by suction filtration (Kiriyama filtrate: No. 4), and after rinsing with acetone, it was dried at 80° C. under the vacuum condition for 2 days, resulting in N-methoxymethylated nylon material. The N-methoxymethylated nylon was referred to as "Material F".

The coating liquid for the intermediate layer will be described.

Comparative Example 1

| | |
|---|---|
| N-methoxymethylated nylon (Material A) | 50 parts |
| Methanol | 700 parts |
| n-butanol | 300 parts |

N-methoxymethylated nylon is added to the heated mixture solvent of methanol and butanol and it was agitated. Heating is stopped after the complete dissolution, the temperature is cooled down to the room temperature, resulting in coating liquid for an intermediate layer. The coating liquid for the intermediate layer was referred to as "Coating Liquid 1".

Example 1

A coating liquid for an intermediate layer of Example 1 was prepared in the same manner with Comparative Example 1, except that N-methoxymethylated nylon (Material B) was used instead of the Material A, which was used in Comparative Example 1. The coating liquid for the intermediate layer was referred to as "Coating Liquid 2"

Example 2

A coating liquid for an intermediate layer of Example 2 was prepared in the same manner with Comparative Example 1, except that N-methoxymethylated nylon (Material C) was used instead of the Material A, which was used in Comparative Example 1. The coating liquid for the intermediate layer was referred to as "Coating Liquid 3".

Example 3

A coating liquid for an intermediate layer of Example 3 was prepared in the same manner with Comparative Example 1, except that N-methoxymethylated nylon (Material D) was used instead of the Material A, which was used in Comparative Example 1. The coating liquid was referred to as "Coating Liquid 4".

Comparative Example 2

A coating liquid for an intermediate layer of Comparative Example 2 was prepared in the same manner with Comparative Example 1, except that N-methoxymethylated nylon (Material E) was used instead of the Material A, which was used in Comparative Example 1. The coating liquid for the intermediate layer was referred to as "Coating Liquid 5".

Comparative Example 3

A coating liquid for an intermediate layer of Comparative Example 3 was prepared in the same manner with Comparative Example 1, except that N-methoxymethylated nylon (Material F) was used instead of the Material A, which was used in Comparative Example 1. The coating liquid of the intermediate layer was referred to as "Coating Liquid 6".

Example 4

| | |
|---|---|
| N-methoxymethylated nylon (Material B) | 50 parts |
| Methanol | 1000 parts |

N-methoxymethylated nylon is added to the heated methanol and it was agitated. Heating is stopped after the complete dissolution, the temperature is cooled down to the room temperature, resulting in coating liquid for an intermediate layer of Example 4 was prepared. The coating liquid for the intermediate layer was referred to as "Coating Liquid 7".

Example 5

A coating liquid for an intermediate layer of Example 5 was prepared in the same manner with Example 4, except that n-propanol was used for the coating solvent instead of methanol, which was used in Example 4. The coating liquid for the intermediate layer was referred to as "Coating Liquid 8".

The Coating Liquids 1 to 8 thus prepared were evaluated as the following. The results are shown in Table 2.

(1) Evaluation for Increasing Viscosity in Liquid:

The Coating Liquids 1 to 8 were stored within a sealed flask for one month under the environment at 22±1° C., respectively. The viscosity of the coating liquids was measured using TV-30 type viscometer (manufactured by Toki Sangyo Co., Ltd.: TVE-30L, cone/plate type) before storing (immediately after preparation) and after storing.

(Viscometer Measurement Conditions)

Cone/plate rotor: 1°34'×R24

Temperature of measurement circulation water: 22° C.

Pre-heating time: 1 min.

Number of rotations: 50 rpm

Furthermore, for the viscosity value of respective coating liquids, a value after 1 minute from the measurement start was adopted, respectively.

The measured value is substituted in the following Numerical Formula 1, and the rate of viscosity increase is calculated.

Rate of viscosity increase (%)=((Viscosity after predetermined storage)−(Viscosity immediately after liquid preparation))/(Viscosity immediately after liquid preparation)×100 Numerical Formula 1

The obtained values were evaluated by grading to the following Grades A to D.

Grade A: Less than 15 (Viscosity is not substantially increased, and it is in excellent condition.)

Grade B: 15 through 25 (Viscosity is increased to some extent.)

Grade C: 25 through 40 (Viscosity increased can be observed.)

Grade D: More than 40 (Viscosity is remarkably increased, and it is partially gelated.)

(2) Evaluation for Film Thickness Non-Uniformity

Films were formed to an aluminum drum with 30 mm of diameter and 340 mm of length using the Coating Liquids 1 to 8 for an intermediate layer, respectively. Respective films were deposited so as to be 1.0 μm of film thickness according to the dip coating method; the films were heated and dried, and thus samples for evaluation are prepared. As the coating liquids, the coating liquid immediately after the preparation and the coating liquid after storing for one month was used, respectively, and the condition of the film thickness non-uniformity of each sample was evaluated. The film thickness of these samples along the lengthwise and the peripheral directions of the drum were evaluated using a film thickness measuring device according to an optical interference method, respectively.

Grade A: No non-uniformity at all and uniform film thickness

Grade B: No non-uniformity and uniform film thickness

Grade C: Slightly non-uniform, but not a level to be a problem

Grade D: Seriously non-uniform (3) Pinhole Test

A pinhole detection of each sample was conducted according to the method described in Example of JP-A No. 2000-304701.

Films with 1.0 μm of film thickness were formed on an aluminum plate with 150 mm×70 mm×0.8 mm of dimension using the Coating Liquids 1 to 8 for intermediate layer, respectively, and the generation state of pinholes was observed using the device described in FIG. 1 of JP-A No. 2000-304701.

Results of the liquid stability evaluation of the coating liquids for an intermediate layer are shown in Table 2.

TABLE 2

| | | Rate of viscosity increase | Film thickness non-uniformity: Immediately after preparation | Film thickness non-uniformity: After a month | Pinhole |
|---|---|---|---|---|---|
| Comp. Example 1 | Coating Liquid 1 | B | A | C | Numerously generated |
| Example 1 | Coating Liquid 2 | A | A | B | Almost without pinhole |
| Example 2 | Coating Liquid 3 | B | A | B | Almost without pinhole |

TABLE 2-continued

| | | Rate of viscosity increase | Film thickness non-uniformity: Immediately after preparation | Film thickness non-uniformity: After a month | Pinhole |
|---|---|---|---|---|---|
| Example 3 | Coating Liquid 4 | B | A | B | Almost without pinhole |
| Comp. Example 2 | Coating Liquid 5 | D | A | D | Slightly generated |
| Comp. Example 3 | Coating Liquid 6 | D | A | D | Slightly generated |
| Example 4 | Coating Liquid 7 | A | A | B | Very slightly generated |
| Example 5 | Coating Liquid 8 | B | B | C | Almost without pinhole |

As is apparent from Table 2, the coating liquids according to the present invention showed small rate of viscosity increase even after long-term storage, so it is clear that the coating liquids can be stably stored. Further, it is clear that uniform coating with less film thickness non-uniformity can be formed even using the long-term stored coating liquids.

In the case of the Coating Liquid 1 using Material A with a lower viscosity according to the methanol measuring method, concerning the storage life of the coating liquid, even though it was within the sustainable scope for use, in the case of forming a film using the Coating Liquid 1, pinholes were numerously generated, so it could not be for practical use. Further, in the case of the Coating Liquids 5 and 6 using Material E with a higher viscosity according to the methanol measuring method, the rate of viscosity increase was great due to the storage and the coating quality (film thickness non-uniformity) after storing was terrible, so these were not also for practical use.

In the case that the coating solvent was only methanol, there was no problem on the storage life of the coating liquid and the film thickness non-uniformity. However, brushing occurred to a part of the film. Further, in the case of the single use of n-propanol, it was slightly inferior compared to the single use of methanol from the points of the storage life of the coating liquid and the film thickness non-uniformity.

As described above, using the material of which the viscosity is within the appropriate range according to the methanol measuring method enables the obtainment of film capable of maintaining stable liquid physical property after the long-term storage, and having fewer film defects.

Examples of synthesizing the titanyl phthalocyanine used in examples will be explained.

Synthesis Example 1 of Pigment

A pigment was synthesized referring to JP-A No. 2001-19871. Initially, 29.2 g of 1,3-diiminoiso indoline and 200 ml of sulfolane were mixed, and 20.4 g of titanium tetrabutoxide was dripped in nitrogen gas atmosphere. After the drip-feed was completed, the raw material was raised to 180° C. gradually, and allowed to react for five hours with stirring while keeping the temperature 170 to 180° C. After the reaction was completed and allowed to cool, the resulting precipitation was filtered, the filter cake was washed with chloroform till the cake turned to blue. Then the filter cake was washed a few times with methanol, and was washed a few times with 80° C. hot water then dried, thereby crude titanyl phthalocyanine was prepared. Then the crude titanyl phthalocyanine was dissolved into concentrated sulfuric acid having twenty times the mass of the crude titanyl phthalocyanine, the solution was dripped into ice-water having one hundred times the mass of the solution while the solution being stirred, the precipitated crystal was filtered, then water washings were repeated till pH of the filtrate came to neutral, i.e. the pH of the washed de-ionized water was 6.8. As a result, titanyl phthalocyanine pigment was prepared as the wet cake or water paste. The resulting wet cake or water paste of 40 g was put into 200 g of tetrahydrofuran, was stirred for four hours, then filtered and dried, resulting in titanyl phthalocyanine powder. The titanyl phthalocyanine powder was referred to as "Pigment 1".

The solid content in the wet cake was 15% by mass. The solvent for crystal transformation was 33 times the mass of the wet cake. By the way, the raw materials of Synthesis Example 1 of the pigment contained no halide.

Figure 16:
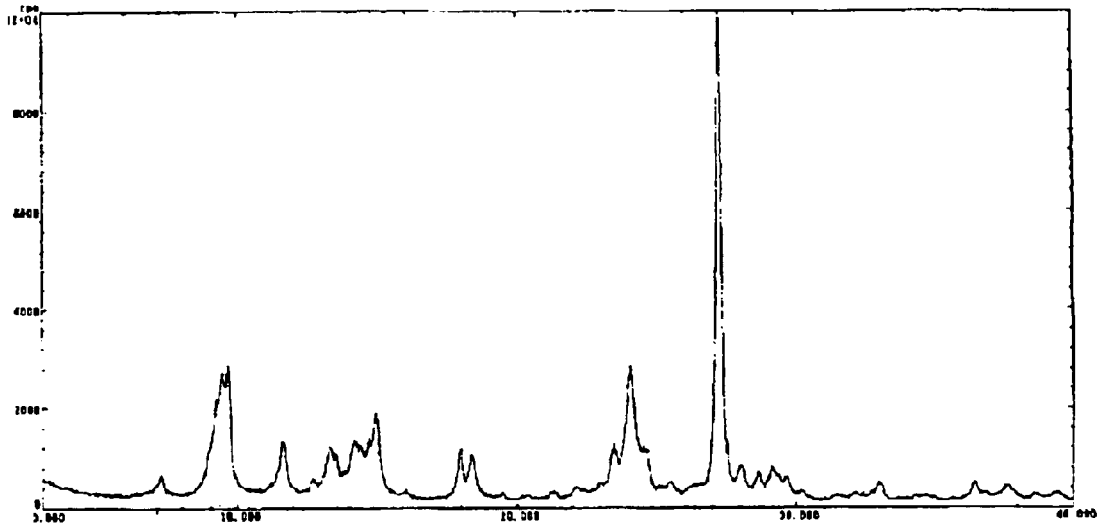
FIG. 16 shows an X-ray diffraction spectrum of titanyl phthalocyanine powder obtained in Example.

The resulting titanyl phthalocyanine powder was measured as to X-ray diffraction spectrum in the following conditions, and the titanyl phthalocyanine powder exhibit the highest peak at 27.2°±0.2°, the peak at 7.3°±0.2° as the lowest angle, and with no peaks in a range between 7.3° and 9.4°, and with no peak at 26.3° as Bragg 2θ angles in terms of CuK-α characteristic X-ray wavelength at 1.542 Å. The result is shown in FIG. 16.

Figure 17:
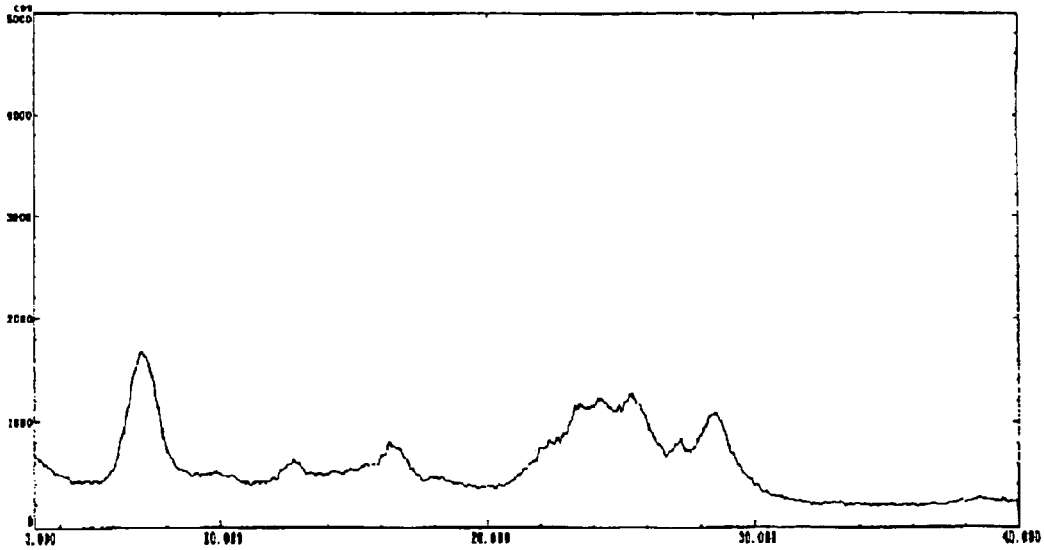
FIG. 17 shows an X-ray diffraction spectrum of dry powder of water paste obtained in Example.

Further, a part of the water paste obtained in Synthesis Example 1 of the pigment was dried at 80° C. under evacuated pressure of 5 mm Hg for two days, thereby titanyl phthalocyanine powder with lower crystallinity was obtained. X-ray diffraction spectrum of the dried titanyl phthalocyanine powder is shown in FIG. 17.

(Measuring Conditions for X-ray Diffraction Spectrum)

X-ray tube: Cu
Voltage: 50 kV
Current: 30 mA
Scanning speed: 2°/min
Scanning range: 3° to 40°
Time constant: 2 seconds Synthesis Example 2 of Pigment A titanyl phthalocyanine pigment was synthesized in a form of water paste in the similar Synthesis Example 1 of the pigment, and the product was subjected to crystal transformation in accordance with the following way, to prepare a titanyl phthalocyanine crystal having smaller primary particle size than Synthesis Example 1 of the pigment.

To the 60 parts of water paste, obtained in Synthesis Example 1 of the pigment, prior to the crystal transformation, 400 parts of tetrahydrofuran was added and was stirred vigorously at 2000 rpm by means of Homomixer (Model Mark IIf, by Kenis). The stirring was stopped when the color of the paste turned from dark blue to light blue after 20 minutes from starting the stirring, immediately then the filtering was conducted under a reduced pressure. The crystal obtained on the filter was rinsed with tetrahydrofuran to obtain a wet cake of pigment. The wet cake was dried at 70° C. under a reduced pressure of 5 mm Hg for 2 days, thereby 8.5 parts of titanyl phthalocyanine crystal was recovered, which is referred to as "Pigment 2". The raw materials of Synthesis Example 2 of the pigment contained no halide. The solid content of the wet cake was 15% by mass, the solvent for crystal transformation was 44 times the mass of the wet cake.

A part of the titanyl phthalocyanine of water paste before crystal transformation, obtained in Synthesis Example 1 of the pigment, was diluted into about 1% by mass using de-ionized water. Scooping up the upper portion of the dispersion by a cupper mesh, of which surface was treated into conductive, the titanyl phthalocyanine was observed with respect to the particle size at a magnification of 75000 times by means of a transmission electron microscope (TEM, Model H-9000NAR, by Hitachi Co.). The averaged primary particle size was determined as follows.

The observed TEM images were taken as TEM photographs, then 30 particles were randomly selected from the visually observed titanyl phthalocyanine particles having needle-like shape, the longer diameters of the respective particles were measured, and the average of the longer diameter of the 30 particles was defined as the averaged primary particle size.

The averaged primary particle size of the titanyl phthalocyanine of Synthesis Example 1 of the pigment was 0.06 μm at the state of water paste according to the method for determining the averaged primary particle size descried above.

Further, the titanyl phthalocyanine crystal after the crystal transformation and before the filtering of Synthesis Example 1 and Synthesis Example 2 were diluted to about 1% by mass using tetrahydrofuran, and the TEM images were observed and the averaged primary particle sizes were measured. The results were shown in Table 3. The titanyl phthalocyanine particles obtained in Synthesis Example 1 and Synthetic Example 2 had not necessarily the same shape, i.e. particles of approximately triangle or quadrangle shape were also observed. Accordingly, the longest diagonals of the respective particles were regarded as the longer diameter then the averaged particle size was calculated.

As shown in Table 3, the Pigment 1 obtained in Synthesis Example 1 of the pigment had a relatively large averaged particle size and also contained coarse particles. On the contrary, the Pigment 2 obtained in Synthesis Example 2 had a relatively small averaged particle size and also the individual primary particles were approximately of the similar size.

TABLE 3

| | Averaged Particle size (μm) | Remarks |
|---|---|---|
| Synthesis Example 1 (Pigment 1) | 0.31 | containing coarse particles of about 0.3 to 0.4 μm |
| Synthesis Example 2 (Pigment 2) | 0.12 | particles are approximately the similar size |

Synthesis Example 3 of Pigment

A pigment was synthesized referring to Synthetic Example 1 of JP-A No. 1-299874 (JP-B No. 2512081). That is, the wet cake obtained in Synthesis Example 1 of the pigment described above was dried, 1 g of the dried product was added to 50 g of polyethylene glycol, then the mixture was subjected to milling by a sand mill with 100 g of glass beads. After subjecting to crystal transformation, the cake was rinsed with dilute sulfuric acid, and ammonium hydroxide in turn, then was dried to prepare a pigment, which is referred to as "Pigment 3". The raw materials of Synthesis Example 3 contained no halide.

Synthesis Example 4 of Pigment

A pigment was synthesized referring to Synthesis Example 1 of JP-A No. 3-269064 (JP-B No. 2584682). That is, the wet cake obtained in Synthesis Example 1 of the pigment described above was dried, 1 g of the dried product was added to a mixed solvent of 10 g of de-ionized water and 1 g of monochlorobenzene and was stirred for one hour at 50° C., then was rinsed with methanol and de-ionized water to obtain a pigment after drying, which is referred to as "Pigment 4". The raw materials of Synthetic Example 4 contained no halide.

Synthesis Example 5 of Pigment

A pigment was synthesized referring to Synthesis Example of JP-A No. 2-8256 (JP-B No. 7-91486). That is, 9.8 g of phthalodinitrile and 75 ml of chloronaphthalene were mixed and stirred, and 2.2 ml of titanium tetrachloride was dripped in nitrogen gas atmosphere. After the drip-feed was completed, the raw material was raised to 200° C. gradually, and was allowed to react for 3 hours with stirring while keeping the temperature 200 to 220° C. After the reaction was completed and allowed to cool, the resulting precipitation was filtered at 130° C., the filter cake was washed with 1-chloronaphthalene till the cake turned to blue. Then the filter cake was washed a few times with methanol, and was washed a few times with 80° C. hot water then dried to prepare a pigment, which is referred to as "Pigment 5". The raw materials of Synthesis Example 5 contained no halide.

Synthesis Example 6 of Pigment

A pigment was synthesized referring to Synthesis Example 1 of JP-A No. 64-17066 (JP-B No. 7-97221). That is, 5 parts of alpha form TiOPc along with 10 parts of common salt and 5 parts of acetophenone were subjected to crystal transformation at 100° C. for 10 hours using a sand grinder. The product was washed with de-ionized water and methanol, purified with dilute aqueous sulfuric acid, and washed with de-ionized water till the acid component disappeared, then dried to prepare a pigment, which is referred to as "Pigment 6". The raw materials of Synthesis Example 6 contained halide.

Synthesis Example 7 of Pigment

A pigment was synthesized referring to Synthesis Example 1 of JP-A No. 11-5919 (JP-B No. 3003664). That is, 20.4 parts of o-phthalodinitrile and 7.6 parts of titanium tetrachloride were allowed to react in 50 parts of quinoline at 200° C. for 2 hours, the solvent was removed by steam distillation, then the product was purified with 2% aqueous solution of hydrochloric acid and subsequently with 2% aqueous solution of sodium hydroxide, thereafter rinsed with methanol and N,N-dimethylformamide, and dried to obtain phthalocyanine. Two parts of the phthalocyanine was dissolved little by little into 40 parts of 98% sulfuric acid at 5° C., and the solution was stirred for about one hour while maintaining the temperature at 5° C. or less. Then, the sulfuric acid solution was slowly poured into 400 parts of ice water under rapid stirring, the deposited crystal was filtered. The crystal was rinsed with distilled water till the remaining acid disappeared to obtain a wet cake. The wet cake was stirred in 100 parts of THF for about 5 hours, thereafter filtered and rinsed with THF, then dried to prepare a pigment, which is referred to as "Pigment 7". The raw materials of Synthesis Example 7 contained halide.

Synthesis Example 8 of Pigment

A pigment was synthesized referring to Synthesis Example 2 of JP-A No. 3-255456 (JP-B No. 3005052). That is, 10 parts of the wet cake synthesized in Synthetic Example 1 of pigment was added to 15 parts of sodium chloride and 7 parts of diethylene glycol, and was subjected to milling for 60 hours while heating at 80° C. by means of an auto-mortar. Then the cake was subjected to sufficient rinsing with water to remove the sodium chloride and diethylene glycol. After drying the product under a reduced pressure, 200 parts of cyclohexane and glass beads of 1 mm in diameter were added, and was subjected to milling for 30 minutes by means of a sand mill to obtain a pigment, which is referred to as "Pigment 8". The raw materials of Synthesis Example 8 contained no halide.

Synthesis Example 9 of Pigment

A pigment was synthesized referring to the process for producing titanyl phthalocyanine crystal described in JP-A No. 8-110649. That is, 58 g of 1,3-diiminoisoindoline and 51 g of tetrabutoxy titanium were allowed to react in 300 ml of alpha-chloronaphthalene at 210° C. for 5 hours, thereafter the product was rinsed with alpha-chloronaphthalene and dimethylformamide (DMF) in order. Then the product was rinsed with hot DMF, hot water, and methanol then dried to obtain 50 g of titanyl phthalocyanine. The resulting titanyl phthalocyanine of 4 g was poured into 400 g of sulfuric acid cooled at 0° C. and was stirred one hour successively. After the titanyl phthalocyanine dissolved completely, the solution was poured into a mixed liquid of 800 ml of water and 800 ml of toluene cooled at 0° C. After stirring for 2 hours at room temperature, the deposited titanyl phthalocyanine was filtered away from the solution, and was rinsed with methanol and water in order. Confirming that the rinsed water was neutral in pH, the titanyl phthalocyanine crystal was removed and dried to obtain 2.9 g of titanyl phthalocyanine crystal, which is referred to as "Pigment 9". The raw materials of Synthesis Example 9 contained no halide.

The pigments of Synthesis Examples 3 to 9 were measured with respect to X-ray diffraction spectrum and the respective identities were confirmed with the spectra described in the references. The X-ray diffraction spectrum of the pigment obtained in Synthesis Example 2 was substantially the same with that of Synthesis Example 1. Table 4 shows the peak sites and characteristics of the spectra in Synthesis Examples 1 to 9 and Synthetic Example 1.

TABLE 4

| Synthetisis Example | Pigment | Highest Peak | Lowest Angle | Peak at 9.4° | Peak at 9.6° | Peak at 7.4° to 9.4° | Peak at 24.0° | Peak at 26.3° |
|---|---|---|---|---|---|---|---|---|
| Synthesis Ex. 1 | 1 | 27.2° | 7.3° | Exist | Exist | No | Exist | No |
| Synthesis Ex. 2 | 2 | 27.2° | 7.3° | Exist | Exist | No | Exist | No |
| Synthesis Ex. 3 | 3 | 27.2° | 7.3° | No | No | No | Exist | No |
| Synthesis Ex. 4 | 4 | 27.2° | 9.6° | Exist | Exist | No | Exist | No |
| Synthesis Ex. 5 | 5 | 27.2° | 7.4° | No | Exist | No | No | No |
| Synthesis Ex. 6 | 6 | 27.3° | 7.3° | Exist | Exist | Exist (7.5°) | Exist | No |
| Synthesis Ex. 7 | 7 | 27.2° | 7.5° | No | Exist | Exist (7.5°) | Exist | No |
| Synthesis Ex. 8 | 8 | 27.2° | 7.4° | No | No | Exist (9.2°) | Exist | Exist |
| Synthesis Ex. 9 | 9 | 27.2° | 7.3° | Exist | Exist | No | Exist | No |

A method of preparing a dispersion of a coating liquid for a charge generating layer using the charge generating substance which was synthesized as described above will be described.

Preparation Example 1

Dispersion

The pigment 1, prepared in Synthesis Example 1, was dispersed in the following conditions to prepare a dispersion of a coating liquid for a charge generating layer.

| | |
|---|---|
| Pigment of titanyl phthalocyanine (Pigment 1) | 15 parts |
| Polyvinyl butyral (BX-1, Sekisui Chemical Co.) | 10 parts |
| 2-butanone | 280 parts |

Using a commercially available dispersing apparatus of beads mill type and PSZ balls of 0.5 mm in diameter, the pigment, polyvinyl butyral, and 2-butanone was poured into the dispersing apparatus, and subjected to dispersing for 30 minutes at 1200 rpm of rotor rotating number to prepare a dispersion, which is referred to as "Dispersion 1".

Preparation Examples 2 to 9

Dispersion

Dispersions were prepared in the same manner as Preparation Example 1, except for changing the pigment 1 into the pigments 2 to 9 obtained in Synthesis Example 2 to 9, which are referred to as "Dispersions 2 to 9" corresponding to the number of pigments.

Preparation Example 10

Dispersion

The dispersion 1 of Preparation Example 1 was filtered by means of a cotton-wind cartridge filter (effective pore size: 1 μm, TCW-1-CS, by Advantec Co.), which is referred to as "Dispersion 10". The filtering was carried out under a pressurized condition using a pump.

Preparation Example 11

Dispersion

A dispersion was prepared in the same manner as Preparation Example 10, except for changing the filter into a cotton-wind cartridge filter (effective pore size: 3 μm, TCW-3-CS, by Advantec Co.) under a pressurized condition using a pump, which is referred to as "Dispersion 11".

Preparation Example 12

Dispersion

A dispersion was prepared in the same manner as Preparation Example 10, except for changing the filter into a cotton-wind cartridge filter (effective pore size: 5 μm, TCW-5-CS, by Advantec Co.) under a pressurized condition using a pump, which is referred to as "Dispersion 12".

Preparation Example 13

Dispersion

Dispersion was prepared in the same manner as Preparation Example 1, except for changing the dispersing condition into 1000 rpm of rotor rotating number for 20 minutes, which is referred to as "Dispersion 13".

Preparation Example 14

Dispersion

The dispersion of Preparation Example 13 was filtered by means of a cotton-wind cartridge filter (effective pore size: 1 μm, TCW-1-CS, by Advantec Co.), which is referred to as "Dispersion 14". The filtering was carried out under a pressurized condition using a pump.

The particle distribution of the prepared dispersions was determined by means of CAPA-700 (by Horiba Co.). The results are shown in Table 5.

TABLE 5

| | Averaged Particle Size (μm) | Standard Deviation (μm) |
|---|---|---|
| Dispersion 1 | 0.29 | 0.18 |
| Dispersion 2 | 0.19 | 0.13 |
| Dispersion 3 | 0.28 | 0.19 |
| Dispersion 4 | 0.31 | 0.20 |
| Dispersion 5 | 0.30 | 0.20 |
| Dispersion 6 | 0.27 | 0.19 |
| Dispersion 7 | 0.29 | 0.20 |
| Dispersion 8 | 0.27 | 0.18 |
| Dispersion 9 | 0.26 | 0.19 |
| Dispersion 10 | 0.22 | 0.16 |
| Dispersion 11 | 0.24 | 0.17 |
| Dispersion 12 | 0.28 | 0.18 |
| Dispersion 13 | 0.33 | 0.23 |

With respect to the Dispersion 14, the filter was plugged during the filtering, consequently, all of the dispersion could not be filtered, therefore, the subsequent evaluation could not be conducted also.

Preparation Example 15

Dispersion

Dispersion having the following composition was prepared by means of a ball mill. Dispersing is conducted for 72 hours to prepare the dispersion, which is referred to as "Dispersion 15".

| | |
|---|---|
| Butyral resin (S-LEC BMS, Sekisui Chemical Co.) | 5 parts |
| Tris-azo pigment having the following structural formula (A) | 15 parts |
| Cyclohexanone | 700 parts |
| 2-butanone | 300 parts |

Structural formula (A)

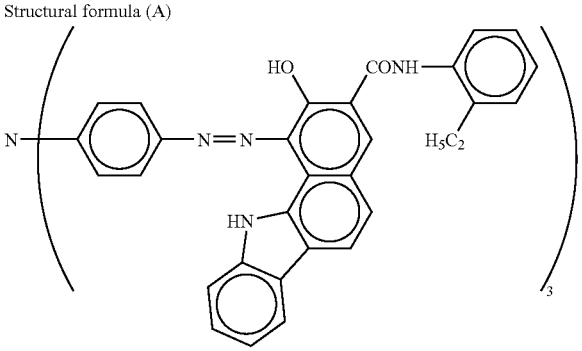

(Preparation of Photoconductor)

The method for preparing a photoconductor using the coating layer for the intermediate layer of the photoconductor as described above will be describes. The intermediate layer was formed using the coating liquid stored for a month immediately after a month under the environment at 22±1° C.

Comparative Example 4

On an aluminum cylinder (JIS 1050 series) of 60 mm in diameter, a coating liquid for moire preventive layer, coating liquid for charge blocking layer, coating liquid for charge generating layer, and coating liquid for charge transporting layer, each having a composition described below, were sequentially applied and dried to form a charge blocking layer of 0.7 μm, moire preventive layer of 3.5 μm, charge generating layer of 0.3 μm, and charge transporting layer of 25 μm, resulting in a photoconductor. The photoconductor is referred to as "Photoconductor 1".

[Coating Liquid for Charge Blocking Layer]

The Coating Liquid 1 for the intermediate layer was used for the coating liquid for charge blocking layer.

| [Coating liquid for moire preventive Layer] | |
|---|---|
| Titanium oxide (CR-EL, Ishihara Sangyo Ltd.) | 120 parts |
| Alkyde resin*1) | 14 parts |
| Melamine resin*2) | 10 parts |
| 2-butanone | 140 parts |

*1)Bekolite M6401-50-S, Solid Content: 50% Dainippon Ink and Chemicals, Inc.

*2)Super Bekamine L-121-60, Solid Content: 60% Dainippon Ink and Chemicals, Inc.

[Coating Liquid for Charge Generating Layer]

The Dispersion 2 described above was employed.

| [Coating liquid for charge transporting layer] | |
|---|---|
| Polycarbonate (TS2050, by Teijin Chemicals Ltd.) | 10 parts |
| Charge transporting substance of the following structural formula (B) | 7 parts |
| Tetrahydrofuran | 80 parts |

Structural formula (B)

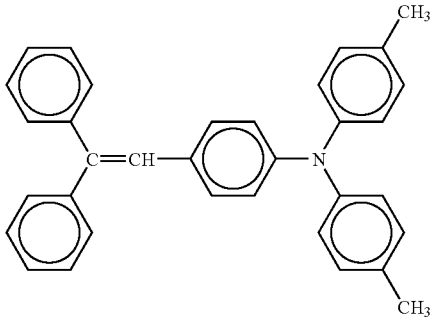

Example 6

Photoconductor was prepared in the same manner as Comparative Example 4, except that the Coating Liquid 2 was used for the coating liquid for charge blocking layer instead of the Coating Liquid 1. The photoconductor is referred to as "Photoconductor 2".

Example 7

Photoconductor was prepared in the same manner as Comparative Example 4, except that the Coating Liquid 3 was used for the coating liquid for charge blocking layer instead of the Coating Liquid 1. The photoconductor is referred to as "Photoconductor 3".

Example 8

Photoconductor was prepared in the same manner as Comparative Example 4, except that the Coating Liquid 4 was used for the coating liquid for charge blocking layer instead of the Coating Liquid 1. The photoconductor is referred to as "Photoconductor 4".

Comparative Example 5

Photoconductor was prepared in the same manner as Comparative Example 4, except that the Coating Liquid 5 was used for the coating liquid for charge blocking layer instead of the Coating Liquid 1. The photoconductor is referred to as "Photoconductor 5".

Comparative Example 6

Photoconductor was prepared in the same manner as Comparative Example 4, except that the Coating Liquid 6 was used for the coating liquid for charge blocking layer instead of the Coating Liquid 1. The photoconductor is referred to as "Photoconductor 6".

Example 9

Photoconductor was prepared in the same manner as Comparative Example 4, except that the Coating Liquid 7 was used for the coating liquid for charge blocking layer instead of the Coating Liquid 1. The photoconductor is referred to as "Photoconductor 7".

Example 10

Photoconductor was prepared in the same manner as Comparative Example 4, except that the Coating Liquid 8 was used for the coating liquid for charge blocking layer instead of the Coating Liquid 1. The photoconductor is referred to as "Photoconductor 8".

Comparative Example 7

Photoconductor was prepared in the same manner as Comparative Example 4, except that the charge blocking layer was not formed. The photoconductor is referred to as "Photoconductor 9".

Example 11

Photoconductor was prepared in the same manner as Example 6, except that the Dispersion 1 was used for the coating liquid for charge generating layer instead of the Coating Liquid 2. The photoconductor is referred to as "Photoconductor 10".

Example 12

Photoconductor was prepared in the same manner as Example 6, except that the Dispersion 3 was used for the coating liquid for charge generating layer instead of the Coating Liquid 2. The photoconductor is referred to as "Photoconductor 11".

Example 13

Photoconductor was prepared in the same manner as Example 6, except that the Dispersion 4 was used for the coating liquid for charge generating layer instead of the Coating Liquid 2. The photoconductor is referred to as "Photoconductor 12".

Example 14

Photoconductor was prepared in the same manner as Example 6, except that the Dispersion 5 was used for the coating liquid for charge generating layer instead of the Coating Liquid 2. The photoconductor is referred to as "Photoconductor 13".

Example 15

Photoconductor was prepared in the same manner as Example 6, except that the Dispersion 6 was used for the coating liquid for charge generating layer instead of the Coating Liquid 2. The photoconductor is referred to as "Photoconductor 14".

Example 16

Photoconductor was prepared in the same manner as Example 6, except that the Dispersion 7 was used for the coating liquid for charge generating layer instead of the Coating Liquid 2. The photoconductor is referred to as "Photoconductor 15".

Example 17

Photoconductor was prepared in the same manner as Example 6, except that the Dispersion 8 was used for the coating liquid for charge generating layer instead of the Coating Liquid 2. The photoconductor is referred to as "Photoconductor 16".

Example 18

Photoconductor was prepared in the same manner as Example 6, except that the Dispersion 9 was used for the coating liquid for charge generating layer instead of the Coating Liquid 2. The photoconductor is referred to as "Photoconductor 17".

Example 19

Photoconductor was prepared in the same manner as Example 6, except that the Dispersion 10 was used for the coating liquid for charge generating layer instead of the Coating Liquid 2. The photoconductor is referred to as "Photoconductor 18".

Example 20

Photoconductor was prepared in the same manner as Example 6, except that the Dispersion 11 was used for the coating liquid for charge generating layer instead of the Coating Liquid 2. The photoconductor is referred to as "Photoconductor 19".

Example 21

Photoconductor was prepared in the same manner as Example 6, except that the Dispersion 12 was used for the coating liquid for charge generating layer instead of the Coating Liquid 2. The photoconductor is referred to as "Photoconductor 20".

Example 22

Photoconductor was prepared in the same manner as Example 6, except that the Dispersion 13 was used for the coating liquid for charge generating layer instead of the Coating Liquid 2. The photoconductor is referred to as "Photoconductor 21".

Example 23

Photoconductor was prepared in the same manner as Example 6, except that the Dispersion 14 was used for the coating liquid for charge generating layer instead of the Coating Liquid 2. The photoconductor is referred to as "Photoconductor 22".

The respective photoconductors 1 to 22 were mounted to an image forming apparatus shown in FIG. 13 which utilized semiconductor laser at 780 nm as an image exposure light source (image recording by means of a polygon mirror), a scorotron charger as a charging unit and a transferring belt as a transferring unit. The photoconductor was charged to have the potential of −800 V, and a running test with 20,000 sheets was executed using a chart with 6% of rate of recording. Halftone image and screen were output and evaluated at the first sheet in the initial stage and after continuous 20,000 sheets, and the image density uniformity and the presence of background smear were checked. The test environment was at 22° C. and 55% RH. Furthermore, the background smear image was evaluated according to four grades, and the extremely excellent one was graded as A, B for excellent, C for slightly inferior and D for terrible. The results are shown in Table 6.

TABLE 6

| | Coating liquid for intermediate layer | Photoconductor | Image density uniformity | Background smear Initial | Background smear After 20,000 sheets of running | Other abnormal images |
|---|---|---|---|---|---|---|
| Comp. Ex. 4 | Coating Liquid 1 | photoconductor 1 | Slightly non-uniform | C | C-D | Nothing in particular |
| Ex. 6 | Coating Liquid 2 | photoconductor 2 | Excellently good | A | A | Nothing in particular |
| Ex. 7 | Coating Liquid 3 | photoconductor 3 | Good | A | B | Nothing in particular |
| Ex. 8 | Coating Liquid 4 | photoconductor 4 | Good | A | B | Nothing in particular |
| Comp. Ex. 5 | Coating Liquid 5 | photoconductor 5 | Seriously non-uniform | C | C | Nothing in particular |
| Comp. Ex. 6 | Coating Liquid 6 | photoconductor 6 | Seriously non-uniform | C | C | Nothing in particular |
| Ex. 9 | Coating Liquid 7 | photoconductor 7 | Good | B | C | Nothing in particular |
| Ex. 10 | Coating Liquid 8 | photoconductor 8 | Very slightly non-uniform | B | B | Nothing in particular |
| Comp. Ex. 7 | Not in use | photoconductor 9 | Good | C-D | D | Nothing in particular |
| Ex. 11 | Coating Liquid 2 | photoconductor 10 | Good | B | B | Nothing in particular |
| Ex. 12 | Coating Liquid 2 | photoconductor 11 | Good | B | C | Nothing in particular |
| Ex. 13 | Coating Liquid 2 | photoconductor 12 | Good | B | C | Nothing in particular |
| Ex. 14 | Coating Liquid 2 | photoconductor 13 | Good | B | C | Nothing in particular |
| Ex. 15 | Coating Liquid 2 | photoconductor 14 | Good | B | C | Nothing in particular |
| Ex. 16 | Coating Liquid 2 | photoconductor 15 | Good | B | C | Nothing in particular |
| Ex. 17 | Coating Liquid 2 | photoconductor 16 | Good | B | C | Nothing in particular |
| Ex. 18 | Coating Liquid 2 | photoconductor 17 | Good | B | C | Nothing in particular |
| Ex. 19 | Coating Liquid 2 | photoconductor 18 | Good | A | A | Nothing in particular |
| Ex. 20 | Coating Liquid 2 | photoconductor 19 | Good | A | A | Nothing in particular |
| Ex. 21 | Coating Liquid 2 | photoconductor 20 | Good | B | C | Nothing in particular |
| Ex. 22 | Coating Liquid 2 | photoconductor 21 | Good | C | C | Nothing in particular |
| Ex. 23 | Coating Liquid 2 | photoconductor 22 | Good | C | C | Image density was reduced |

In the case of the Coating Liquid 1 using Material A with the lower viscosity according to the methanol measuring method, background smear was inappropriate, and it is considered that this is caused by the generation of pinholes. Further, the image density non-uniformity is slightly poor. Further, in the case of using the Coating Liquid 5 using Material E with the higher viscosity according to the methanol measuring method, the image density non-uniformity was terrible, so it could not be for practical use. As described above, it is clear that using the material of which the viscosity is within the appropriate range according to the methanol measuring method enables the obtainment of excellent image.

Example 24

Photoconductor was prepared in the same manner as Example 6, except that the coating liquid having the following composition was used for the charge transporting layer. The photoconductor is referred to as "Photoconductor 23".

| [Coating liquid for charge transporting layer] | |
|---|---|
| Charge transporting substance of the following structural formula (C) ("n" in the formula was about 250 according to GPC measurement.) | 15 parts |
| Tetrahydrofuran | 120 parts |

Structural formula (C)

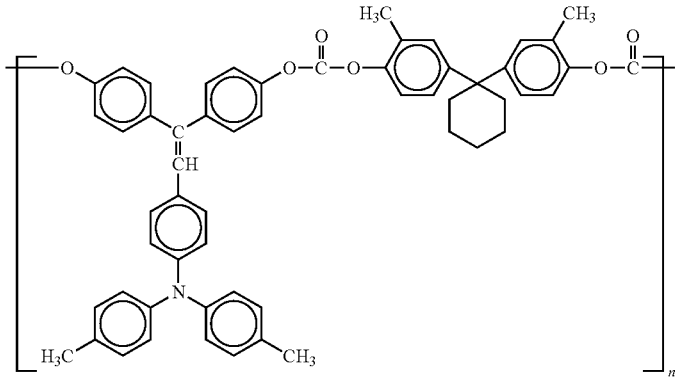

Example 25

Photoconductor was prepared in the same manner as Example 6, except that the film thickness of the charge transporting layer was changed to 20 μm, and a protective layer with 5 μm of film thickness was formed on the charge transporting layer. The protective layer was formed by applying a coating liquid having the following composition on the charge transporting layer by spray coating, and then drying, thereby a photoconductor was prepared. The photoconductor is referred to as "Photoconductor 24".

| [Coating liquid for protective layer] | |
|---|---|
| Polycarbonate (TS2050, by Teijin Chemicals Ltd., Viscosity-average molecular mass: 50,000) | 10 parts |

-continued

| [Coating liquid for protective layer] | |
|---|---|
| | 7 parts |
| Charge transporting substance of the following structural formula (B) | |
| Alumina fine particles (Specific resistance: 2.5 $\times 10^{12}$ Ωcm, Averaged primary particle size: 0.4 μm) | 4 parts |
| Cyclohexanone | 500 parts |
| Tetrahydrofuran | 150 parts |

Structural formula (B)

-continued

[Coating liquid for protective layer]

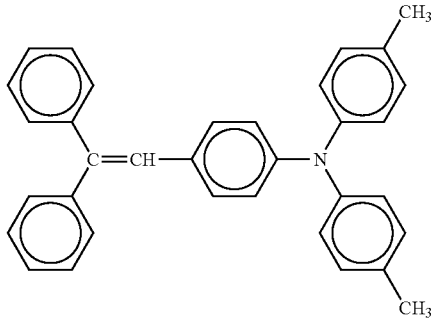

Example 26

Photoconductor was prepared in the same manner as Example 6, except that the film thickness of the charge transporting layer was changed to 20 μm, and a protective layer with 5 μm of film thickness was formed on the charge transporting layer. The protective layer was formed by applying a coating liquid having the following composition on the charge transporting layer by spray coating, and then drying, thereby a photoconductor was prepared. The photoconductor is referred to as "Photoconductor 25".

| [Coating Liquid for protective layer] | |
|---|---|
| Charge transporting substance of the following structural formula (C) ("n" in the formula was about 250 according to GPC measurement.) | 15 parts |
| Alumina fine particles (Specific resistance: $2.5 \times 10^{12}$ Ωcm, Averaged primary particle size: 0.4 μm) | 4 parts |
| Cyclohexanone | 500 parts |
| Tetrahydrofuran | 150 parts |

Structural formula (C)

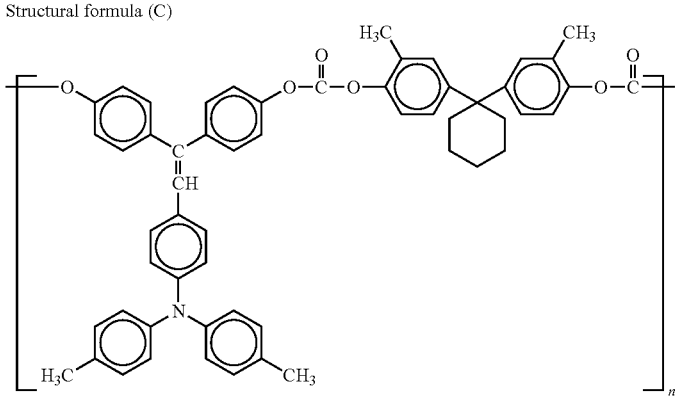

Example 27

Photoconductor was prepared in the same manner as Example 6, except that the film thickness of the charge transporting layer was changed to 20 μm, and a protective layer with 5 μm of film thickness was formed on the charge transporting layer. The protective layer was formed by applying a coating liquid having the following composition on the charge transporting layer by spray coating, and then drying, thereby a photoconductor was prepared. The photoconductor is referred to as "Photoconductor 26".

| [Coating liquid for protective layer] | |
|---|---|
| Methyl trimethoxysilane | 100 parts |
| 3% acetic acid | 20 parts |
| Charge transporting compound of the following structural formula (D) | 35 parts |
| Antioxidant (Sanol LS2626, manufactured by Sankyo Lifetech Co., Ltd.) | 1 part |
| Curing agent (dibutyltin acetate) | 1 part |
| 2-propanol | 200 parts |

Structural formula (D)

-continued

[Coating liquid for protective layer]

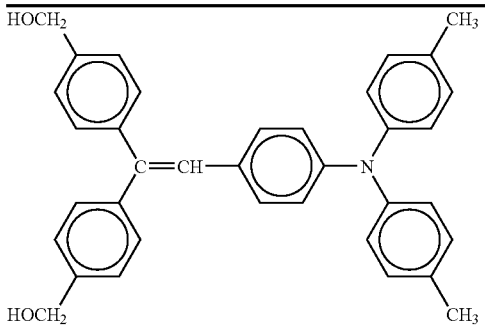

Example 28

Photoconductor was prepared in the same manner as Example 6, except that the film thickness of the charge transporting layer was changed to 20 μm, and a protective layer with 5 μm of film thickness was formed on the charge transporting layer. The protective layer was formed by the following method. That is, a coating liquid having the following composition was applied on the charge transporting layer by spray coating, the applied film was air-dried for 20 minutes and was irradiated with light under the following condition so as to cure the applied film, thereby a photoconductor was prepared. The photoconductor is referred to as "Photoconductor 27".

(Light Irradiation Condition)

Metal halide lamp: 160 W/cm

Irradiating distance: 120 mm

Irradiation intensity: 500 mW/cm$^2$

Irradiation time: 60 seconds

| [Coating liquid for protective Layer] | |
|---|---|
| Radical polymerizable monomer having three or more functionalities and no charge transporting structure (Trimethylolpropane triacrylate (KAYARAD TMPTA, Nippon Kayaku Co., Ltd.), Molecular weight: 296, Number of functional group: three functionalities, Molecular weight/number of functional group = 99) | 10 parts |
| Radical polymerizable compound having one functionality and having charge transporting structure, which has the following structural formula (E) | 10 parts |
| Photopolymerization initiator (1-hydroxy-cyclohexylphenyl-ketone (IRGACURE 184, by Ciba Specialty Chemicals)) | 1 part |
| Tetrahydrofuran | 100 Parts |

Structural formula (E)

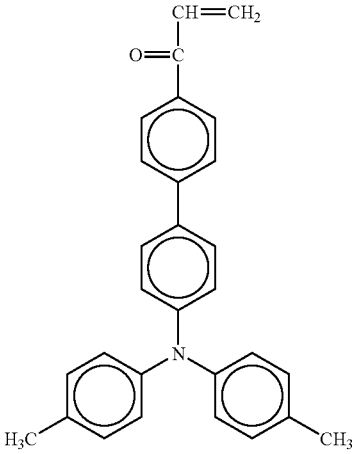

The respective photoconductors 23 to 27 were mounted to an image forming apparatus shown in FIG. 13 which utilized semiconductor laser at 780 nm as an image exposure light source (image recording by means of a polygon mirror), a scorotron charger as a charging unit and a transferring belt as a transferring unit. The photoconductor was charged to have the potential of −800 V, and a running test with 50,000 sheets was executed using a chart with 6% of rate of recording. Halftone image and screen were outputted and evaluated at the first sheet in the initial stage and after continuous 50,000 sheets, and the image density uniformity and the presence of background smear were checked. The test environment was at 22° C. and 55% RH. Furthermore, the background smear image was evaluated according to four grades, and the extremely excellent one was graded as A, B for excellent, C for slightly inferior and D for terrible.

Further, after the 50,000-sheets of running, an image forming apparatus was installed under the environment at high temperature and high humidity (30° C., 90% RH), and halftone image was output, and, the image evaluation was conducted.

In addition, the film thickness of the photoconductors at initial and after 50,000 sheets of running was measured, and the abrasion wear of the surface layer of the photoconductor after the 50,000 sheet of running was evaluated.

The results are shown in Table 7.

TABLE 7

| | | | Background smear | | Evaluation results | |
|---|---|---|---|---|---|---|
| | Coating liquid for an intermediate layer | photoconductor | Initial | After 50,000 sheets of running | at high temparature and high humidity | Amount of abrasion Wear (μm) |
| Example 6 | Coating Liquid 2 | photoconductor 2 | A | B-C | Black streak was slightly generated | 4.2 |
| Example 24 | Coating Liquid 2 | photoconductor 23 | A | B | Good | 2.8 |
| Example 25 | Coating Liquid 2 | photoconductor 24 | A | A-B | Image blur was slightly generated | 1.5 |
| Example 26 | Coating Liquid 2 | photoconductor 25 | A | A-B | Image blur was very slightly generated | 1.2 |
| Example 27 | Coating Liquid 2 | photoconductor 26 | A | A-B | Good | 0.8 |
| Example 28 | Coating Liquid 2 | photoconductor 27 | A | A | Good | 0.5 |

As is apparent from Table 7, the protective layer on the surface of the photoconductor caused remarkable reduction of the abrasion wear on the surface layer due to the repeated use. Further, accompanied with this reduction of abrasion wear, the background smear control effectively, which is one of effects of the present invention, becomes further remarkable.

Further, the type of the protective layer causes slightly different efficacy. In the case of the protective layer in which filler is dispersed so as to improve the abrasion resistance, even though the abrasion wear was improved and the background smear characteristic was also improved, a side effect to generate a light image blur occurred under the environment at high temperature and high humidity (however, it is not a level to be problematic).

In the meantime, in the case of using the cross-linked protective layer having the charge transporting structure (Photoconductors 26 and 27), not only the abrasion wear remarkably reduced and the background smear characteristic was improved, but no image blur also occurred under the environment at high temperature and high humidity. In addition, in the case using an acryloyloxy group and/or a methacryloyloxy group for the functional group in the radical polymerizable monomer having three or more functionalities and no charge transporting structure (Photoconductor 27), the most preferable result was obtained.

Comparative Example 8

Photoconductor was prepared in the same manner as Comparative Example 4, except that an aluminum cylinder (JIS 1050) of 30 mm in diameter was used for the support instead of the aluminum cylinder of 60 mm. The photoconductor is referred to as "Photoconductor 28".

Example 29

Photoconductor was prepared in the same manner as Example 6, except that an aluminum cylinder (JIS 1050) of 30 mm in diameter was used for the support instead of the aluminum cylinder of 60 mm. The photoconductor is referred to as "Photoconductor 29".

Example 30

Photoconductor was prepared in the same manner as Example 7, except that an aluminum cylinder (JIS 1050) of 30 mm in diameter was used for the support instead of the aluminum cylinder of 60 mm. The photoconductor is referred to as "Photoconductor 30".

Example 31

Photoconductor was prepared in the same manner as Example 8, except that an aluminum cylinder (JIS 1050) of 30 mm in diameter was used for the support instead of the aluminum cylinder of 60 mm. The photoconductor is referred to as "Photoconductor 31".

Comparative Example 9

Photoconductor was prepared in the same manner as Comparative Example 5, except that an aluminum cylinder (JIS 1050) of 30 mm in diameter was used for the support instead of the aluminum cylinder of 60 mm. The photoconductor is referred to as "Photoconductor 32".

Comparative Example 10

Photoconductor was prepared in the same manner as Comparative Example 6, except that an aluminum cylinder (JIS 1050) of 30 mm in diameter was used for the support instead of the aluminum cylinder of 60 mm. The photoconductor is referred to as "Photoconductor 33".

Comparative Example 11

Photoconductor was prepared in the same manner as Comparative Example 7, except that an aluminum cylinder (JIS 1050) of 30 mm in diameter was used for the support instead of the aluminum cylinder of 60 mm. The photoconductor is referred to as "Photoconductor 34".

Four each of the Photoconductors 28 to 34 produced as described above were prepared, and they were mounted on the process cartridge shown in FIG. 15, and in addition, these process cartridges were mounted on a tandem type full-color image forming apparatus shown in FIG. 14. Semiconductor laser at 780 nm was used as the image exposure light source (image recording by polygon mirror). The charging unit was arranged adjacent to the photoconductor by winding an insulating tape with 50μ of thickness in non-image forming regions at both sides of the charging roller. On that occasion, DC bias was set at 900 (−V) and AC bias (Vpp (Peak to peak): 1.9 kV, frequency: 1.0 kHz) was superposed, and the developing bias was set at 650 (−V). The same developers were filled into the process cartridges in which each photoconductor sample was mounted, respectively, and they were set to cyan station, magenta station, cyan station and black station, and while the stations were rotated every 10,000 sheets, a total of 40,000 sheets of image output was repeatedly performed, and then, the image evaluation was conducted. The test environment was at 23° C. and 55% RH.

Furthermore, the image evaluation was graded according to the following four levels:

A: Very excellent

B: Slight image deterioration was observed, but it is not problematic

C: Image defect was clearly confirmed

D: Effect of image defect is great and the image quality was terrible

These results are shown in Table 8.

TABLE 8

| | | | Background smear | | |
|---|---|---|---|---|---|
| | Coating Liquid | Photoconductor | Initial | After 40,000 sheets of running | Other abnormal images |
| Comp. Example 7 | Coating Liquid 1 | photoconductor 28 | C | C-D | Color reproducibility was slightly poor |

TABLE 8-continued

| | Coating Liquid | Photoconductor | Background smear Initial | Background smear After 40,000 sheets of running | Other abnormal images |
|---|---|---|---|---|---|
| Example 29 | Coating Liquid 2 | photoconductor 29 | A | A | Good |
| Example 30 | Coating Liquid 3 | photoconductor 30 | A | B | Good |
| Example 31 | Coating Liquid 4 | photoconductor 31 | A | B | Good |
| Comp. Example 8 | Coating Liquid 5 | photoconductor 32 | C | C | Color reproducibility was poor |
| Comp. Example 9 | Coating Liquid 6 | photoconductor 33 | C | C | Color reproducibility was poor |
| Comp. Example 10 | Not in use | photoconductor 34 | C-D | D | Color reproducibility was poor |

As is apparent from Table 8, in the case of the Coating Liquid 1 using Material A with the lower viscosity according to the methanol measuring method, background smear was inappropriate, and it is considered that this is caused by the generation of pinholes. Further, the color reproducibility is slightly poor. Further, in the case of using the Coating Liquid 5 using Material E with the higher viscosity according to the methanol measuring method, the color reproducibility was terrible, so it could not be for practical use. As described above, it is clear that using the material of which the viscosity is within the appropriate range according to the methanol measuring method enables the obtainment of excellent image.

Finally, the peak at 7.3° of the lowest angle as Bragg 2θ angles in terms of the CuK-α characteristic X-ray wave, which is a feature of the titanyl phthalocyanine crystal employed in the present invention, will be examined as to the identity with the peak at 7.5° of the lowest angle in the conventional material.

Synthesis Example 10 of Pigment

A titanyl phthalocyanine was prepared in the same manner as Synthesis Example 1 of the pigment, except for changing the solvent for crystal transformation from methylene chloride to 2-butanone.

Figure 18:
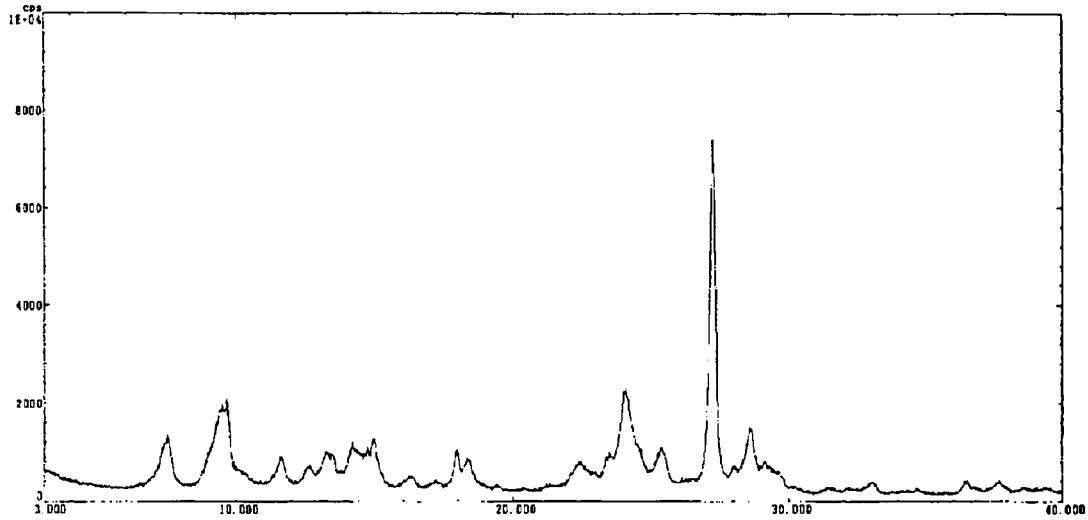
FIG. 18 shows an X-ray diffraction spectrum of titanyl phthalocyanine crystals obtained in Example.

X-ray diffraction pattern of the titanyl phthalocyanine crystal of Synthesis Example 10 was measured in the same manner as Synthesis Example 1, which is shown in FIG. 18. As being understood from FIG. 18, the lowest angle of the X-ray diffraction spectrum of Synthesis Example 10 is 7.5°, which is different from the lowest angle of 7.3° in Synthesis Example 1.

Measuring Example 1

To the pigment having the lowest angle of 7.3° obtained in Synthesis Example 1 of the pigment, the pigment having the lowest angle of 7.5° prepared in accordance with JP-A No. 61-239248 was added in an amount of 3% by mass, and mixed in a pestle, then X-ray diffraction pattern was measure. The X-ray spectrum of Measuring Example 1 is shown in FIG. 19.

Measuring Example 2

Figure 20:
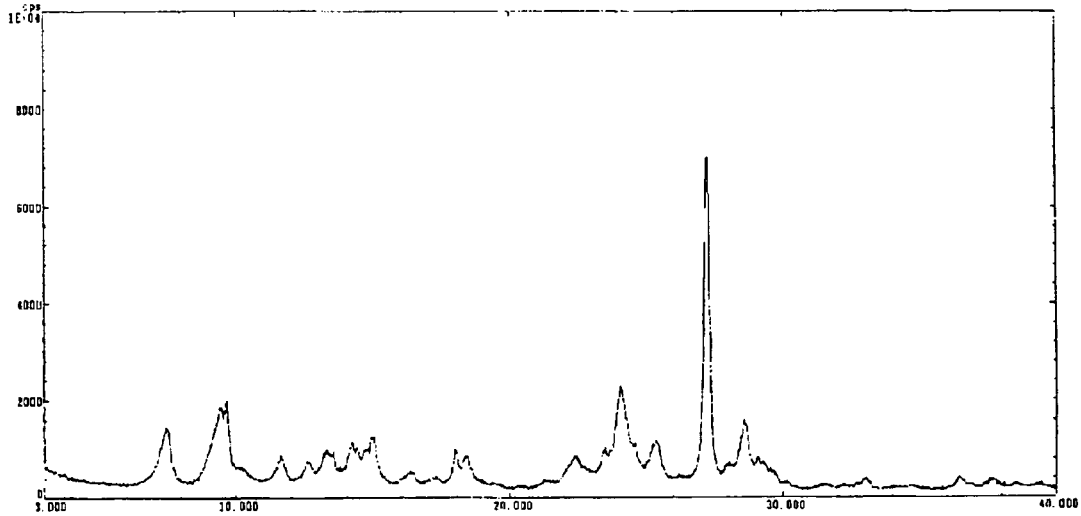
FIG. 20 shows still another X-ray diffraction spectrum of titanyl phthalocyanine crystals obtained in Example.

To the pigment having the lowest angle of 7.5° obtained in Synthesis Example 10, the pigment having the lowest angle of 7.5° prepared in accordance with JP-A No. 61-239248 was added in an amount of 3% by mass, and mixed in a pestle, then X-ray diffraction pattern was measure. The X-ray spectrum of Measuring Example 2 is shown in FIG. 20.

Figure 19:
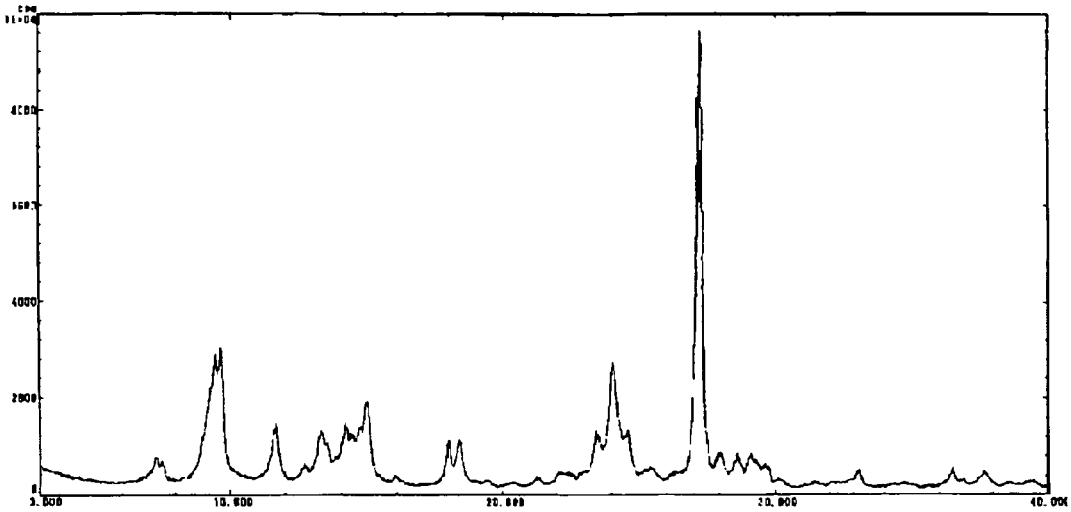
FIG. 19 shows another X-ray diffraction spectrum of titanyl phthalocyanine crystals obtained in Example.

In the spectrum shown in FIG. 19, two peaks exist independently at lower angle side of 7.3° and 7.5°, therefore, the peaks of 7.3° and 7.5° are confirmed to be at least different each other. On the other hand, in the spectrum shown in FIG. 20, only the peak of 7.5° exist at lower angle side, which is clearly different from FIG. 19.

From the results, it is understood that the peak at 7.3° of the lowest angle of the titanyl phthalocyanine crystal employed in the present invention is different from the peak at 7.5° of the lowest angle in the conventional material.

What is claimed is:

1. An electrophotographic photoconductor, comprising a support, an intermediate layer and a photoconductive layer in this order, wherein the intermediate layer is formed using a coating liquid which comprises at least one of alcohol solvents and N-methoxymethylated nylon, and the N-methoxymethylated nylon has solution viscosity within a range from 43 mPa·s to 50 mPa·s when dissolving into methanol at 30 ° C. in a concentration of 20% by mass.

2. The photoconductor according to claim 1, wherein the photoconductive layer comprises a charge generating layer and a charge transporting layer.

3. The photoconductor according to claim 1, wherein the intermediate layer comprises multiple layers.

4. The photoconductor according to claim 3, wherein the intermediate layer comprises a charge blocking layer and a moire preventive layer on the charge blocking layer.

5. The photoconductor according to claim 4, wherein the charge blocking layer contains N-methoxymethylated nylon.

6. The photoconductor according to claim 2, wherein a charge generating material contained in the charge generating layer is titanyl phthalocyanine.

7. The photoconductor according to claim 6, wherein the titanyl phthalocyanine is titanyl phthalocyanine crystal showing a highest diffraction peak at least at 27.2°, main peaks at 9.4°, 9.6° and 24.0°; a diffraction peak as a lowest-angle leak at 7.3°, and has no peaks in a range between 7.3° and 9.4° and at 26.3° as Bragg 2θ angles (±0.2°) in terms of CuK-α characteristic X-ray wavelength at 1.542 Å; and having 0.25 μm or less of average particle size of primary particles.

8. The photoconductor according to claim 7, wherein the photoconductive layer or the charge generating layer is formed by:

using the titanyl phthalocyanine crystal particles having an average particle size of 0.3 μm or less;

dispersing the titanyl phthalocyanine crystal particles to prepare a dispersion till the standard deviation of the average particle size reduces to 0.2 μm or less;

filtering the dispersion by means of a filter having an effective pore size of 3.0 μm or less; and coating the dispersion to form the photoconductive layer or the charge generating layer.

9. The photoconductor according to claim 7, wherein the titanyl phthalocyanine crystal particles are formed through:

transforming amorphous or lower crystallinity titanyl plithalocyanine, which shows a highest diffraction peak in a range between 7.0° and 7.5° as Bragg 2θ angles (±0.2°) in terms of the CuK-α characteristic X-ray wavelength at 1.542 Å, a peak width at half height of the highest peak of 1° or more, and an average primary particle size of 0.1 μm or less, by using an organic solvent in the presence of water; and separating the transformed titanyl phthalocyanine from the organic solvent before the average primary particle size of the transformed titanyl phthalocyanine grows above 0.25 μm or more.

10. The photo conductor according to claim 6, wherein the titanyl phthalocyanine particles are synthesized using raw materials free from halides.

11. The photoconductor according to claim 9, wherein the amorphous or lower crystallinity titanyl phthalocyanine prior to the transforming is produced by an acid paste process that involves such sufficient rinsing with de-ionized water that the rinsed deionized water exhibits at least one of a pH of 6.0 to 8.0 and a specific conductivity of 8.0 or less.

12. The photoconductor according to claim 6, wherein the transforming of the titanyl phthalocyanine is conducted using the organic solvent 30 times or more than the amount of the amorphous or lower crystallinity titanyl phthalocyanine.

13. The photoconductor according claim 1, further comprising a protective layer on the photoconductive layer.

14. The photoconductor according to claim 13, wherein the protective layer is a cross-linked protective layer having a charge transporting structure.

15. The photoconductor according to claim 14, wherein the cross-linked protective layer comprises a reaction product of a radical polymerizable compound having one functionality and the charge transporting structure and a radical polymerizable monomer having three or more functionalities and no charge transporting structure, and a functional group of the radical polymerizable monomer having three or more functionalities and no charge transporting is at least one of acryloyloxy group and methacryloyloxy group.

16. An image forming apparatus, comprising:

an electrophotographic photoconductor;

a charging unit configured to charge the photoconductor;

an exposing unit configured to expose the charged photoconductor by the charging unit with a recording light to form a latent electrostatic image on the photoconductor;

a developing unit configured to supply a developer to the latent electrostatic image to form a visible toner image on the photoconductor; and a transferring unit configured to transfer the toner image onto a transfer material, wherein the photoconductor comprises a support, an intermediate layer and a photoconductive layer in this order, the intermediate layer is formed using a coating liquid which comprises at least one of alcohol solvents and N-methoxymethylated nylon, and the N-methoxymethylated nylon has solution viscosity within a range from 43 mPa·s to 50 mPa·s when dissolving into methanol at 30° C. in a concentration of 20% by mass.

17. The image forming apparatus according to claim 16, comprising a plurality of image forming units each comprising at least the photoconductor, the charging unit, the exposing unit and the developing unit.

18. The image forming apparatus according to claim 16, further comprising a cleaning unit, wherein the photoconductor and at least one unit selected from the group consisting of the charging unit, the exposing unit, the developing unit and the cleaning unit are formed in an integral construction detachably mounted to a main body of the image forming apparatus.

19. A process cartridge for an image forming apparatus, wherein the process cartridge has a photoconductor and at least one unit selected from the group consisting of a charging unit configured to charge the photoconductor, an exposing unit configured to expose the charged photoconductor by the charging unit with a recording light to form a latent electrostatic image on the photoconductor, a developing unit configured to supply a developer to the latent electrostatic image to form a visible toner image on the photoconductor, a transferring unit configured to transfer the toner image onto a transfer material, a cleaning unit configured to clean the toner remaining on the photoconductor after the transferring, and a charge-eliminating unit configured to eliminate the latent electrostatic image on the photoconductor after the transferring, which is mounted detachably to a main body of an image forming apparatus, the photoconductor comprises a support, and an intermediate layer and a photosensitive layer in this order, the intermediate layer is formed using a coating liquid which comprises at least one of alcohol solvents and N-methoxymethylated nylon, and the N-methoxymethylated nylon has solution viscosity within a range from 43 mPa·s to 50 mPa·s when dissolving into methanol at 30 ° C. in a concentration of 20% by mass.

* * * * *